US011160708B2

(12) United States Patent
Saayman

(10) Patent No.: US 11,160,708 B2
(45) **Date of Patent: *Nov. 2, 2021**

(54) LIFTING DEVICE FOR DISABLED PERSON

(71) Applicant: Jacobus Hendrik Saayman, Carindale (AU)

(72) Inventor: Jacobus Hendrik Saayman, Carindale (AU)

(73) Assignee: PANO SOLUTIONS PTY. LTD., Carindale (AU)

( * ) Notice: Subject to any disclaimer, the term of this patent is extended or adjusted under 35 U.S.C. 154(b) by 229 days.

This patent is subject to a terminal disclaimer.

(21) Appl. No.: 16/161,059

(22) Filed: Oct. 16, 2018

(65) Prior Publication Data

US 2019/0060150 A1 Feb. 28, 2019

Related U.S. Application Data

(63) Continuation-in-part of application No. 14/653,920, filed on Jun. 19, 2015, now Pat. No. 10,117,799.

(51) Int. Cl.
*A61G 7/10* (2006.01)

(52) U.S. Cl.
CPC ..... *A61G 7/1051* (2013.01); *A61G 7/1017* (2013.01); *A61G 7/1019* (2013.01); *A61G 7/1046* (2013.01); *A61G 7/1048* (2013.01); *A61G 7/1067* (2013.01); *A61G 7/1061* (2013.01); *A61G 7/1074* (2013.01); *A61G 2200/34* (2013.01)

(58) Field of Classification Search
CPC .. A61G 7/1013; A61G 7/1019; A61G 7/1017; A61G 7/1051; A61G 7/1067; A61G 7/018; A61G 7/1076; A61G 7/1046; A61G 2200/34
See application file for complete search history.

(56) References Cited

U.S. PATENT DOCUMENTS 3,188,657 A * 6/1965 Cotner ..... A61G 7/1003 4/562.1
3,356,184 A * 12/1967 Bidgood ..... A61G 7/1019 187/231
3,394,933 A * 7/1968 Benoit ..... A61G 7/1094 482/67
3,815,163 A * 6/1974 Sullivan ..... A61G 7/1003 4/562.1

(Continued)

*Primary Examiner* — Peter M. Cuomo
*Assistant Examiner* — Ifeolu A Adeboyejo
(74) *Attorney, Agent, or Firm* — David Guerra

(57) ABSTRACT

The invention provides an electronically control motorized lifting device for transfer of a paraplegic between seated positions. A post extends from a wheeled base and movably supports a head for upwards and downwards movement. A lifting arm arrangement is pivotably secured to the head. The head is also rotatable about the post and the base movable between an expanded stabilizing condition and a retracted condition. The latter condition allows the lifting device to fit through a standard width doorway. Movement of the base between these conditions is effected by pivoting of the lifting arm arrangement into and out of a lateral supporting position. The base preferably includes five legs extending substantially radially from the post with two of the legs foldable towards adjacent legs.

39 Claims, 36 Drawing Sheets

(56) References Cited

U.S. PATENT DOCUMENTS

| | | | | | |
|---|---|---|---|---|---|
| 4,206,523 | A * | 6/1980 | James | A61G 7/1019 | 4/562.1 |
| 4,571,758 | A * | 2/1986 | Samuelsson | A61G 7/1019 | 4/460 |
| 6,112,346 | A * | 9/2000 | Agadzi | A61G 7/1015 | 5/83.1 |
| 6,119,287 | A * | 9/2000 | Phillips | A61G 7/1017 | 5/81.1 RP |
| 6,430,761 | B1 * | 8/2002 | Brandorff | A61G 7/053 | 5/81.1 R |
| 7,003,820 | B1 * | 2/2006 | Iura | A61G 5/128 | 5/83.1 |
| 8,336,133 | B2 * | 12/2012 | Palay | A61G 7/1069 | 5/83.1 |
| 2003/0110561 | A1 * | 6/2003 | Porcheron | A61G 7/1096 | 5/86.1 |

* cited by examiner

A

B

C

D

LIFTING DEVICE FOR DISABLED PERSON

CROSS-REFERENCE TO RELATED APPLICATION

This application is a continuation-in-part under 35 U.S.C. § 120 based upon co-pending U.S. patent application Ser. No. 14/653,920 filed on Dec. 20, 2013, which is incorporated herein by reference in its entirety.

BACKGROUND

Field of the Invention

This invention relates to a lifting device for a disabled person and more specifically, but not exclusively, to a lifting device for a paraplegic person to facilitate transfer from one seated position to another seated position.

Background to the Invention

Paraplegia is an impairment of the lower extremities of a person's body. Paraplegics are able to use their shoulders and arms but cannot use their legs or muscles from the waist down. The disability presents various difficulties for a person's daily activities. One such difficulty is encountered where the disabled person needs to be transferred between a bed, a wheelchair and possibly a toilet seat.

Various devices exist to assist the transfer of the paraplegic to and from one seated position to another. One such device includes a base with wheels and slings on a lifting arm onto which the paraplegic positions himself. The lifting arm is then raised by lifting means such as a hydraulic jack and the device can then be maneuvered into position, above the wheelchair, to lower the paraplegic into the wheelchair.

Users of most mobile lifts are dependent on the assistance of another individual to enable them to be transferred from one position/location to another. Available mobile lifts typically lift the invalid but as they are unable to rotate, an assistant must push the lift with the user being supported until aligned with the new seating position. Lifts that can be used by an invalid without any assistance are typically not mobile, but rather removable at best and mounted to the floor or another structure in a specific location, which allows the invalid limited independence. This impacts hugely on the independence of the invalid and additionally introduces a cost for having the assistant or limits the freedom of a family member.

A problem with this type of device is that the paraplegic requires assistance to use the device.

OBJECT OF THE INVENTION

It is an object of this invention to provide a lifting device that, at least partially, alleviates some of the difficulties associated with the prior art.

SUMMARY OF THE INVENTION

In accordance with the invention there is provided a lifting device comprising a wheeled base with a post extending from the base, the post movably supporting a head for upwards and downwards movement, and the head having a lifting arm arrangement attached thereto, characterized in that the head is rotatable about the post and the base movable between an expanded stabilizing condition and a retracted condition.

One aspect of the present technology is a mobile lifting system including a wheeled base unit is movable between an expanded stabilizing condition and a retracted condition and configured for operation, to move the base unit between the stabilizing condition and the retracted condition. A post can extend from the base, and movably supporting a head for upwards and downwards movement. The head being rotatable about the post through at least 180°. A lifting arm arrangement can be pivotably attached to the head. A motor can be configured to rotate the head about the post and movable between a supporting position and an inoperative position. An electronic control unit can be configured or configurable to control at least one motive element in the base unit that moves the base into the stabilizing condition when the lifting arm arrangement is in the supporting position and moves the base unit into the retracted condition when the lifting arm arrangement is in the inoperative position.

Another aspect of the present technology is a mobile lifting system including a wheeled base unit is movable between an expanded stabilizing condition and a retracted condition and configured for operation, to move the base unit between the stabilizing condition and the retracted condition. A post can extend from the base, and movably supporting a head for upwards and downwards movement. The head can be rotatable about the post through at least 180°. A lifting arm arrangement can be pivotably attached to the head. A motor can be configured to rotate the head about the post and movable between a supporting position and an inoperative position. A rotation limiting mechanism can be associated with the post and configured or configurable to control a range of rotation of the head about the post.

The invention further provides for a lifting device as defined in which the lifting arm arrangement is pivotably secured to the head and movable between a supporting position and an inoperative position, and the arm arrangement is connected to the base through a linkage which moves the base into the stabilizing condition when the arm arrangement is in the supporting position and moves the base into the retracted condition when the arm arrangement is in the inoperative position; and in which the linkage secures the base in the stabilizing condition while the arm arrangement remains in the supporting position.

Further features of the invention provided for a lifting device as defined in which the lifting arm arrangement includes a pair of spaced apart arms extending from a cross-beam pivotably secured to the head; and wherein the arms when in the supporting position extend laterally from the head and in the inoperative position extend upwardly from the head.

Further features of the invention provided for a lifting device as defined in which wheels of the base are arranged substantially equally spaced apart on a diameter about the post when the base is in the stabilizing condition; in which the base includes a plurality of legs extending substantially radially from the post in the stabilizing condition, with at least one of the legs being movable from a radial position towards an adjacent leg to bring the base into the retracted condition; having five legs, two of which are hingedly connected to the post and foldable towards adjacent legs.

Further features of the invention provided for a lifting device as defined in which the head includes an actuator, for movement relative to the post, accessible to a person supported by the lifting arm; and in which the actuator is a rotatable handle provided on the head.

Further features of the invention provided for a lifting device as defined in which the handle is rotatable in opposite directions to rotate the head alternately about the post; and in which the handle turns an outer rotary gear, rotatably supported in relation to the head that runs on track provided by an inner annular gear, which is coaxial and fixed relative to the post.

Further features of the invention provided for a lifting device as defined in which the handle is rotatable in opposite directions to respectively raise and lower the head on the post; and in which the handle axially turns a screw-threaded rod rotatably fixed to the head which extends through a correspondingly screw-threaded bore in a carrier fixed to the post.

Another aspect of the present technology can be a mobile lifting system including a base having one or more wheels, and a post extending from the base. The base can include a plurality of substantially equally spaced apart legs extending substantially radially relative to the post. The post can be movably supporting a head configured for upwards and downwards movement. The head can have a lifting arm arrangement attached thereto, with the head being rotatable about the post for transfer of a person between two seating positions which are angularly displaced and in proximity of the post. The head can include an actuator configured for effecting movement relative to the post. The post being located substantially at a centre of the base configured to provide stability as the lifting arm arrangement on the head is rotated about the post while supporting the person. The device can be configured for operation, to move the head upward and downward on the post and to rotate the head about the post, by the person using the device and for movement with a wheelchair by the disabled person using the wheelchair.

BRIEF DESCRIPTION OF THE DRAWINGS

One embodiment of the invention is described below, by way of example only, with reference to the accompanying drawings, in which.

DETAILED DESCRIPTION OF THE INVENTION

Figure 1:
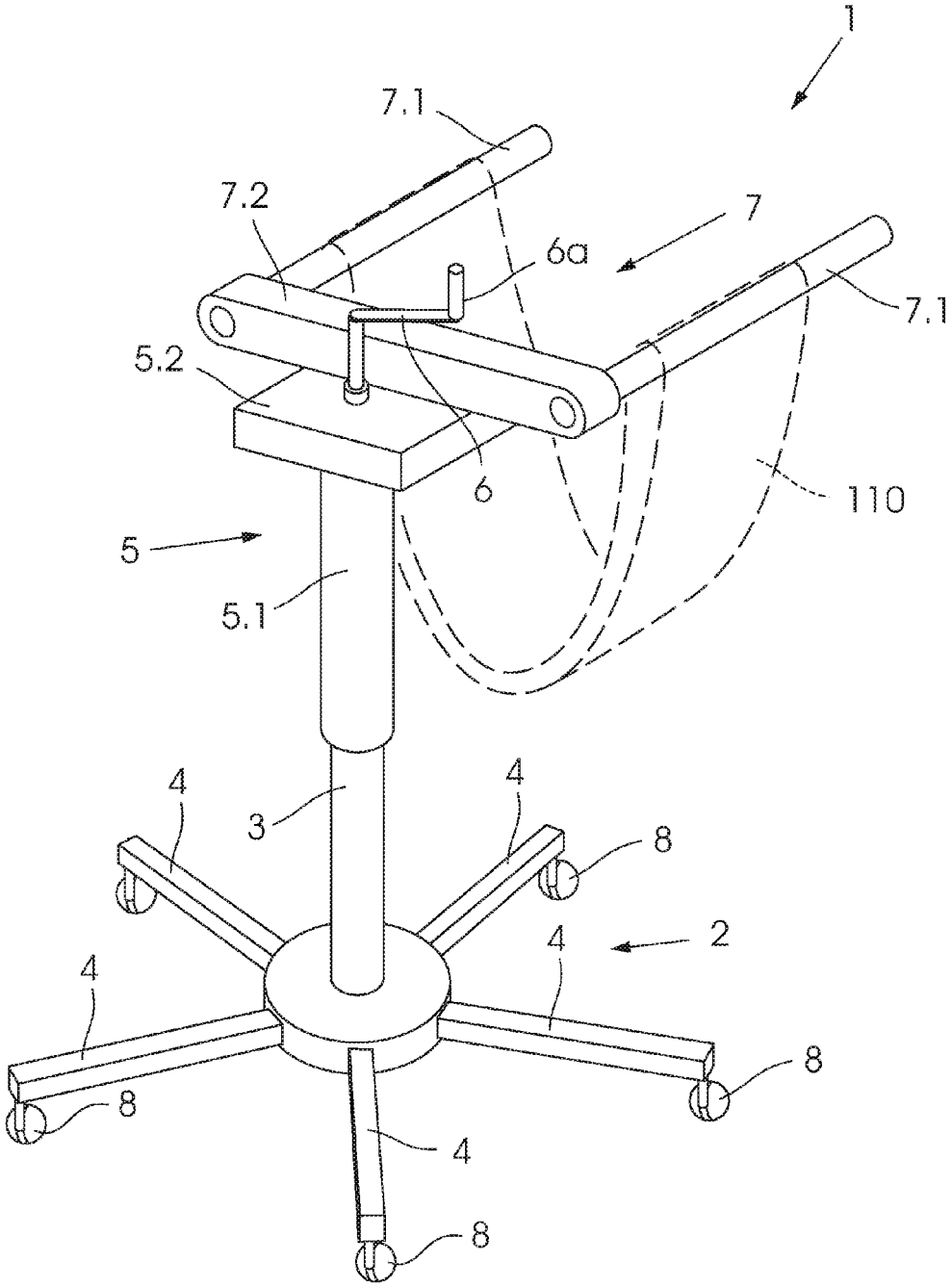
FIG. 1 is a perspective view of a lifting device.

With reference to the drawings, in which like features are indicated by like numerals, a lifting device or lift is generally indicated by reference numeral 1.

The lift 1 includes a base 2 and a post 3 extending from the base. The base 2 comprises a plurality of legs 4, which extend substantially laterally from a hub at the lower end of the post 3. The legs 4 are each provided with a castor wheel 8 at the outer end thereof. In this embodiment, there are five legs 4, which are radially arranged and equally spaced apart with the base 2 expanded in a stabilizing condition as shown in FIGS. 1 and 2.

A head 5 is movably supported by the post 3. The head includes a sleeve 5.1 located over the upper end of the post 3. The sleeve 5.1 forms a telescopic extension of the post 3. At the top of the sleeve 5.1 is a housing 5.2. The configuration of the housing 5.2 will vary depending on the mechanisms required for operation of the lift 1. Examples of these are described below.

A lifting arm arrangement 7 is supported on the housing 5.2 of the head 5. The arrangement 7 includes a pair of spaced apart lifting arms 7.1, which extend from a cross-beam 7.2 that is pivotably connected to the head 5. A sling 110 is removably securable to the arms 7.1, for supporting a person's lower body when using the lift 1.

Figure 2:
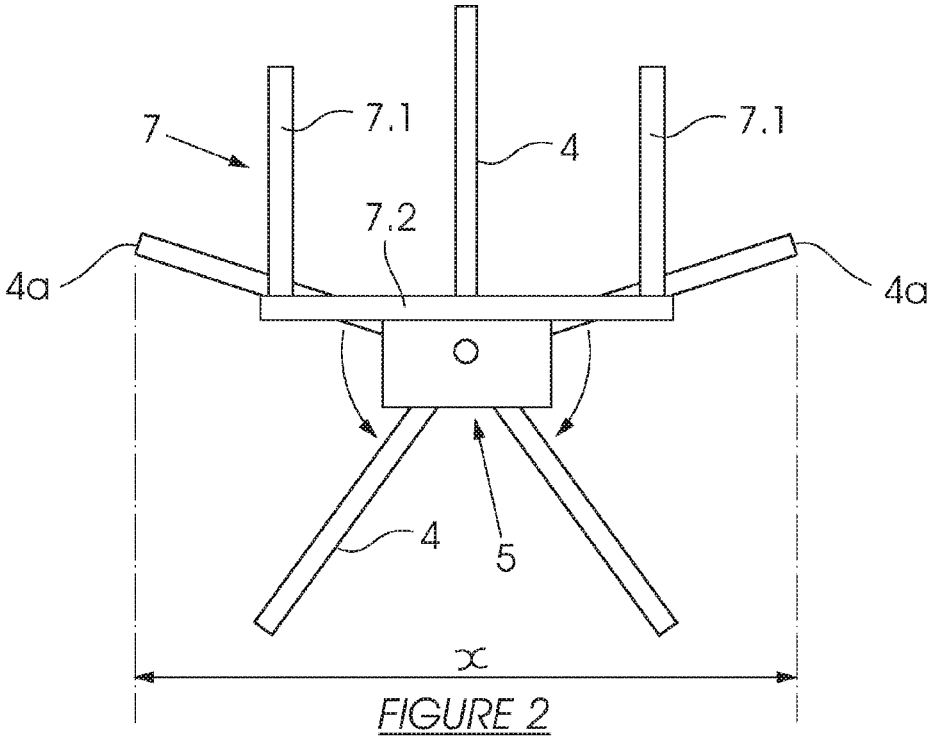
FIG. 2 is a schematic plan view of a lifting device, with the base in a stabilizing condition.
Figure 3:
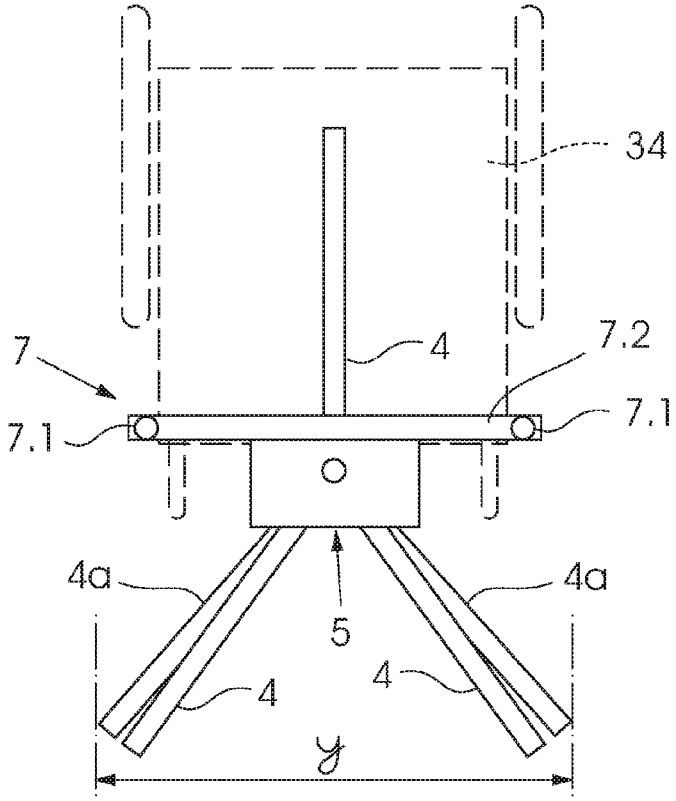
FIG. 3 is a schematic plan view of the lifting device in FIG. 2, with the base in a retracted condition.
Figure 4:
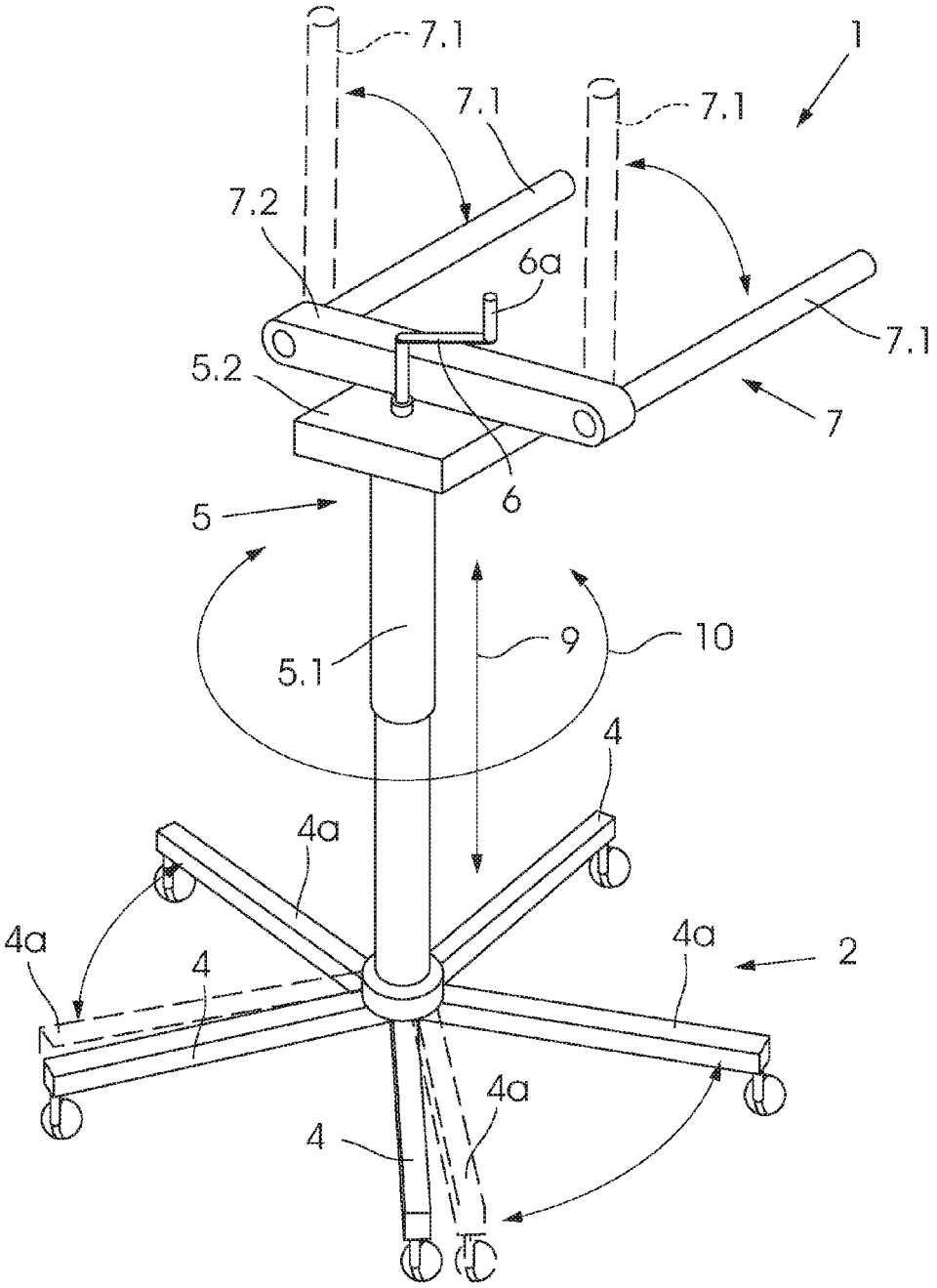
FIG. 4 is a perspective view of a lifting device, showing the positions between which the legs and lifting arm arrangement may move.

With reference to FIGS. 2 to 4, two of the legs 4*a* are movable between a stabilizing extended position wherein each leg 4*a* extends radially outwardly from the base 2 to widen the effective width "x" of the base 2, and a inoperative, folded position wherein each of the movable legs 4*a* is hinged at the bottom of the post 3 towards adjacent legs 4, to decrease the effective width "y" of the base 2. With the legs 4*a* in the latter position, the base 2 is in a retracted condition.

This operation of the movable legs 4*a* is effected through pivoting of the lifting arm arrangement 7 as described below, to move the base 2 between the stabilizing condition and a retracted condition.

The head 5 is movable upwardly and downwardly (as indicated by arrow 9 in FIG. 4) and is also rotatable about the post (as indicated by arrow 10 in FIG. 4). The lift 1 includes an actuator in the form of a rotatable lever 6 for moving the head 5 relative to the post 3 through the mechanisms referred to below. The head 5 and post 3 are guided for relative axial, rotational movement and longitudinal, sliding movement by polymeric, typically Vesconite™, bearings as illustrated in the detail view C of FIG. 5.

Figure 5:
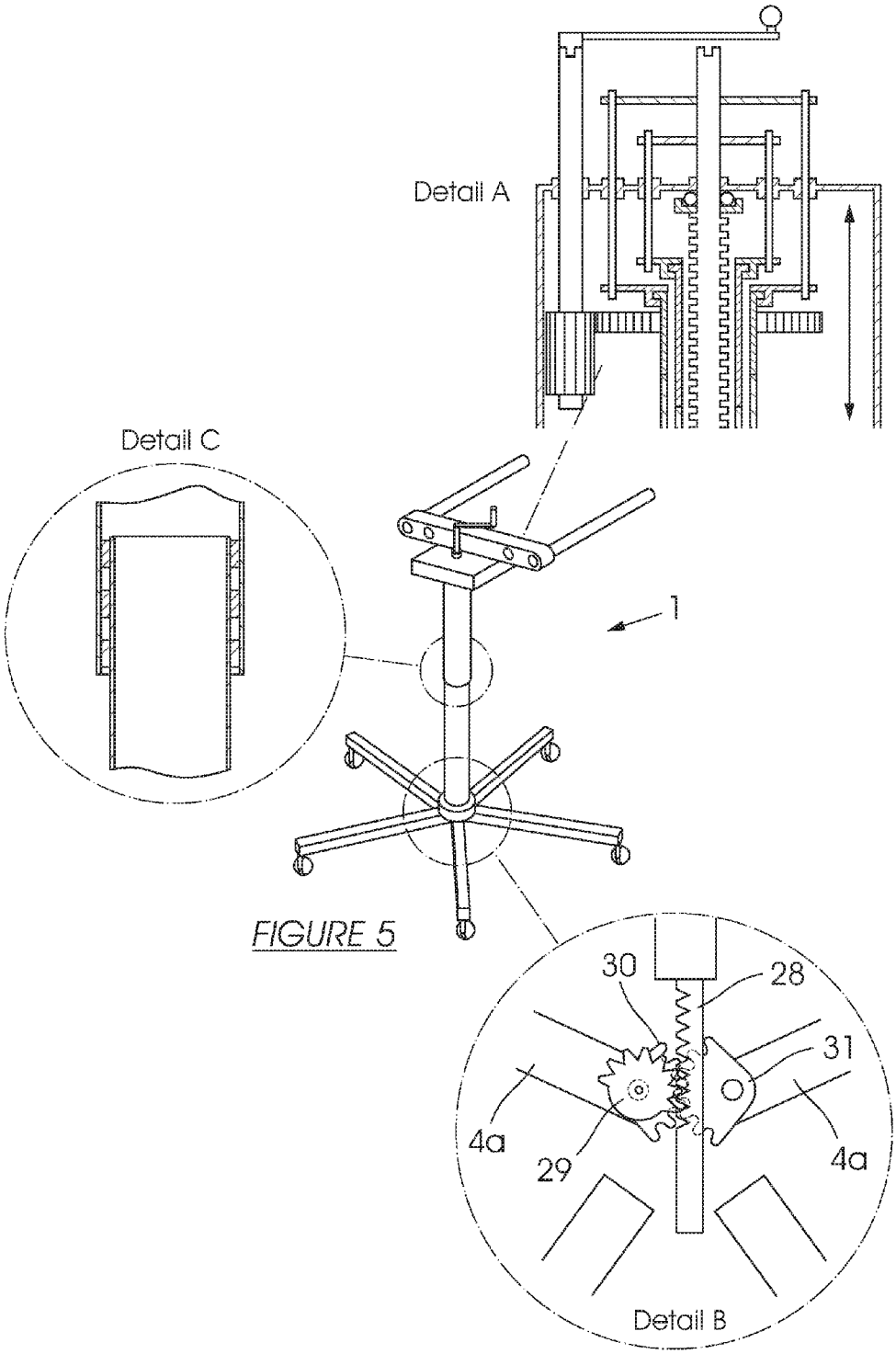
FIG. 5 is a perspective view of a lifting device showing detail views A, B and C of different portions of the lifting device.
Figure 5B:
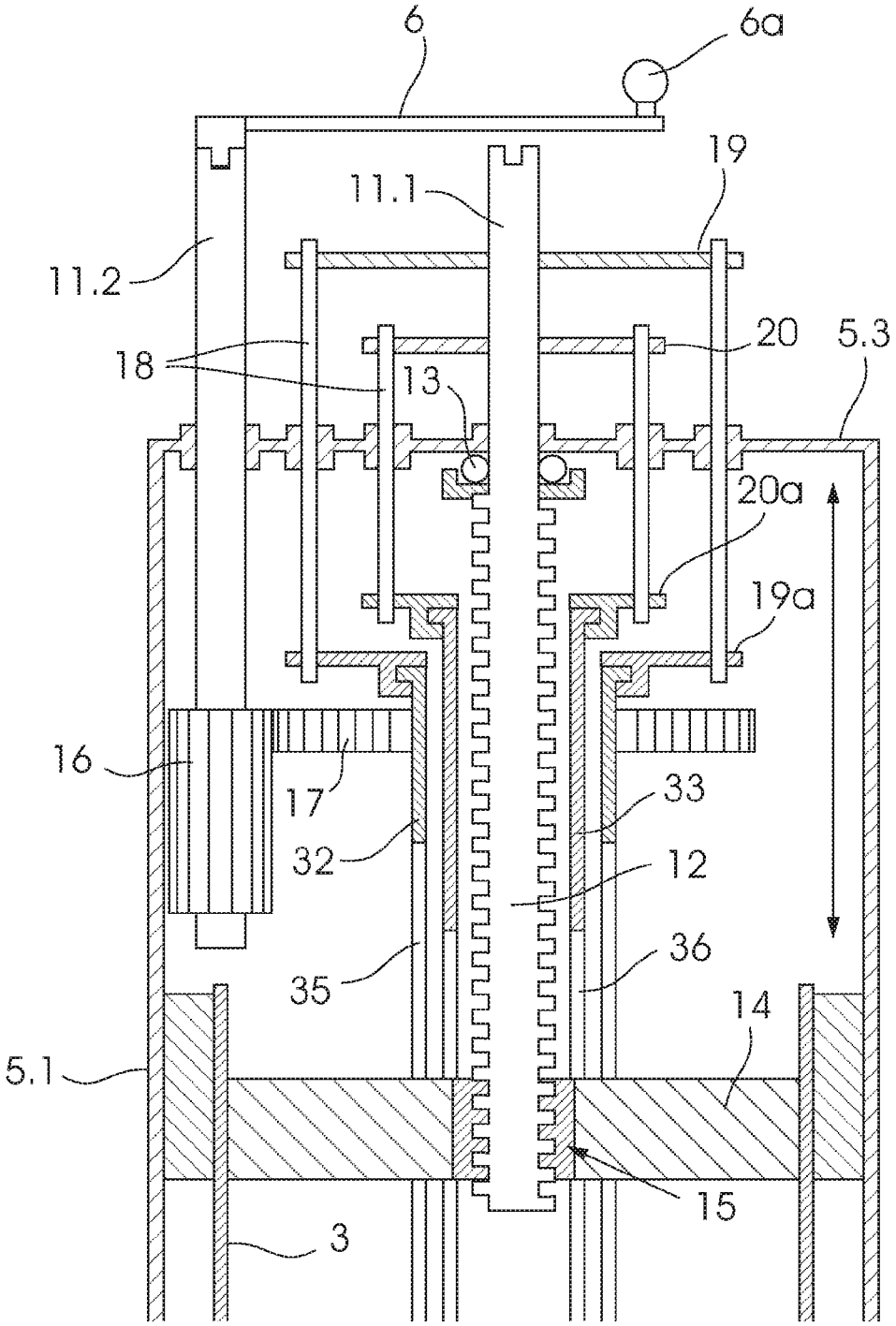
FIG. 5*b* is an enlarged cross-sectional view of detail view A of FIG. 5 including reference numerals.

The rotatable lever 6 is removably securable to either of two protrusions 11.1 and 11.2—only one of these is illustrated in FIGS. 1 to 4, but both are shown in FIG. 5*b*. The components shown in FIGS. 5 to 8 will be enclosed inside the housing 5.2 with only the protrusions 11.1 and 11.2 exposed therethrough for operation.

The lever 6 will typically click into position on each of the protrusions 11.1 and 11.2 through splined socket and spigot formations, which may include a spring loaded detent. The lever 6 may also be extendable to provide a mechanical advantage for use by weaker persons who require more leverage to operate the lift 1. A rotatable, perpendicular handle 6*a* extends upwardly at the end of the lever 6. The combination provides a crank handle for convenient rotation of the protrusions 11.1 and 11.2.

The first protrusion 11.1 (see FIGS. 5*b* and 6) drives a screw-threaded rod 12. The screw-threaded rod 12 is rotatably secured to the head 5 through a bearing arrangement 13. The length of the rod 12 extends through a carrier 14, which is fixed to the post 3. The carrier 14 includes a central, correspondingly screw-threaded bore 15, which engages on the rod 12. The bearing arrangement 13 is secured adjacent an upper end of the rod 12 and adjustably supports the head 5 above the post 3. The bore 15 may be provided by a ball screw assembly, to reduce frictional resistance to passage of the screw-threaded rod 12.

Rotating the lever 6 when fitted to the first protrusion 11.1 in one direction raises the head 5 relative to the post 3, and rotating the lever 6 in the opposite direction lowers the head 5 relative to the post 3.

The second protrusion 11.2, with the lever 6 attached thereto in detail view of FIG. 5*b*, is secured to a small outer gear 16 which meshes with and turns on a large inner gear 17. Outer gear 16 is attached to the head 5 whilst inner gear 17 is attached to a cylindrical member 32, which extends slidably through the carrier 14 but is unable to rotate relative to the carrier 14.

The outer gear 16 is longer than the inner gear 17 to allow for vertical travel of the inner gear 17 on the member 32 during the moving action of the legs 4*a* as described below.

When the lever 6 is rotated on the second protrusion 11.2, the outer gear 16 travels about a toothed track provided by the inner gear 17 and the head 5 rotates relative to the post 3. This allows a person using the lifting device 1, who is seated in the sling 110, to rotate himself or herself 360° about the post 3. By moving the lever 6 to the first protrusion 11.1, the person may also raise or lower himself or herself.

The lifting arms 7.1 are movable, by pivoting of the cross-beam 7.2 on the housing 5.2, between a weight carrying or supporting position (as shown in FIGS. 1, 2 and 5)

and an inoperative position (shown in broken lines in FIG. 4). In the weight carrying position the lifting arms 7.1 extend laterally or horizontally from the head 5, and in the inoperative position the lifting arms 7 extend longitudinally or upwardly from the head 5. To facilitate such pivoting, it is envisaged that the cross-beam 7.2 may also be fitted with a handle (not shown) which extends downwardly. The handle will allow a user to pull the beam 7.2 into the inoperative position.

It is desirable that the movable legs 4*a* must be securable and remain in the stabilizing, extended position whilst a person is using the device 1. This is accomplished through movement means (the components of which are schematically illustrated in FIGS. 6 to 10). As already mentioned, the movement means is controlled by pivoting of the arm arrangement 7 and its components provide a mechanical linkage to control the positioning of the movable legs 4*a*.

The movement and locking means includes a pair of cam followers 19 and 20 with connecting rods 18, which extend slidably through an upper end wall 5.3 of the head sleeve 5.1. The followers 19 and 20 are respectively connected to annular plates 19*a* and 20*a* by the rods 18. Both plates 19*a* and 20*a* have a central opening with an annular, radial slot provided therein. Radial flanges provided at the upper ends of cylindrical members 32 and 33 are respectively rotatably located inside the radial slots of plates 19*a* and 20*a*.

The arrangement provides for the members 32 and 33 to be secured longitudinally to the plates 19*a* and 20*a*, whilst being axially rotatable through the flange and slot connection. The members 32 and 33 have longitudinal slots 35 and 36 (see FIG. 5*b*) with portions of carrier 14 extending through the slots 35 and 36 to prevent the members 32 and 33 from rotating relative to the post 3 but allowing for limited vertical travel through the carrier 14. The members 32 and 33 are therefore also rotatable relative to the head 5 but unable to rotate relative to the post 3.

The followers 19 and 20 are accordingly moveable up and down with respect to the end wall 5.3 and the assembly of components described enables transfer of vertical movement of followers 19 and 20 to the members 32 and 33 but allows for relative rotational movement between these parts.

The bottom end of the member 33 is provided as a cup 37 with an annular flange 38 providing a stop, which surrounds linear gear 21. A pair of gripping wedges 25 is positioned against the flange 38. The bottom end of the member 32 is located inside the cup 37 of the member 33 and provided with a tapered throat 39 which is located adjacent the wedges 25.

The wedges 25 will be resiliently biased away from teeth on the linear gear 21. The position of the tapered throat 39 relative to the wedges 25 is dependent on the spacing between the followers 19 and 20. When the tapered throat 39 of the member 32 closes over the wedges 25, in the operation described below, the wedges 25 will be pressed into engagement with the gear 21.

For operation by a pair of overlying cams 22 and 23, the followers 19 and 20 are spring biased upwardly, away from the end wall 5.3. The springs are not shown but can be of any suitable type and provided at any suitable position within the assembly.

The cams 22 and 23 are connected to the cross-beam 7.2 of the arm arrangement 7, which pivots relative to the housing 5.2 of the head 5. The cams 22 and 23 extend from the beam 7.2 into the housing 5.2 where they engage the followers 19 and 20. The two followers 19 and 20 are provided as plates. The plates 19 and 20 have aligned slots through which the cams 22 and 23 extend. Each follower 19 and 20 has a pin (19.1) and (20.1) extending across its slot. The pins (19.1) and (20.1) bear against the cams 23 and 22 respectively under action of the spring bias referred to.

Figure 6:
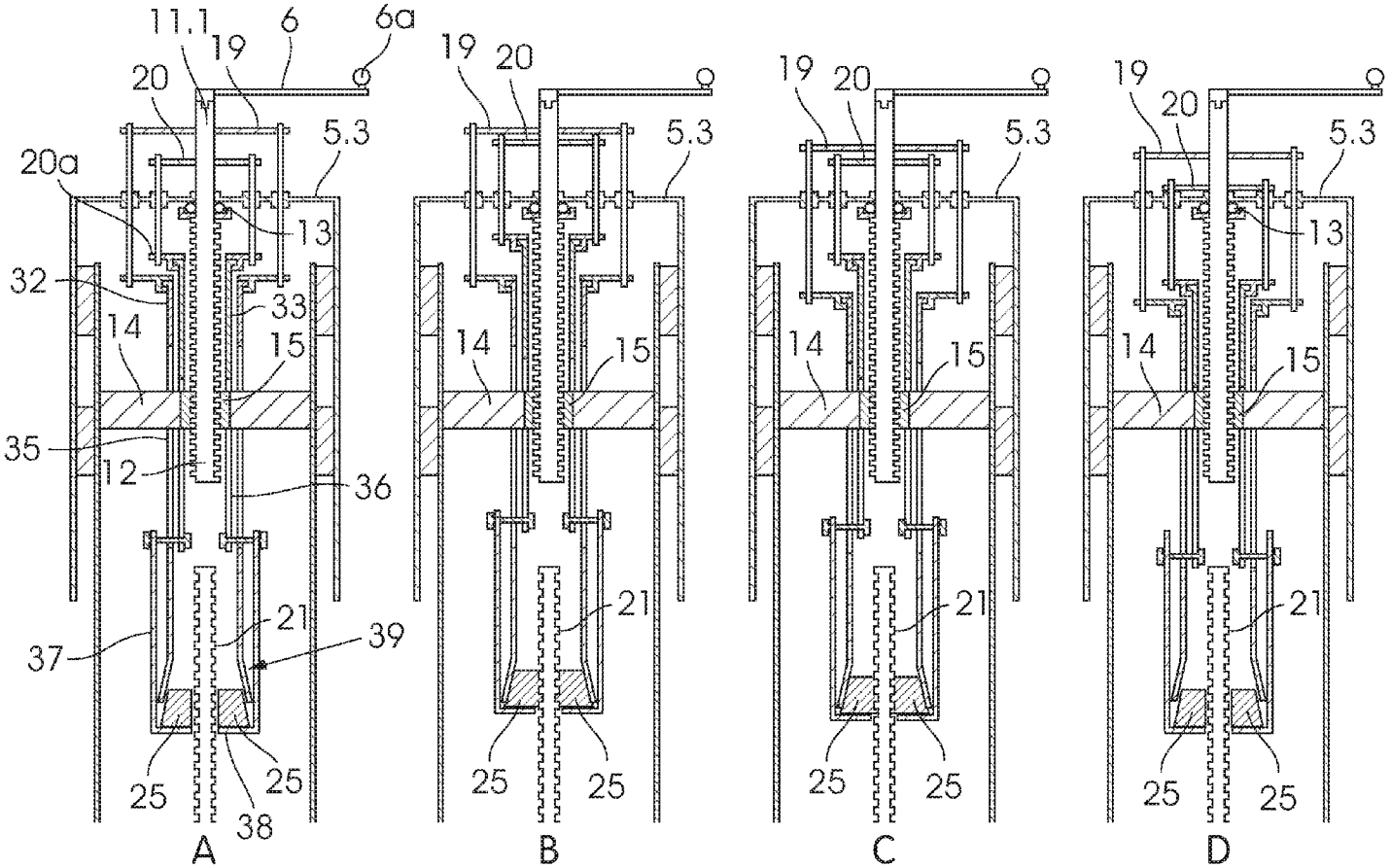
FIG. 6 provides four schematic cross-sectional views of components of movement means for legs of a lifting device.

Arrangement A in FIG. 6 shows second follower 20 in a central position and first follower 19 raised. This arrangement corresponds to arrangement A of the cams 22 and 23 shown in FIG. 7. The two followers 19 and 20 are supported spaced apart from each other by the cams 22 and 23. In this arrangement the lifting arms 7.1 are in the upward, inoperative position, raised vertically relative to the post 3, with the lifting device 1 in mobile mode with the base 2 in the retracted condition, wherein the legs 4*a* are in the folded position.

Moving the lifting arms 7 downward initially (as a person would do to use the device) allows the second follower 20 to rise in accordance with the indent 24 of cam 22. The space between the followers 19 and 20 is reduced.

As the second follower 20 is raised towards the first follower 19, wedges 25 close towards each other engaging onto a linear gear 21. This transition is shown in FIGS. 6 and 7, from the arrangement in views A to the arrangement in views B, wherein the linear gear 21 is fully engaged by the wedges 25.

On moving the lifting arms 7 further downward, second cam 22 lowers follower 20 and first cam 23 lowers follower 19. The close spacing between the followers 19 and 20 is maintained as the pins are displaced by the substantially corresponding curves of the two cams 22 and 23. This is shown in arrangement C in FIGS. 6 and 8. The followers 19 and 20 are accordingly lowered in unison with the engaged wedges 25 lowering linear gear 21.

Figure 7:
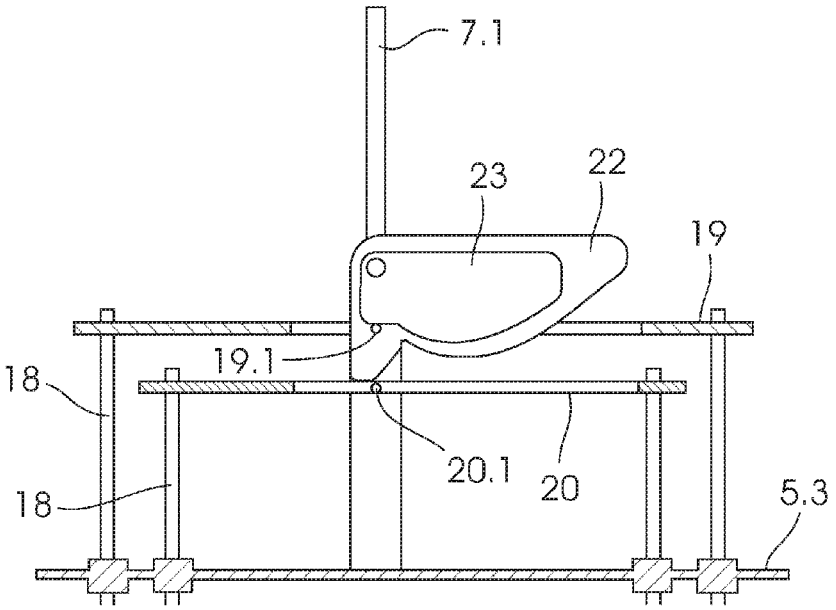
FIGS. 7 & 8 provide a further four cross-sectional schematic views of additional components of the movement means for legs of a lifting device.
Figure 7:
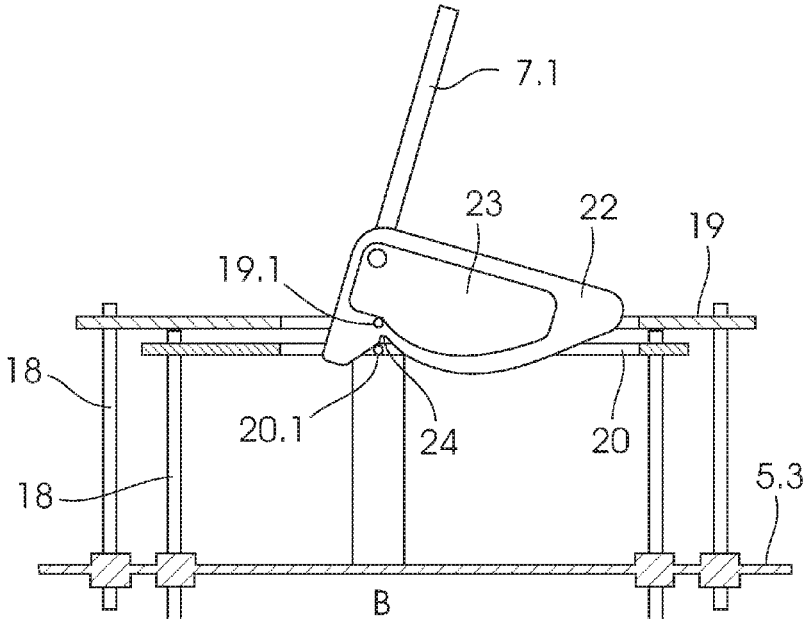
Figure 8:
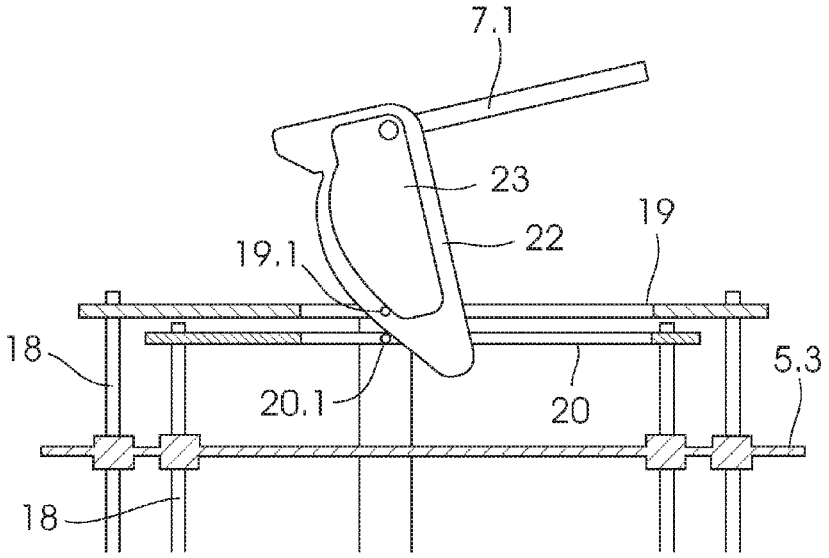
Figure 8:
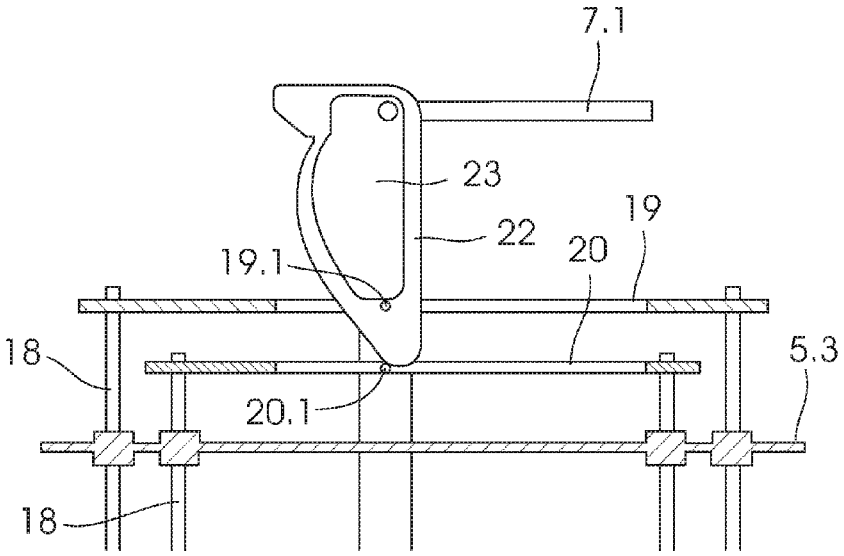
Figure 9:
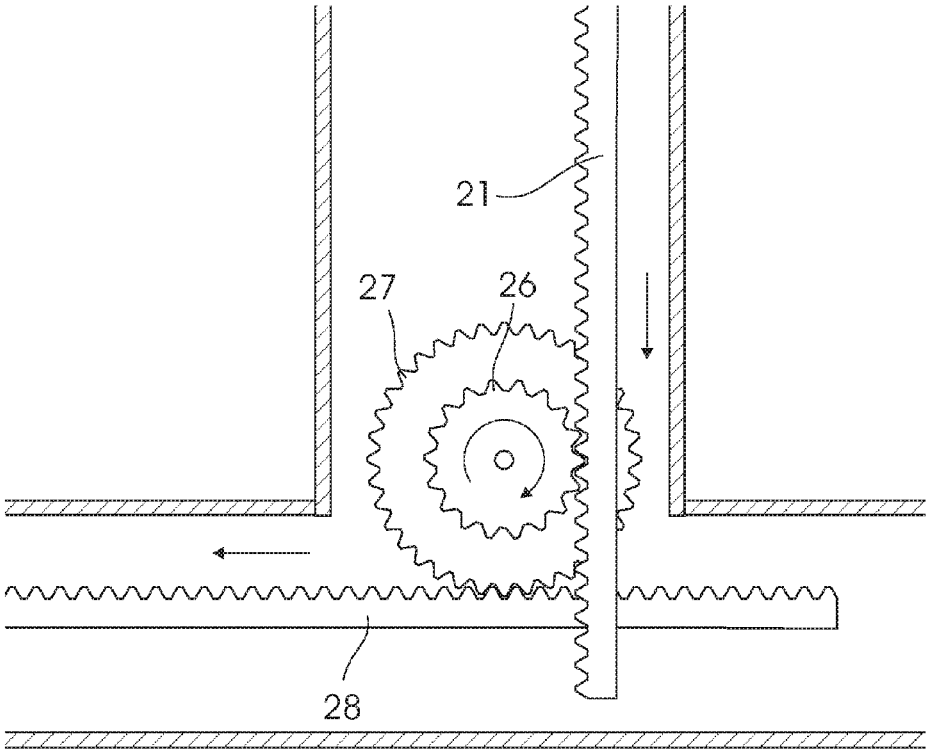
FIGS. 9 & 10 are schematic views of still further components of the movement means for legs of a lifting device.
Figure 10:
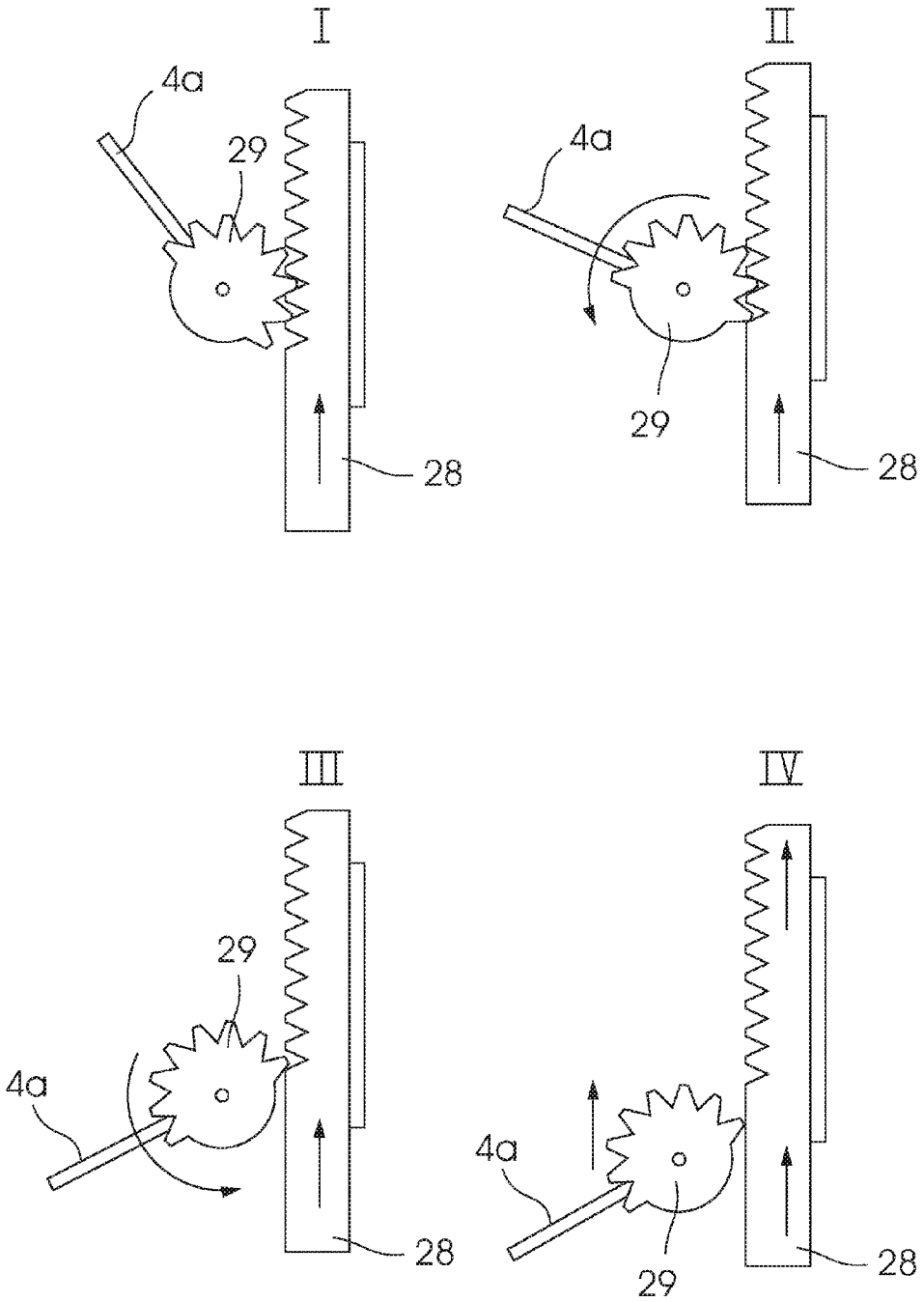

This displacement of the linear gear 21, as the cams 22 and 23 are moved from the positions in view B to view C of FIGS. 6 to 8, in turn drives gear 26 located adjacent the bottom of the post 3, see FIG. 9. The gear 26 is secured to a coaxial gear 27, which actuates a second linear gear 28.

The second linear gear 28 in turn drives partially cogged gear 29 (shown in the detail view B of FIG. 5 and in FIG. 10) attached to one of the legs 4*a*. The movable legs 4*a* have partially cogged inner ends 30 and 31, which provide synchronized movement of the legs 4*a*, which corresponds to the rotation of the cogged gear 29.

Thus, between arrangements B and C, as the lifting arm 7 is lowered, legs 4*a* move operatively forward towards the stabilizing position. When linear gear 28 moves past the cogged portion of gear 29 (as per illustration IV in FIG. 10), gear 28 and gear 29 are no longer meshed and legs 4*a* are locked into the stabilized position. An attempt to move the legs 4*a* by applying force to the legs 4*a* themselves will not have any effect as the cogs are no longer meshed and gear 29 only exerts a force transverse to the direction of travel of linear gear 28 thereon.

As the lifting arm 7 is lowered further into the weight carrying, supporting position wherein the lifting arm 7 extends laterally relative to the post (between arrangements C and D in FIGS. 6 and 8) the second follower 20 is again displaced away from the first follower 19 sufficiently to cause the wedges 25 to disengage from linear gear 21. This assures that any vertical movement of the head 5 relative to the post 3 with the lifting arms 7.1 in the supporting position, will not have an effect on linear gear 21 and hence the movement of legs 4*a*.

The lifting device 1 is designed to enable a person who does not have the use of the lower extremities of their body to transfer himself or herself from one seated position to another seated position, on a different support as described below, without the assistance of another person.

A typical example of when such transfer is required is where the disabled person needs to be moved from his bed to a lavatory. To do so, using the embodiment described, a person will lower the lifting arm arrangement 7 to the lateral, supporting position, consequently moving the legs 4*a* into the extended position. These two positions correspond to the stabilizing condition of the base 2 referred to.

The person positions himself in the sling 110, secure the sling to the lifting arms 7.1, moves the lever 6 to the first protrusion 11.1, and rotates the lever 6 to raise himself from the bed. Once the person is raised clear of the bed, he will move the lever 6 to the second protrusion 11.2 and turn the lever 6 to rotate himself about the post 3 until he is positioned above his wheelchair 34. He will then move the lever 6 back to the first protrusion 11.1 and rotate the lever 6 in the opposite direction to be lowered onto the wheelchair 34.

The person then removes himself from the sling 110, and raises the lifting arm arrangement 7 to the inoperative position. The lifting device 1 is now in mobile mode and legs 4*a* are in the folded position and the base 2 in the retracted condition. The person will position himself with his wheelchair 34 such that the post 3 is between his legs as indicated in FIG. 3. Having legs 4*a* in the folded position allows the wheelchair 34 to move close to the post 3. He may thus move the lifting device 1 along with his wheelchair 34.

The procedure described is reversed once the person is in the bathroom. He will again position himself in the sling 110, raise himself by rotating the lever 6 on the first protrusion 11.1, rotate himself to above the lavatory by rotating lever 6 on the second protrusion 11.2, and lower himself onto the lavatory seat by rotating lever 6 on the first protrusion 11.1.

For the operation described, the device 1 is required to be sufficiently stable or steady so that the person can safely rotate 360° about the post 3. It is further required that the effective width of the lifting device 1 or its base 2 should be small enough for the device 1 to be moved through a standard width doorway.

These two requirements present a typical engineering problem in that the stability of the device 1 whilst rotating would be compromised in the direction of least effective width of a supporting base and it is not practical to increase the effective width of the base to greater than the width of a standard doorway. If the width of the base is limited to that of a standard width doorway, the lifting arms would have to be of such a short length that would make it unfeasible or impractical to carry a person in the sling 110.

In accordance with the current invention, the problem is overcome by having the base 2 movable between the expanded stabilizing condition and the retracted condition. The movable legs 4*a*, which in the stabilizing condition, extend radially outwardly, provide the base 2 of the lifting device 1 with an effective width "x" which is greater than that of a standard doorway. Whereas, when the base 2 is moved into a retracted condition with the legs 4*a* folded respectively towards adjacent legs 4, the effective width "y" of the device 1 is smaller than the standard width of a doorway.

The wheels 8 of the base 2 are arranged substantially equally spaced apart on a diameter about the post 3 when the base 2 is in the stabilizing condition. In this condition, the stability of the device 1 is not compromised in any direction.

The configuration and dimensions of the components for the various mechanisms illustrated in the accompanying schematic drawings will be within the design competence of a suitably skilled person.

The present technology allows the user thereof to increase his/her independence, enabling them to transfer themselves between seated positions of varying height and in different locations within the home or facility, e.g. on a bed, sofa, toilet seat, recliner, wheelchair etc., by moving the lift from one location to another by means of a wheelchair, without the presence or assistance of another person. In an exemplary, the user will place himself onto a sling whilst seated on a bed, hook the sling to the lifting arm arrangement that was lowered into the supporting position and then raise himself using the lift. When cleared of the bed, the user will rotate the head about the post of the lift until he is aligned with a wheelchair that was placed next to the lift—typically over the single fixed leg between the two folding legs. The user will then lower himself onto the wheelchair, unhook the sling and return the lifting arms to the inoperative position, thereby retracting the folding legs. The user can then push the lift in front of him, using the wheelchair with the lift loosely attached thereto, to a new location and then repeat the process again to be transferred to another seating position, e.g. a lounge chair.

The present technology provides unassisted usage of the lift by the user in a vast range of locations and seating arrangements inside the house/facility. Provided that the flooring surface is relatively level, even and free from steps, the present technology strives to allow the user to transfer himself to other seating positions anywhere in the home, even in relatively confined spaces. In addition, this can effectively be done with no other person being present for prolonged periods of time, as the lift can be maintained serviceable in the new embodiments. The present technology, offering motorized lifting arms, enables users with who have limited upper body movement and hand/arm range limitations to operate the lift device without assistance, and the driven and partial rotation functionality allows the user to use the lift device in situations and areas that were previously not possible.

Figure 11A:
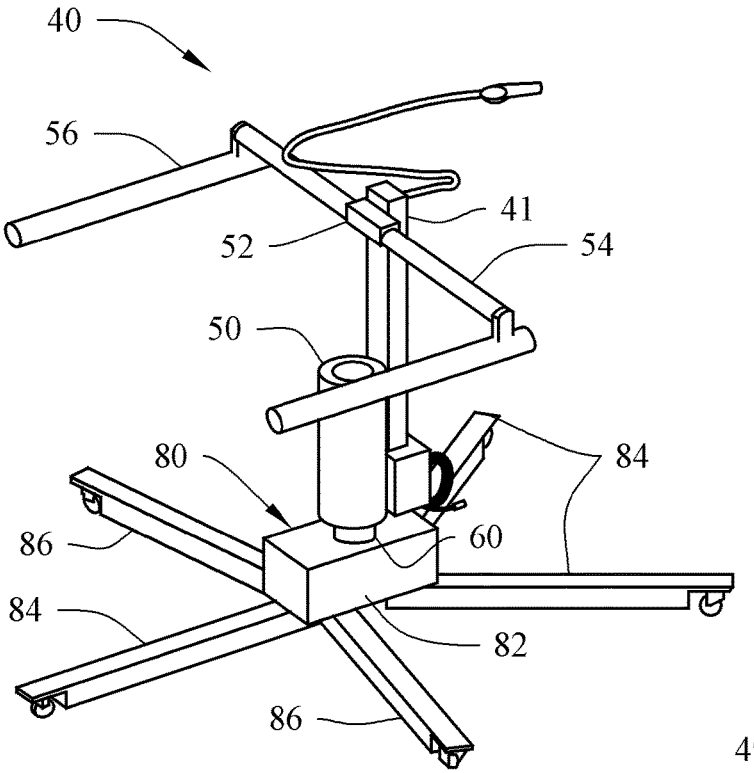
FIGS. 11A and 11B are perspective views of a motorized lift device of the present technology with the lifting arms in the supporting horizontal position (FIG. 11A) and in the inoperative position (FIG. 11B)
Figure 11B:
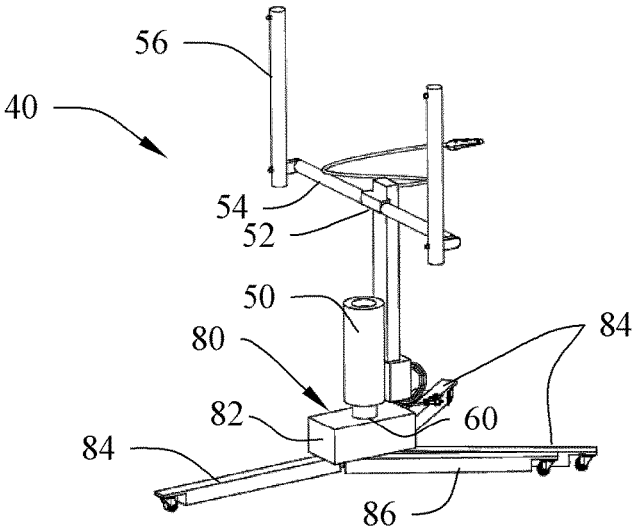
Figure 12:
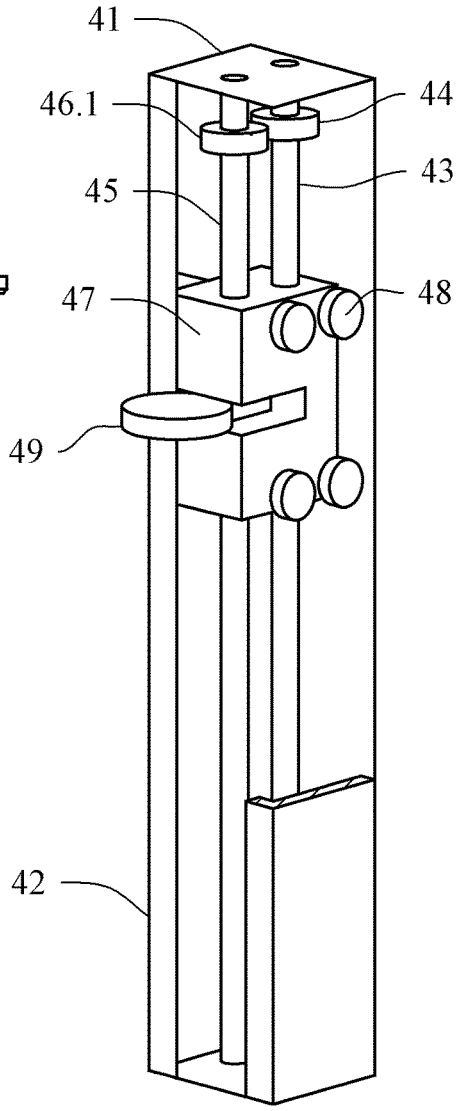
FIG. 12 is a perspective view of the track and carrier assembly with a portion of the track housing removed.

An embodiment of the present technology can utilize a motorized and electronically controlled lift device 40, which includes a combination of electronic controls with mechanical linkage, and also a full electronic linkage between lifting arms and the base, along with motorized assemblies, as illustrated in FIG. 11A-B.

A track unit 41 is fitted to a moveable head unit 50, which provides vertical adjustable movement for a lifting arm arrangement, whilst the head unit 50 can also rotate about the post 60. The lifting arm arrangement is supported on a housing 52 of the head unit 50. The lifting arm arrangement 7 can include a pair of spaced apart lifting arms 56, which extend from a cross-beam or bar 54 that is pivotably connected to the track unit 41 via housing 52. A sling can be removably secured to the arms 56, for supporting a person's lower body when using the lift device 40. The head unit 50 is supported by the post 60, which is attached to the base 82.

The base unit 80 can include a base 82, multiple fixed legs 84, and at least two movable or foldable legs 86 that are movable between a stabilizing extended position wherein each foldable legs 86 extends radially outwardly from the base 82 to widen the effective width of the base unit 80, and a retracted folded position wherein each of the foldable legs 86 is hinged towards adjacent fixed legs 84, to decrease the effective width of the base unit 80. With the foldable legs 86 in the latter position, the base 82 is in a retracted condition and the lifting arms 56 are in the inoperative position, as best illustrated by FIG. 11B. FIG. 11A best illustrates the base 82 in the stabilizing condition with the lifting arms 56 in the supporting horizontal position.

This operation of the foldable legs 86 can be effected through pivoting of the lifting arm arrangement as described herein, to move the base 82 between the stabilizing condition and a retracted condition. It can be appreciated that this operation of moving the foldable legs 86 in combination with pivoting of the lifting arms 56 can be accomplished utilizing motors, gears and/or electronic controls.

Figure 17A:
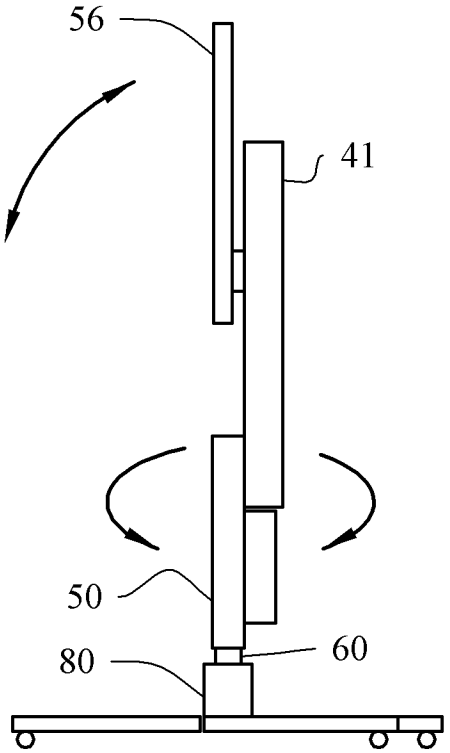
FIGS. 17A-C are schematic plan views of the lifting arm in the inoperative and supporting positions also showing directions of movement of other components.
Figure 17B:
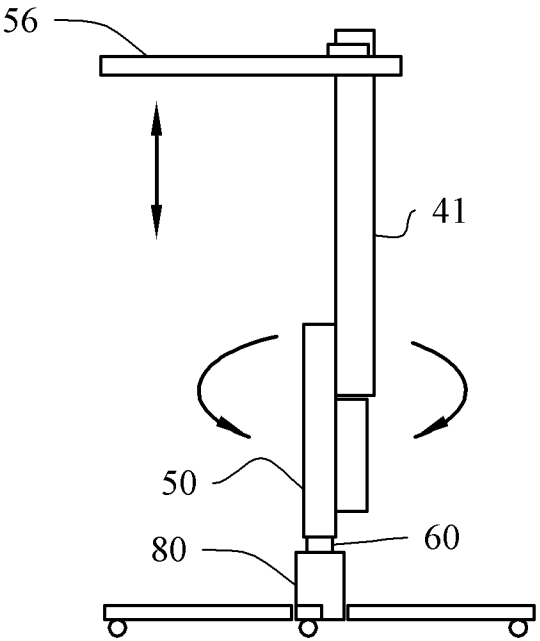
Figure 17C:
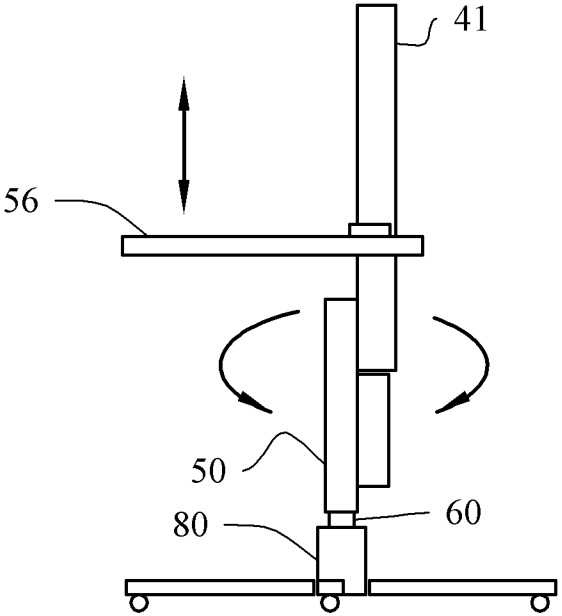
Figure 18:
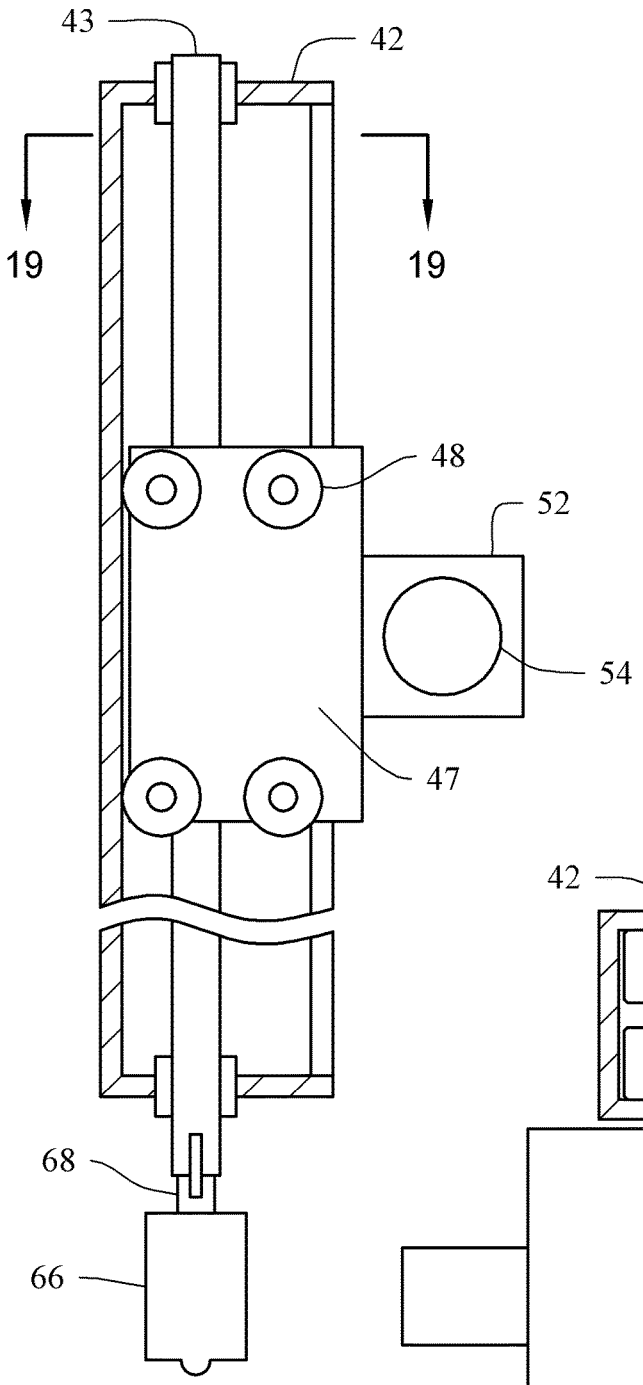
FIG. 18 is an enlarged cross-sectional view of a motorized track and carrier assembly.
Figure 19:
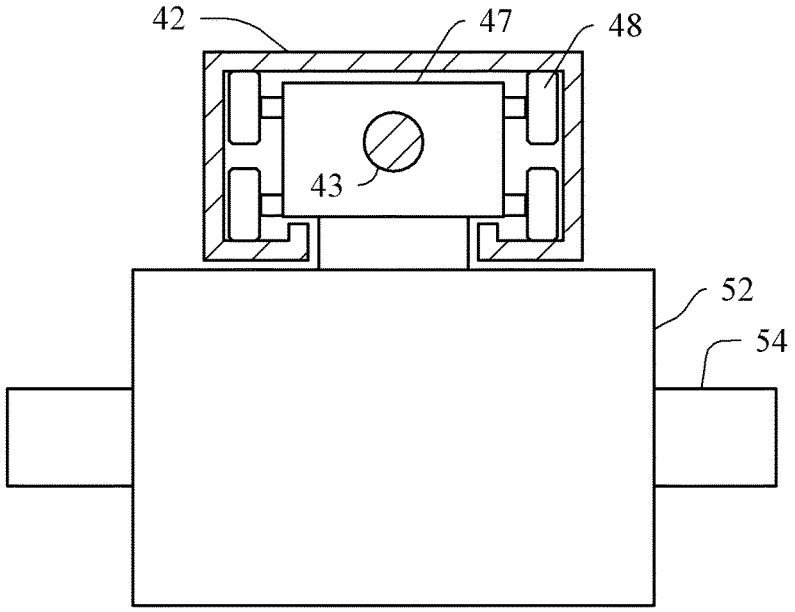
FIG. 19 is a cross-sectional view of the motorized track and carrier assembly taken along line 19-19 in FIG. 18.

Some embodiments of the present technology can include the lifting arms 56 being pivotably secured to the track unit 41 by housing 52 which in turn is coupled to a carrier assembly 47, which allows for upwards and downwards movement, as best illustrated in FIGS. 17A-17C. The coupling between the load bearing housing 52 and the carrier 47 moving upwards and downwards inside the track unit 41 can be similar to that used to secure the head unit to the track in other embodiments described herewith The linkage between the lifting arm arrangement 56 and the base unit 80 can incorporate electronics to facilitate operation. The lifting arm 56 activates an electronic switch to signal its position to a control unit, which in turn controls the condition of the base unit 80. In this embodiment, there is no jockey assembly. Rotation of the head unit 50 about the post 60 is effected by a worm drive motor mounted to the head 50 which interfaces with a ring gear mounted on the post 60—this mechanism is described in detail later in this description. Upwards and downwards movement of the lifting arm arrangement 56 is effected by means of a screw-threaded rod 43, which is rotatably secured at the top and bottom inside a channel defined by a track housing 42. The carrier assembly 47, which includes a ball bearing arrangement 48 to enable it travel upwards and downwards in the track housing 42, includes a central, correspondingly screw-threaded bore causing movement along the screw-threaded rod 43 when the rod is turned, as best illustrated in FIG. 18-19. The screw-threaded rod 43 is coupled via a coupling 68 to a drive motor 66 mounted at the bottom of the track housing 42, and the drive motor is controlled by the electronic control unit that controls all the other electronic functions of the lift.

Figure 13A:
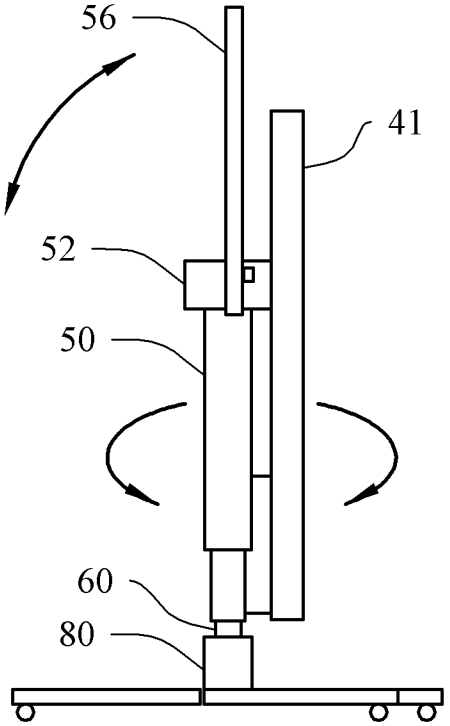
FIGS. 13A-C are schematic plan views of the lifting arm in an inoperative and supporting positions also showing directions of movement of other components.
Figure 13B:
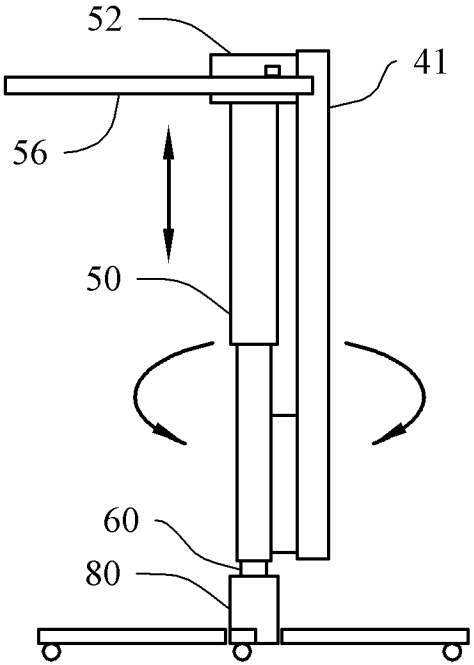
Figure 13C:
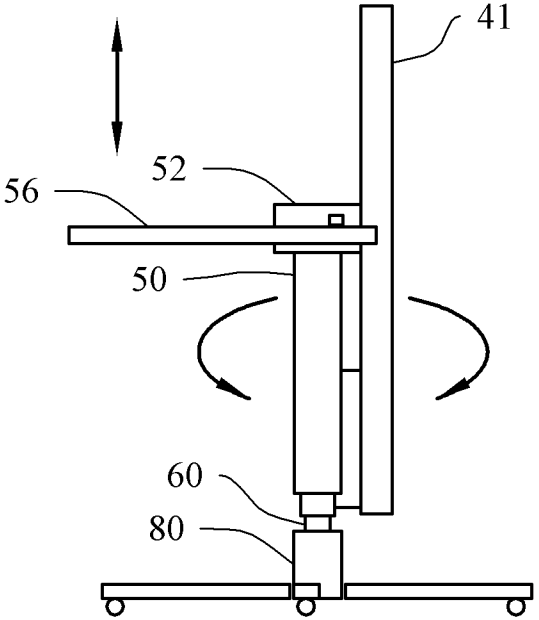
Figure 14:
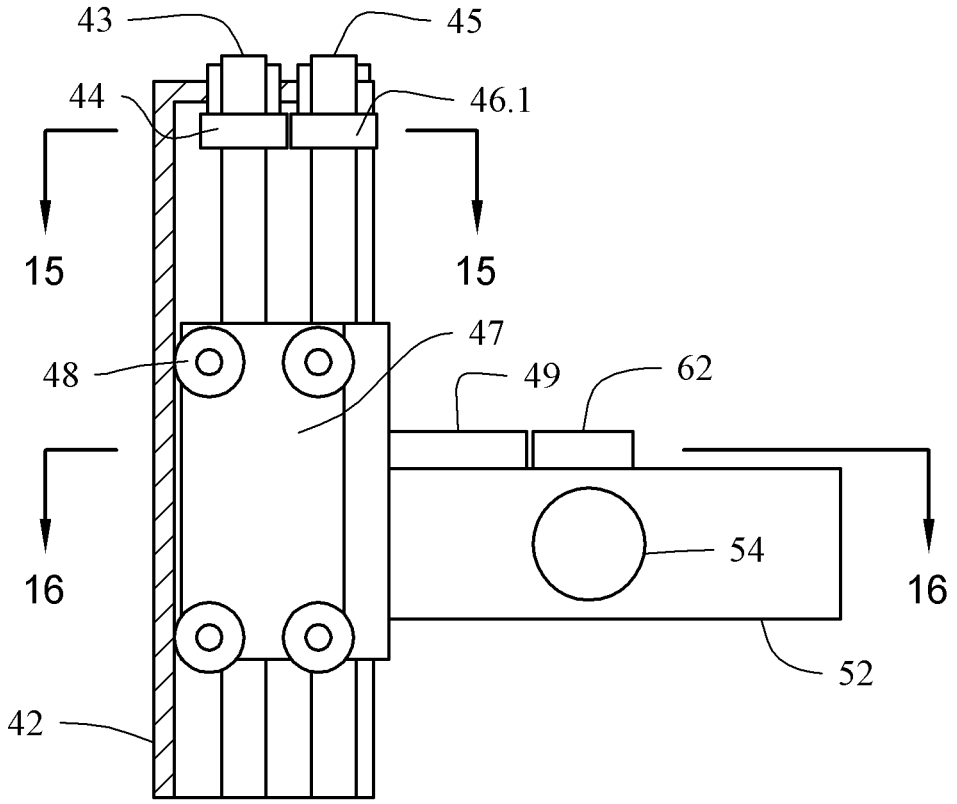
FIG. 14 is an enlarged cross-sectional view of the track and carrier assembly.

In another embodiment of the present technology the head unit 50 is movable upwardly and downwardly and is also rotatable about the post 60, as illustrated in FIGS. 13B-13C. The lift device 40 can include an actuator in the form of a motor and gearing for moving the head unit 50 relative to the post 60 supporting the head unit 50. The head unit 50 and post 60 can be guided for relative axial, rotational movement by using a taper bearing configuration and for longitudinal, sliding movement by using a track unit 41. FIG. 13A shows the lift device 40 with the lifting arms 56 in the inoperative position and the base 80 in the retracted condition. FIG. 13B shows the lift device 40 with the lifting arms 56 in the supporting position at their highest level and the base 80 in the stabilizing condition, whilst FIG. 13C shows the lifting arms 56 in their lowest supporting position.

Referring to FIGS. 12-16, in this embodiment, the configuration of the head unit 50 changes slightly wherein the load bearing head section 52 of the head unit 50 which has the lifting arms 56 pivotably secured to it, moves up and down, but is supported by being mounted to the track unit 41. The linkage between the lifting arm arrangement 56 and the base 80 is still mechanical and identical to that in the original embodiment using the cam plate system (22 and 23) and the gripping wedges 25 and tapered throat 39 assembly, but this embodiment allows for the utilization of motorization via a worm drive motor with a jockey assembly. Upwards and downwards movement is effected by means of a screw-threaded rod 43, which is rotatably secured at the top and bottom inside a channel defined by a track housing 42. At an upper portion of the screw-threaded rod 43, and within the channel, is located a spur gear 44.

Figure 15:
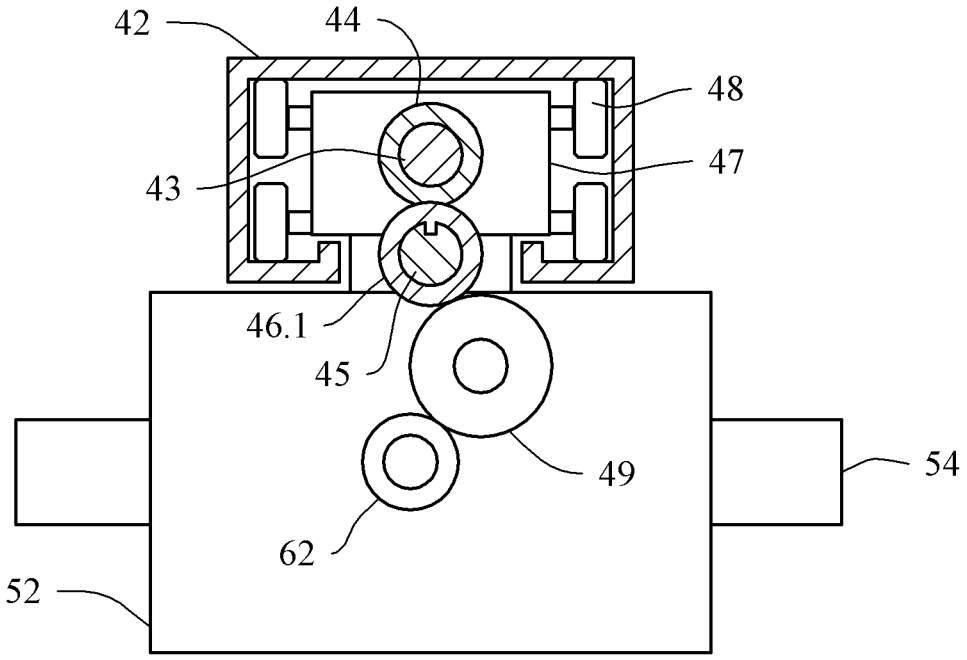
FIG. 15 is a cross-sectional view of the track and carrier assembly taken along line 15-15 in FIG. 14.
Figure 16:
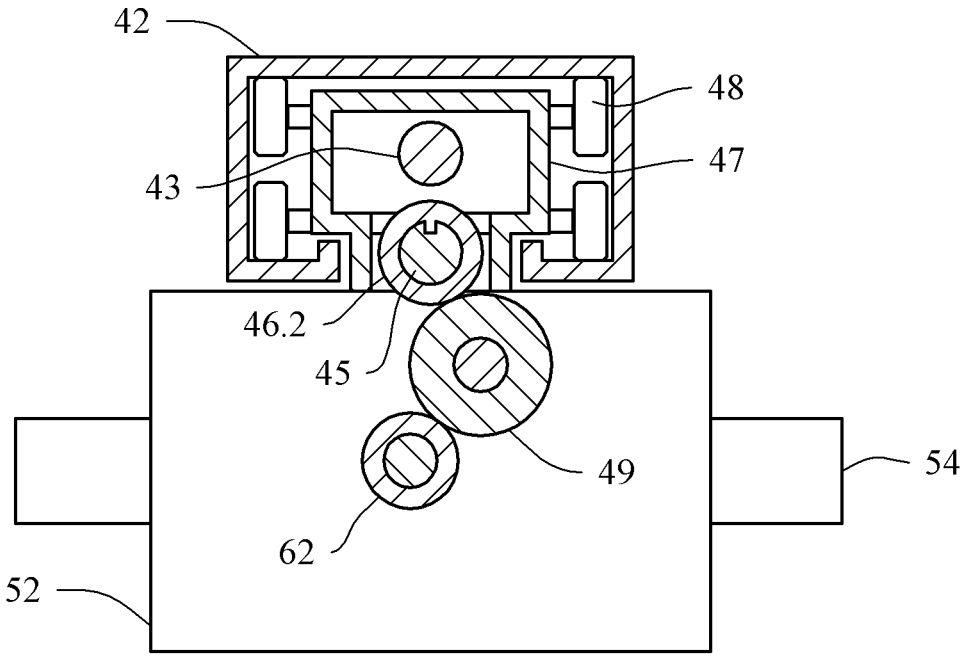
FIG. 16 is a cross-sectional view of the track and carrier assembly taken along line 16-16 in FIG. 14.

A slotted rod 45 is located in the channel, and includes a first slotted spur gear 46.1 and a second slotted spur gear 46.2. Both spur gears can be fixed to the slotted rod by way of, but not limited to, a slot and key configuration. The first spur gear 46.1 is engageable with the spur gear 44 of the screw-threaded rod 43, as best illustrated in FIG. 15. The second spur gear 46.2 is engageable with an intermediate gear 49 associated with the carrier assembly 47, as best illustrated in FIG. 16. It can be appreciated that the second spur gear 46.2 is configured or capable of sliding along the slotted rod 45 so as to allow upwards and downwards movement of the carrier assembly 47 which it forms part of.

A carrier assembly 47 containing roller bearings 48 is moveably arranged in the channel allowing it to travel up and down the channel. The carrier assembly 47 includes a central, correspondingly screw-threaded bore causing movement along the screw threaded rod 43 when the rod is turned. The intermediate gear 49 can be further engageable with a central drive gear 62 of the jockey assembly.

The carrier assembly 47 can further include multiple wheels or roller bearings 48 that are configured to allow the carrier assembly 47 to travel along the channel depending on rotation of the screw-threaded rod 43.

Some embodiments of the present technology can include the lifting arms 56 being pivotably secured to the track mounted coupling unit 41, which allows upwards and downwards movement, as best illustrated in FIGS. 17A-17C. The track mounted coupling unit 41 can be similar to that used to secure the head unit to the track in previous embodiments. The linkage between the lifting arm arrangement 56 and the base unit 80 can incorporate electronics to facilitate operation. The lifting arm 56 activates an electronic switch to signal its position to a control unit, which in turn controls the condition of the base unit 80. In this embodiment, there is no jockey assembly. Rotation of the head unit 50 is effected as per the rotation of head unit 50 about the post 60, and upwards and downwards movement of the lifting arm arrangement 56 is effected by means of the screw-threaded rod in the track unit 41, which is rotatably secured at the top and bottom inside the channel. The carrier assembly 47 includes a central, correspondingly screw-threaded bore causing movement along the screw-threaded rod 43 when the rod is turned.

The slotted rod 45, which engages its second slotted spur gear 46.2, is housed in a slot within the carrier assembly 47. When the central drive gear 62 is rotated on the jockey via handle or drive motor, it in turn rotates the intermediate gear 49, which in turn rotates the second slotted spur gear 46.2. This in turn rotates the first spur gear 46.1 attached to the top of the slotted rod 45, which is engaged with the spur gear 44 attached to the top of the screw-threaded rod 43. This ultimately causes the carrier assembly 47 to move upwards or downwards within the provided channel of the track unit 41.

The load bearing head section 52 at the top of the head 50 is attached to the carrier 47, and as such the lifting arm assembly 56 which is attached to this section of the head, moves up or down. In this embodiment, the head section 52 is supported for upwards and downwards movement via the attachment to the carrier 47 in the track unit 41, whilst in other embodiments of the present technology the head 50 was supported by a threaded rod mounted in the center of the post 60.

Figure 20C:
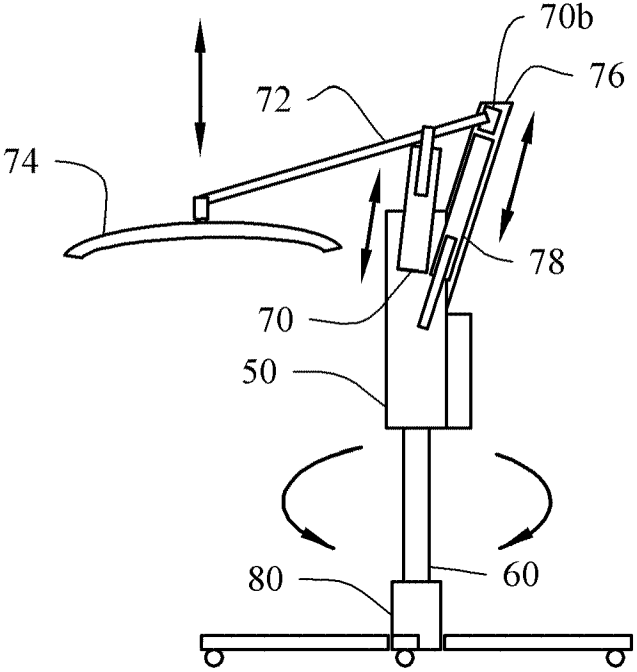
FIGS. 20A-C are schematic plane views of an alternate lifting arm arrangement in the inoperative and supporting positions also showing directions of movement of other components.
Figure 20B:
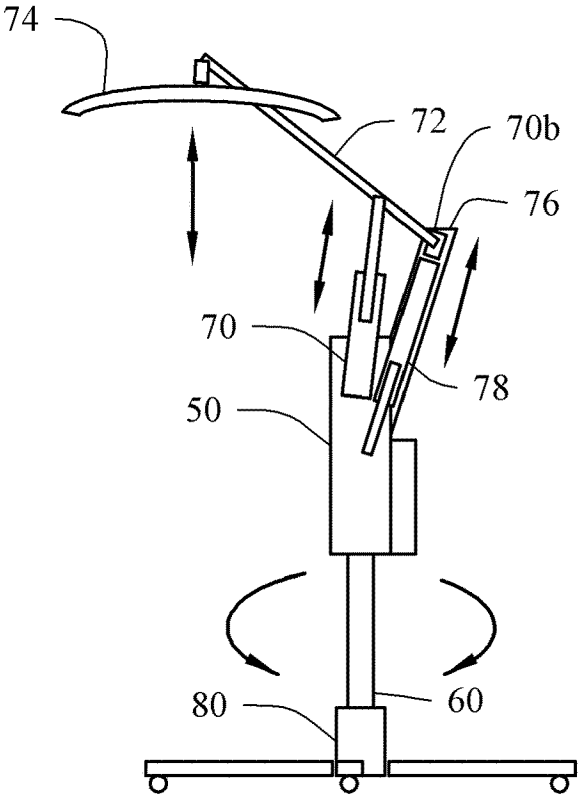
Figure 20A:
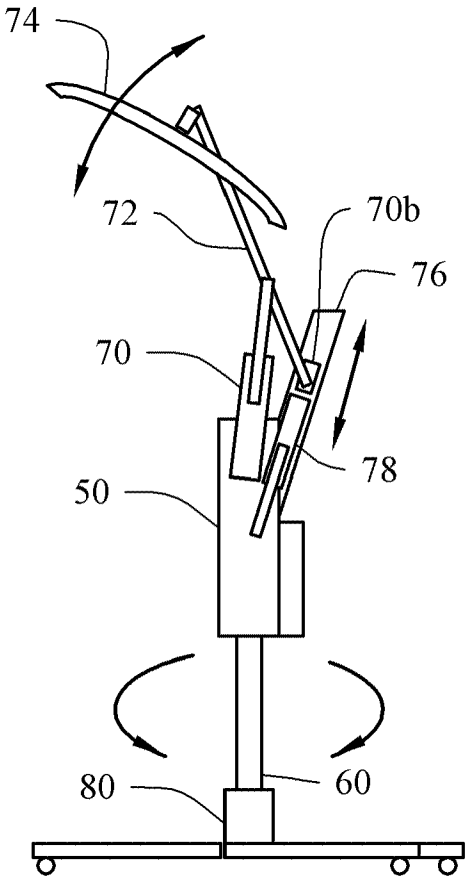
Figure 20F:
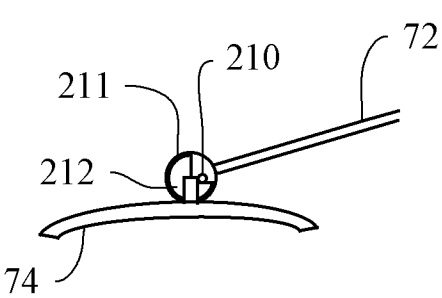
FIG. 20D-G are schematic plane views of the alternate lifting arm of FIGS. 20A-C showing the mechanical stop effected by means of the coupling between the alternate lifting arm and the hingedly attached section.
Figure 20E:
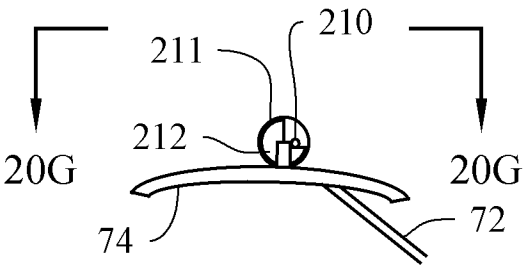
Figure 20G:
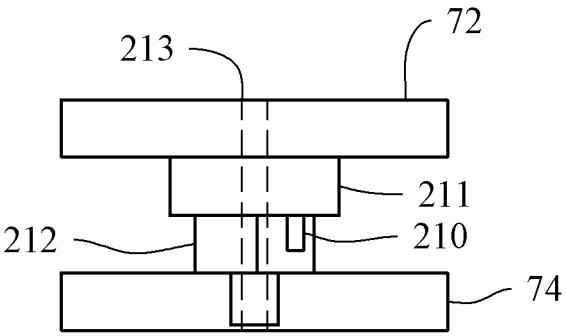
Figure 20D:
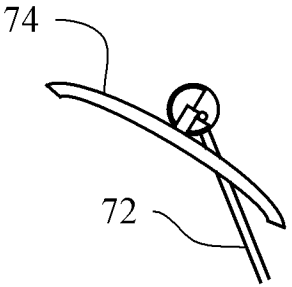
Figure 21:
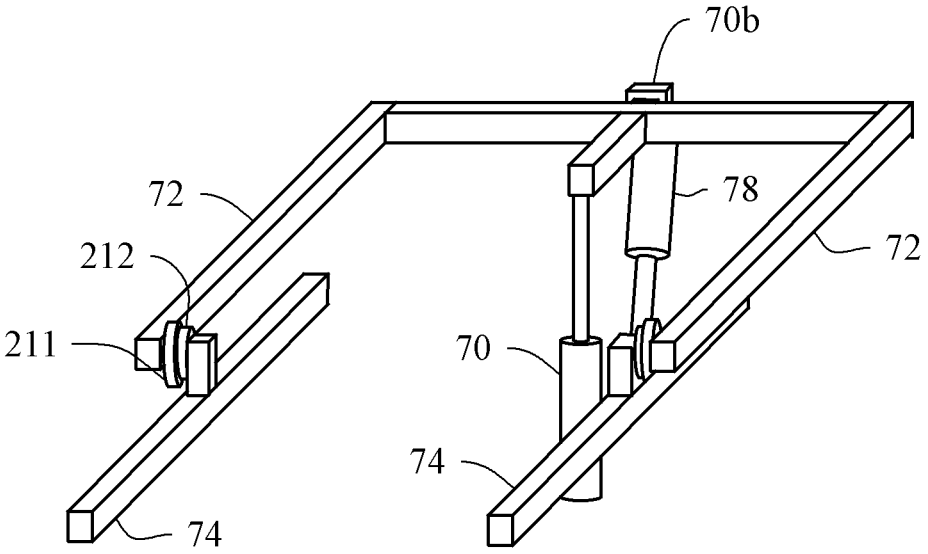
FIG. 21 is a top elevational view of the lifting arm arrangement of FIGS. 19A-C.
Figure 22:
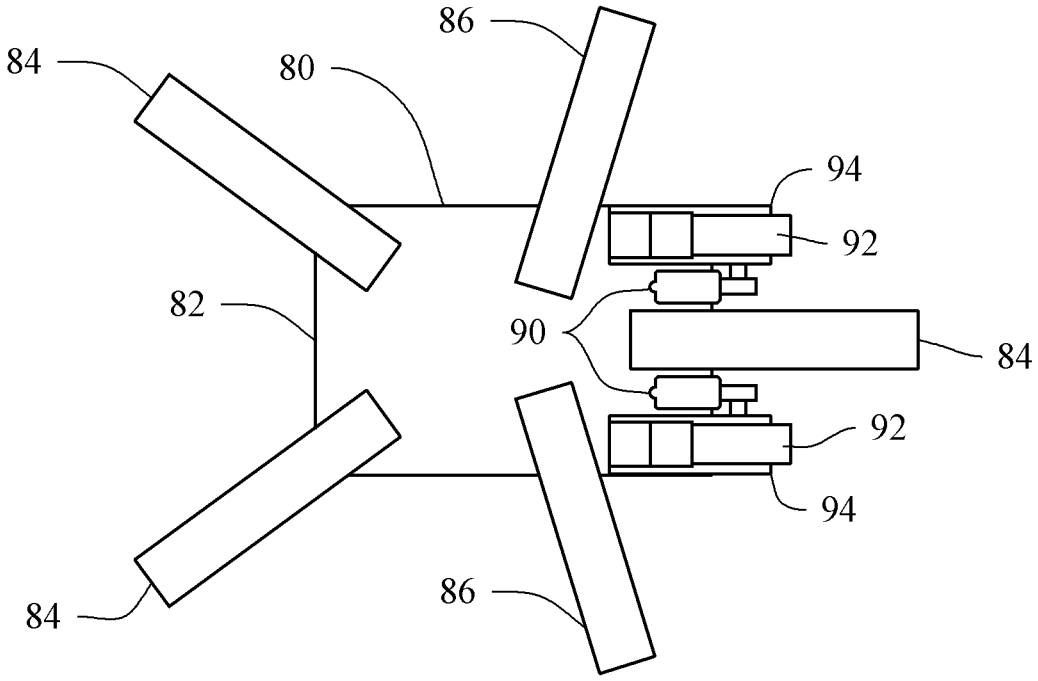
FIG. 22 is a bottom elevational view of the base with a motorized wheel arrangement.

Referring to FIGS. 20A-21, and alternate embodiment motorized lift device will be described. In some embodiments the upwards and downwards movement of a lifting arm arrangement 72 including a hingedly attached section 74 can be effected by means of a "lifting" linear actuator 70 which is secured towards the top of the head unit 50 and at a secondary pivot point on the "lifting" arm arrangement 72. With the base in the supportive condition, the actuator 78 remains fully extended causing the rear pivot point of lifting arm arrangement 72 to remain at the upper end of the offset channel 76. Lowering and raising of the lifting arm arrangement 72 is achieved by retracting and extending lifting linear actuator 70 respectively. Changing the position of the lifting arm arrangement 72 between the supportive and inoperative positions is effected by a "mode changing" linear actuator 78 mounted in the offset channel 76. One side of the offset channel 76 is fixed to the head unit 50 and it contains linear actuator 78 as well as a track mounted carrier assembly 70*b* to which the lifting arm arrangement 72 is pivotably secured. Actuator 78 is secured on one end at the bottom of the offset channel, whilst it is coupled with the track mounted carrier assembly 70*b* at the other end. When the "mode changing" actuator 78 is fully extended it moves the track mounted carrier assembly 70*b* to the top of the offset channel 76 which has the effect of raising the rear pivot point of the lifting arm arrangement 72, which lowers it into the supportive condition and the base 80 is moved into the stabilizing condition, as illustrated in FIG. 20C.

To put the lifting arm arrangement 72 into the inoperative condition, the "lifting actuator" 70 is fully extended while the "mode changing" actuator 78 is fully retracted and track mounted carrier assembly 70*b* is lowered inside the offset channel 76, as illustrated in FIG. 20A, which effectively lowers the rear pivot point of the lifting arm arrangement 72 causing the other end of the lifting arm arrangement with hingedly attached section 74 to be raised to a near vertical level and puts the lifting arm arrangement 72 in the inoperative condition. In this condition, the hingedly attached section 74 of lifting arm arrangement 72 is mechanically tilted further due to a mechanical stop incorporated in the connection between the arm arrangement 72 and the attached section 74 in order to render it impossible to be loaded with the sling arrangement, and the base 80 is in the retracted condition. The sling that supports the user is attachable at four points to the hingedly attached section 74 of the lifting arm arrangement 72. In this embodiment, the upwards and downwards movement of lifting arm arrangement 72 and corresponding movement in the base 80 as well as of the rotation of the head 50 about the post 60 are all controlled electronically by means of switches and similar mechanisms, connected to an electronic control unit, and it shares the design of the base 80 and head unit rotation with the previous embodiment.

Referring to FIG. 20D-G, the mechanical stop is effected by means of a coupling between the lifting arm arrangement 72 and the hingedly attached section 74.

Disc 211 is attached towards the end of each arm of the lifting arm arrangement 72 and disc 212 is attached to the central mounting point of section 74. The central mounting point is located at the point where the section 74 is in balance and will hang laterally when supported only at this point without any load attached to it. Pin 213 secures the lifting arm arrangement 72 with disc 211 attached and section 74 with disc 212 attached rotatably against each other as best illustrated in FIG. 20G. Rotation is limited by pin 210 which is fitted to disc 211. When the lifting arm arrangement 72 is raised into the inoperative position, the pin 210 pushes against disc 212 and prevents hingedly attached section 74 from remaining lateral. As a result, hingedly attached section 74 tilts upwardly, as best illustrated in FIG. 20D, and into the inoperative position where it cannot support a user.

The position of lifting arm arrangement 72 in FIG. 20A corresponds to that in FIG. 20D, in FIG. 20B corresponds to that in FIG. 20E and in FIG. 20C corresponds to that in FIG. 20F. FIG. 21 shows a perspective view of the lifting arm arrangement in this embodiment, with a differently shaped hingedly attached section 74.

In some embodiments, the present technology can be self-driven by remote control. This feature allows the lift device 40 to move from one position to another under its own power.

One aspect of the present technology is to provide users with independence, and it would be beneficial to recharge the batteries required for electronic operation on a regular basis. Electrical power is typically required to operate the charging circuitry, and to this end the lift device 40 has to be placed in a position where a power socket or charging station can be accessed.

In order to achieve this type of mobility, a set of wheels 92 of small diameter are pivotably mounted to the base 82, or a mounting thereof, of the lift device 40, as illustrated in FIGS. 22-24C. The wheels 92 are facing in the same direction, mounted spaced apart and parallel to each other, and can be operated independently, by remote control, in forward and reverse rotational directions and at varying rotation speeds. This allows the lift to be maneuvered with precision, even in confined spaces. The wheels 92 are each driven by a worm drive interface with a small electronic motor 90, such as but not limited to, a worm drive motor or right angle drive motor. The worm drive interface allows the wheels 92 to be used as a brake when the no electrical power is supplied to the motor.

The drive wheels 92 can be lowered and raised depending on the requirement. When the drive wheels 92 are required to maneuver the lift device 40 for charging or storing out of reach, or when the user is operating the lift device 40 on a small incline and requires the lift to remain stationary, the drive wheels 92 can be lowered manually, mechanically or electronically to make contact with floor F.

Figures 23A, 23B, 23C:
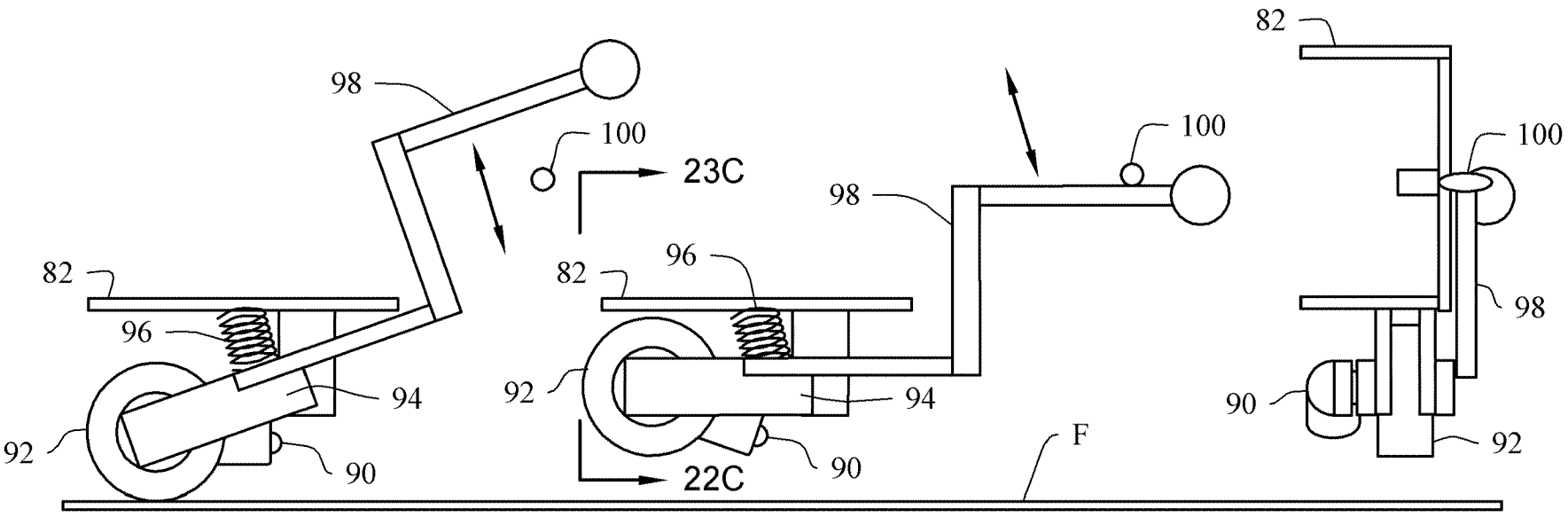
FIGS. 23A-C are plane views of a manually operated wheel raising arrangement, with FIG. 23C being a front plane view taking along line 23C-23C in FIG. 23B.

When the user is moving the lift device 40 with the use of his wheelchair, the drive wheels 92 can be raised to avoid contact with the floor F, as best illustrated in FIGS. 23B and 23C. Another application where drive wheels 92 can be raised is when a family member or caregiver is present and would like to move the lift device 40 by hand whilst the user is being supported by the lift.

In another embodiment, the capacity of the electronic motors 90 driving the drive wheels 92 as well as the contact surface area of the wheels 92 may be increased to allow the user to move the lift device 40 using the drive wheels 92, whilst being supported by the lift device 40. A typical application would be where space is limited and it would be too difficult to have both the wheelchair and the lift in the space, such as but not limited to, in a bathroom or water closet.

The drive wheels 92 can typically be in a default lowered position, with manual override (FIGS. 23A-23C) or electrical power (FIGS. 24A-24C) required to raise them. The wheel assembly can also be spring loaded 96 to ensure best contact to floor surface F when unevenness is encountered.

The means by which the drive wheels 92 are controlled will be selectable and only one option can be selected at a time to avoid uncontrolled/accidental activation of the drive wheels.

Connectivity options for the purpose of controlling the drive wheels may include but not be limited to a controller/ application wirelessly connected via Smartphone/Radio remote control or Bluetooth link to control circuitry or physical remote control connected to control circuitry via cable.

In some embodiment, a manual override option can be available where a caregiver or family member would like to push the lift device 40 with the user being supported for short distances, or push the lift out of the way when the base is in the retracted condition. The lift device 40 may be configured in that manual override can be selected with the base unit 80 being in the stabilized or retracted conditions, but the base will be prevented from going from the retracted condition to the stabilized condition whilst the manual override is selected. This can be achieved by interlock switches incorporated on the manual override mechanism of the drive wheels 92 to sense when wheel is retracted. The reason for this interlock being to prevent the lift device 40 being used by the user to support himself from an unsupported position whilst the drive wheels are manually overridden, which will disable maneuverability and more critically braking.

Manual override, as best illustrated in FIGS. 23A-23C, can include the manual raising of the drive wheels 92. This can be achieved by pushing down an override lever 98, attached to the wheel carrier 94, and hooking it over a protrusion 100 extending from the side of the base 82. This protrusion 100 can also be or include an electric switch, which serves as an interlock switch preventing the base 82 from going from the retracted condition to the stabilized condition whilst the manual override is selected. This manual override configuration is the same for both drive wheels. This manual override lever 98 is visible and accessible on the outside of the base 82.

The wheel carrier 94 is pivotably mounted to the base 82 or a mounting thereof. The spring 96 is configured to force the wheel carrier 94 to pivot so that the wheel 92 is in contact with the floor F, consequently placing the lever 98 in a raised position. To the raise the wheels 92 of the floor F, the user could pressed or step down on the portion of the lever 98 that is accessible outside the base 82, which would pivot the wheel carrier 94 towards and against the force of the spring 96. Releasing the lever 98 would automatically lower the wheels 92.

Figure 24A:
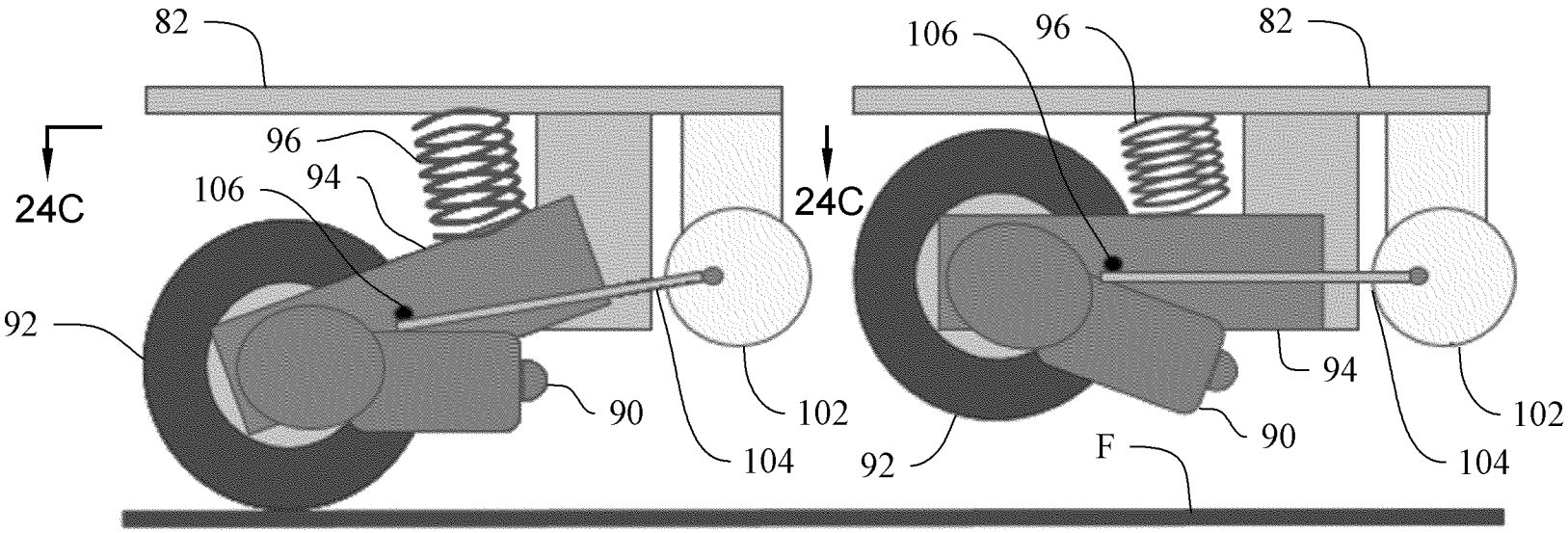
FIGS. 24A-C are plane views of a motorized wheel raising and lowering arrangement, with FIG. 24C being a top elevational view taking along line 24C-24C in FIG. 24A.
Figure 24B:
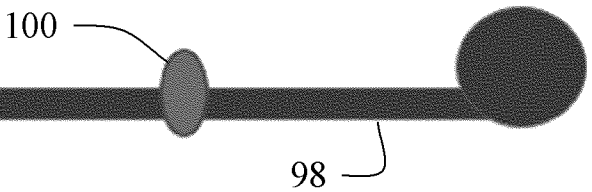
Figure 24C:
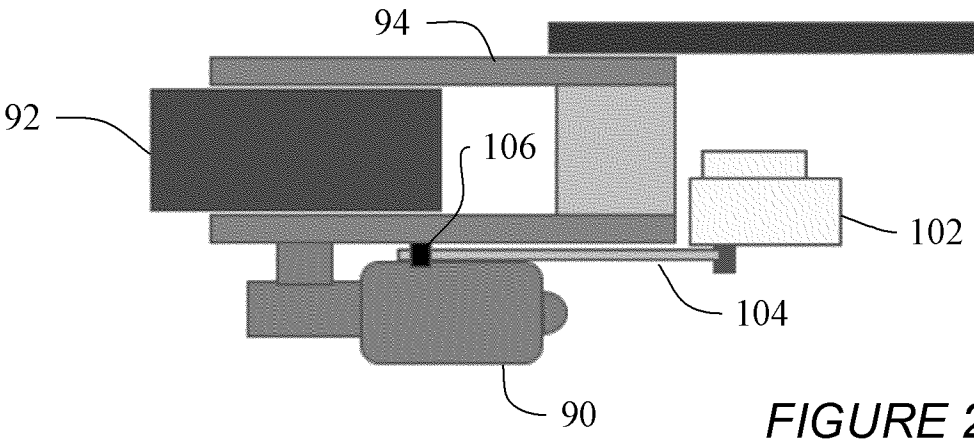

In some embodiments, as best illustrated in FIGS. 24A-24C, the manual override lever can take the form of a linkage lever 104 that can be operated by a stepper motor 102 mounted to the base 82 or a mounting thereof. A linkage, disc or wheel can be operably attachable to the shaft of the stepper motor 102. On end of the linkage lever 104 can be operably coupled to the linkage part of the motor 102 in an offset arrangement from a longitudinal axis of the stepper motor shaft. An opposite end of the linkage lever 104 can be engageable with a protrusion or mount 106 of the wheel carrier 94.

Rotation of the stepper motor 102 results in translational movement of the linkage lever 104, which consequently rotates the wheel carrier 94 about its pivot point thereby lifting the wheel assembly off the ground against the biasing force of the spring 96.

Figure 25A:
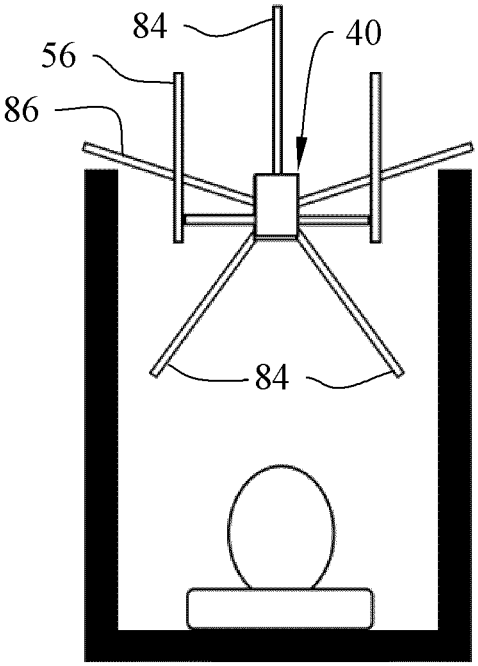
FIGS. 25A-25E are top schematic views of the folding legs in a variety of configurations.
Figure 25B:
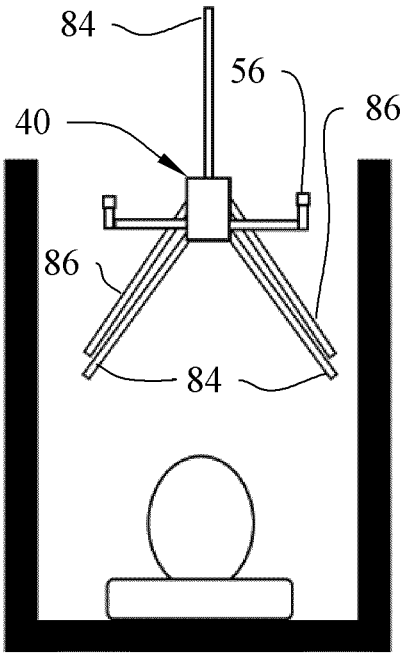

An operational feature of the present technology is partial rotation of the foldable legs 86. This feature can be utilized where the lift device 40 may be required to be used in an area with limited space. An example of which, as best illustrated in FIG. 25A-25E, is the utilization of the lift device 40 in a water closet/bathroom, where the user would not be able to use the facility as the lift's footprint would be too wide to fit between the walls if it is in the full stabilizing condition per FIG. 25A. With the lift device 40 in the retracted condition, it may enter the water closet/bathroom, but there is insufficient space to put the base into the stabilizing condition, as illustrated in FIG. 25B. This feature allows the user to enter the water closet with the base in the retracted condition, and then select partial rotation option, which will cause the base to be expanded on the one side only. As the lift device 40 is not in the stabilizing condition for full rotation, rotation is limited to a predefined angle, for example, approximately 150°, by means of physical discs mounted on the post, with associated mechanism, as further described below and illustrated in FIG. 25C-25E. Another option is to select the partial rotation option prior to entering the water closet, and then use the drive wheels 92 to move the lift device 40 into the water closet whilst the user is being supported by the lift.

The partial rotation can be selected for one side at a time, and the lift device 40 is still put into this partial stabilizing condition by lowering the lifting arms 56 into the supporting condition. An interlock prevents the partial mode being changed once the lift device 40 is in the stabilizing condition. This function may also conserve energy as an added benefit, as only one side of the base is expanded.

In the exemplary, with reference to FIGS. 26-30C, there may be four modes of rotation of the head unit about the post:

Full Driven Rotation—Rotation through 360° about the post effected by a worm drive motor 140 coupled to a ring gear 134 mounted on the post. The head is rotatably fitted to the post by using two taper roller bearings 180, 181 (see FIGS. 38 and 39). These bearings 180, 181 are biased towards radial forces during rotation of the head under load, and at the same time will carry the head to which the channel assembly is attached and the lifting arms are pivotably secured thereto. Rotation of the head unit about the post is achieved by placing the ring gear 134 on the post between the two taper roller bearings 180, 181 and driving this with the worm drive motor assembly 140 or similar, which is attached to the back of the head unit away from the user when supported by the lifting arms.

Full Free Rotation—Rotation through 360° about the post effected by manually pushing/rotating the head unit about the post as the worm drive motor is manually disengaged. A worm drive motor can be used to effect rotation, which is hingedly mounted on the head unit and interfaces with the ring gear. The worm drive motor is capable of being manually disengaged to allow free rotation by manually pushing/rotating the head unit about the post, when lift is in stabilizing condition. The mechanism is interlocked when the lift is not in this condition, which will prevent the drive motor from being disengaged to effect free rotation.

The motor can be hinged between the engaged and disengaged positions by means of a spring loaded selection lever attached thereto and protruding through to the outside of the enclosure through a gated slot, which locates the lever in either one of the two positions.

Figure 25C:
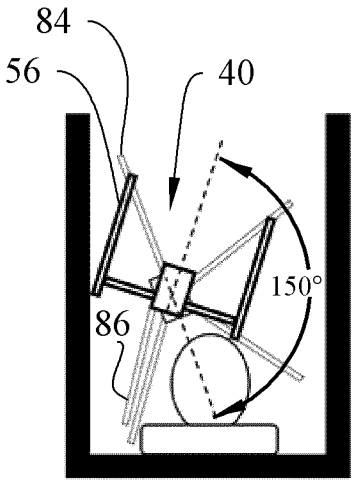
Figure 25D:
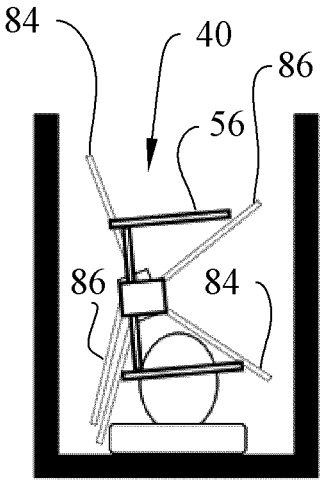
Figure 25E:
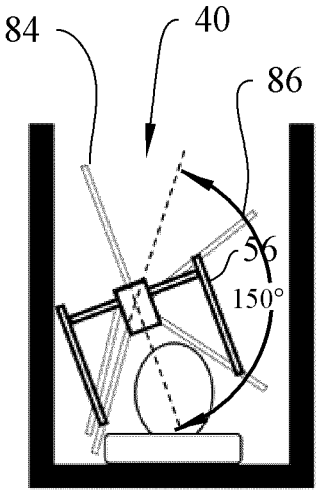

Partial Driven Rotation—Rotation about the post is effected by the worm drive motor and ring gear arrangement, but it is limited to a predefined angle, for example, approximately 150°, per side in order to prevent the lifting arms to rotate over the section of the base, which is not in the stabilizing condition, as best illustrated in FIG. 25C-25E. In FIG. 25C, the lifting arms 56 is in its most counter clockwise position. It is able to rotate clockwise over the section of the base that is in the stabilizing condition, until the lifting arms 56 reaches the most clockwise position as illustrated by FIG. 25E.

Partial Free Rotation—Rotation about the post is effected by manually pushing/rotating the head unit about the post as the worm drive motor is manually disengaged, but it is limited to a predefined angle, for example, approximately 150°, per side in order to prevent the lifting arms to rotate over the section of the base, which is not in the stabilizing condition.

Figure 26:
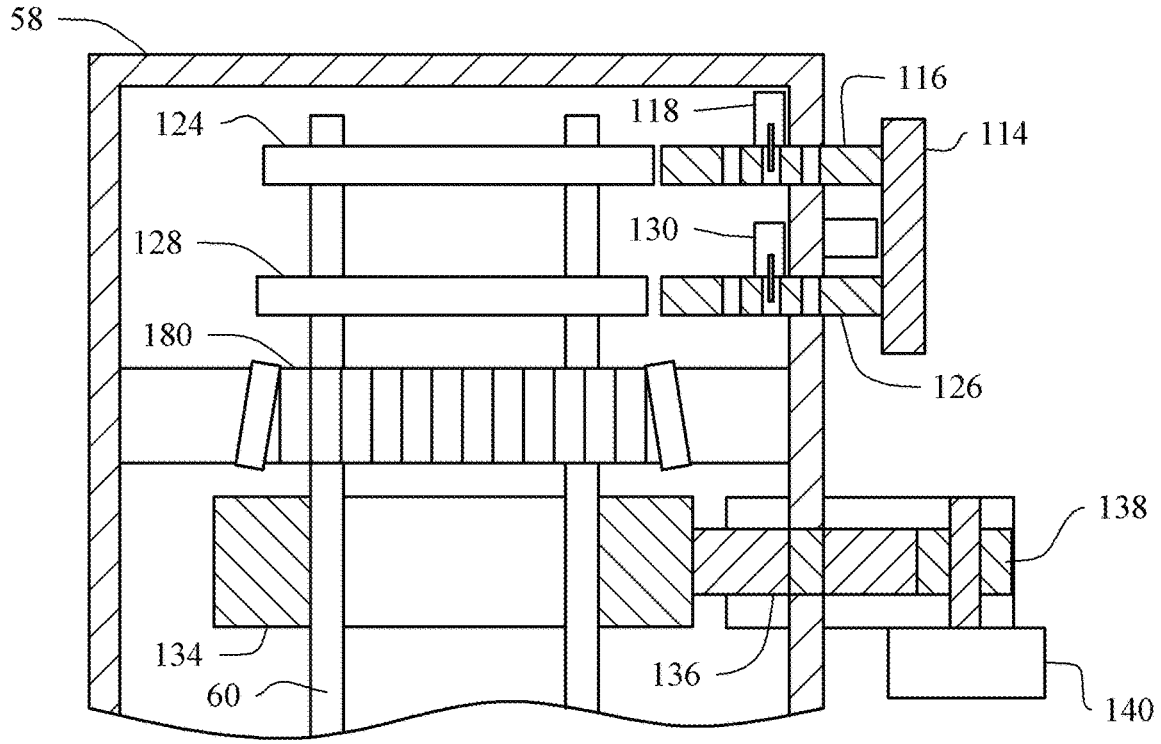
FIG. 26 is a cross-sectional view of a motorized head unit.

A mechanism that can be used to achieve the partial rotation feature can include two discs 124, 128 mounted above the top taper roller bearing 180, as best illustrated in FIG. 26. The discs 124, 128 can be mounted in the cavity between the post and the head unit, and the discs 124, 128 can include removed or notched sections. FIG. 26 best illustrates the discs 124, 128 in relation to the top of the post and other components. This mechanism can include a pivotable or pushable rotation selection lever 114 that interacts with a pair of push rods 116, 126, each of which defining a plurality of holes. Each push rod 116, 126 is also associated with a corresponding solenoid 118, 130 that can engage with at least one of the holes, respectively. Ends of the push rods 116, 126 are engageable with the removed or notched section of their corresponding disc 124, 128.

Figure 27:
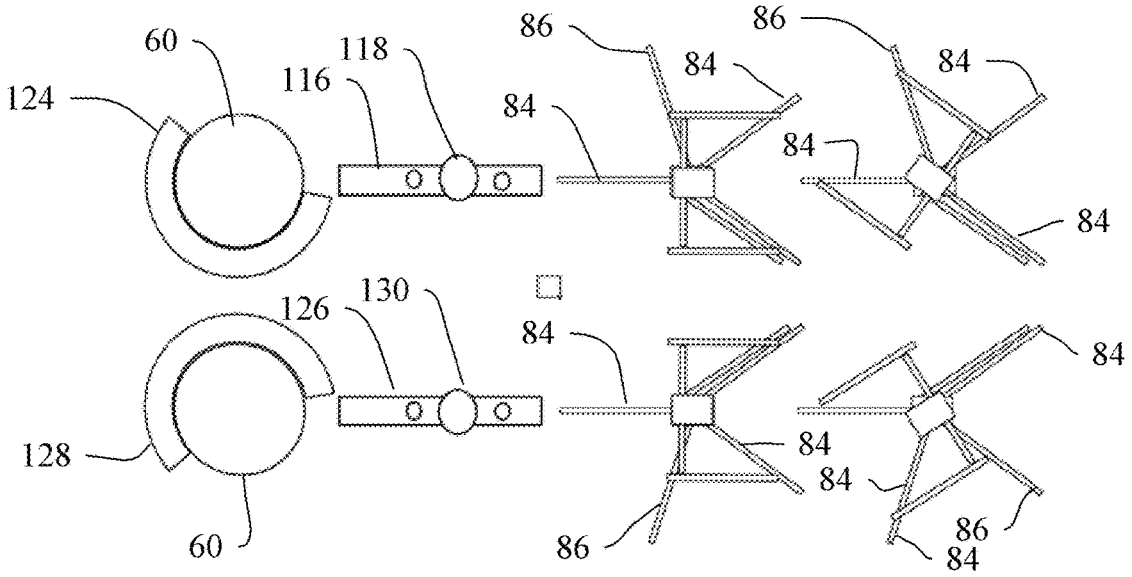
FIG. 27 is a top elevational schematic view of the discs and push rods associated with the motorized head unit in varying operational states with corresponding folding leg configurations.
Figure 29:
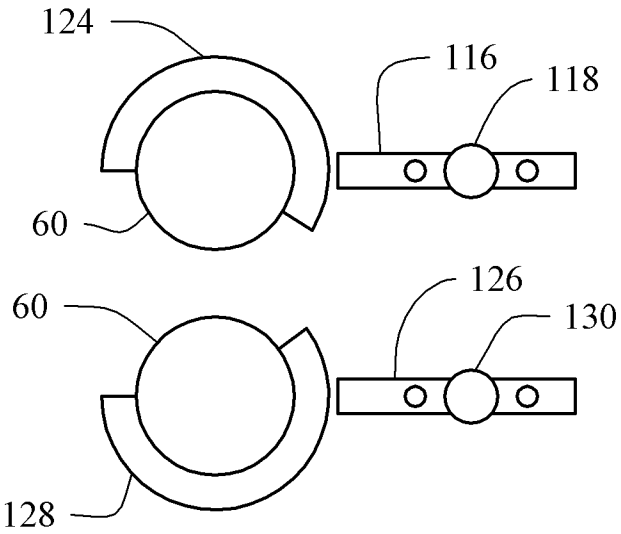
FIG. 29 is a top elevational schematic view of the discs and push rods in the full rotation mode of FIG. 28.

These discs 124, 128 can be mounted to the post tube 60 in an orientation as shown in FIG. 27, with the right hand side of it illustrating an orientation of the foldable legs 86 corresponding to its disc position. As the discs 124, 128 are attached to the post 60, they remain aligned with the fixed legs 84 on the base in the same orientation. The portions of the discs 124, 128 that were removed in this configuration, being a predefined angle, for example, approximately 150°, of full rotation, reflects the safe rotation range when the base is only in the stabilizing condition on one side. The sections of the discs 124, 128 that remain and are fixed to the post reflect the unsafe rotation range when the base is only in the stabilizing condition on one side.

Referring to FIGS. 27-30C, partial rotation can be activated by selecting either Right Partial Rotation or Left Partial Rotation. This can be accomplished by pushing or pivoting the lever 114 in either at the top or at the bottom. The lever 114 is interlocked by means of two solenoids 118, 130 that extend through the series of holes in top and bottom push rods 116, 126, respectively.

Figure 28:
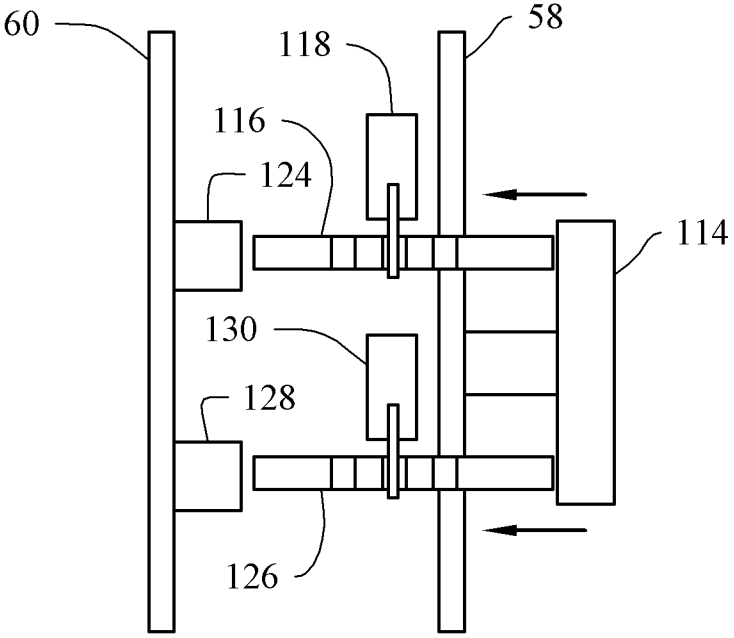
FIG. 28 is a cross-sectional schematic view of the discs and push rods in a full rotation mode.
Figure 30A:
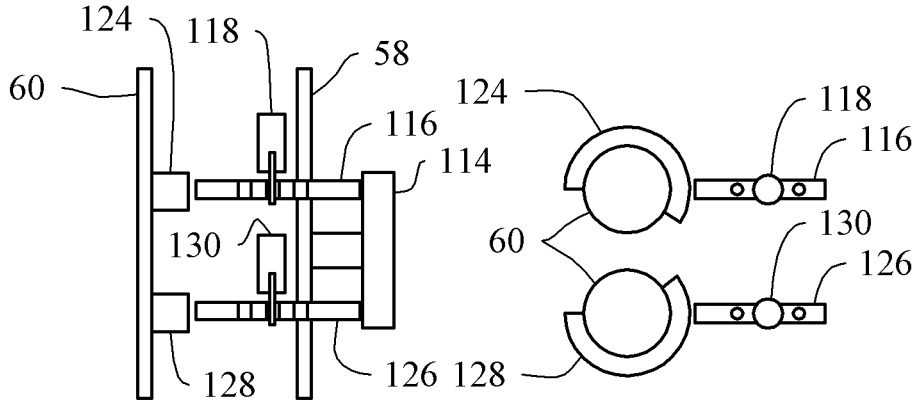
FIGS. 30A-C are top elevational schematic views of the discs and push rods in the full rotation mode (FIG. 30A), the partial right rotation mode (FIG. 30B), and the partial left rotation mode (FIG. 30C)

Full free rotation of the head unit can be accomplished by keeping the lever 114 in a non-pushed configuration, as illustrated in FIGS. 27, 28 and 30A. In this configuration, the ends of the push rods 116, 126 are not received in the removed sections of their corresponding discs 124, 128.

Figure 30B:
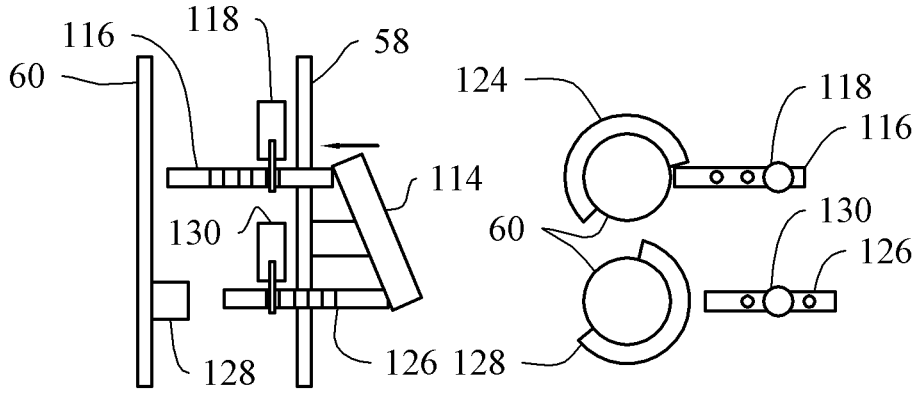
Figure 30C:
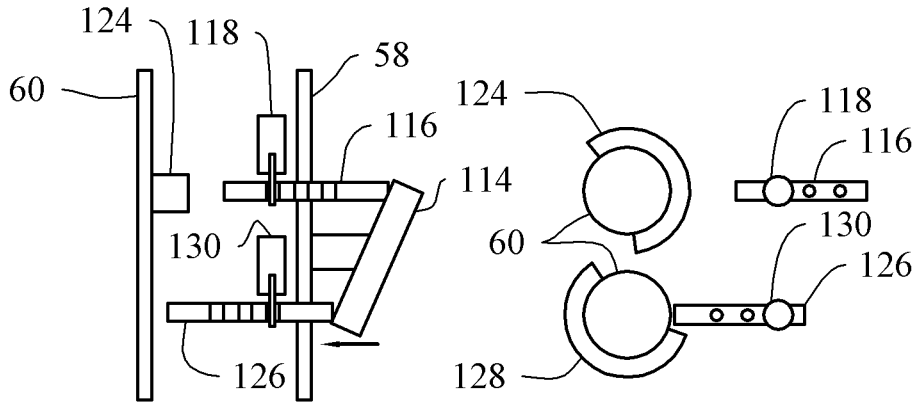

A partial rotation selection can be made when the base is in the retracted condition, and as such the solenoids 118, 130 interlock the lever 114 from having any movement whilst the base is not in this condition. Once partial rotation mode is selected, the selected pushrod 116, 126 is pushed into the cavity of the portion of the disc 124, 128 that was removed, i.e. the 150° portion. The base is put into a partial stabilizing condition, and the lever 114 is interlocked to remain in the chosen position, as best illustrated in FIGS. 30B and 30C. As such, the selection for partial rotation cannot be changed whilst the base is in the stabilizing condition.

Once rotation reaches the end of this safe range, the push rod 116, 126 physically makes contact with the portion of the disc 124, 128 that was mounted on the post, and physically prevents the head from any further rotation in that direction. Although this is a mechanical safeguard against rotation outside the safe range, electrical switches (not shown) mounted on the discs 124, 128 can cause driven rotation to stop as well.

Once the base is put into the retracted condition, the rotation mode can be changed, as electronic sensors on the folding legs 86 (not shown) will provide a signal to the control unit, causing the solenoids 118, 130 to retract and allow rotation selection lever 114 to move.

Optical couplers (not shown) can be included, which provide the electronic signal to the programmable control unit of whether a partial rotation mode is selected or not by using the holes in the pushrods 116, 126 as well. This electronic signal is used by the control unit to move the corresponding foldable leg 86 into the stabilizing condition based on the partial rotation mode selected, or to move both foldable legs 86 into the stabilizing condition if no partial rotation mode is selected.

Figure 31A:
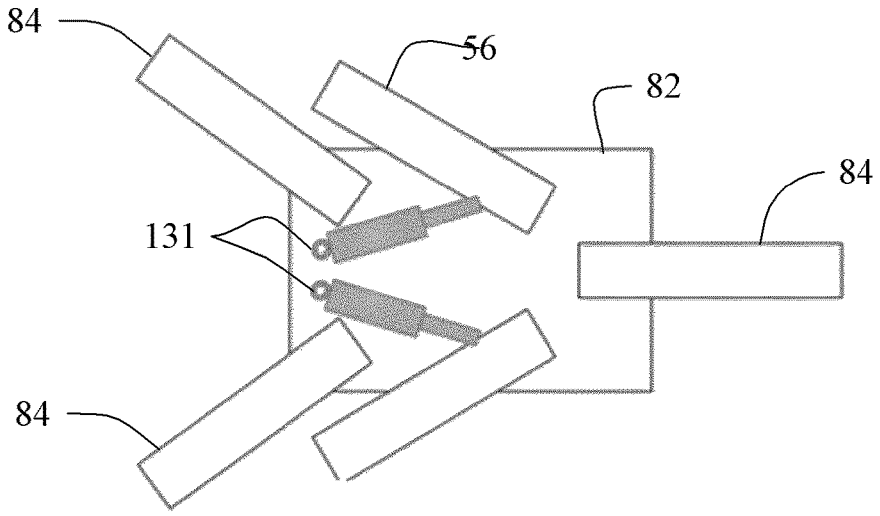
FIGS. 31A-B are top elevational views of the base with the folding legs operated by linear actuators to allow for partial rotation functionality.
Figure 31B:
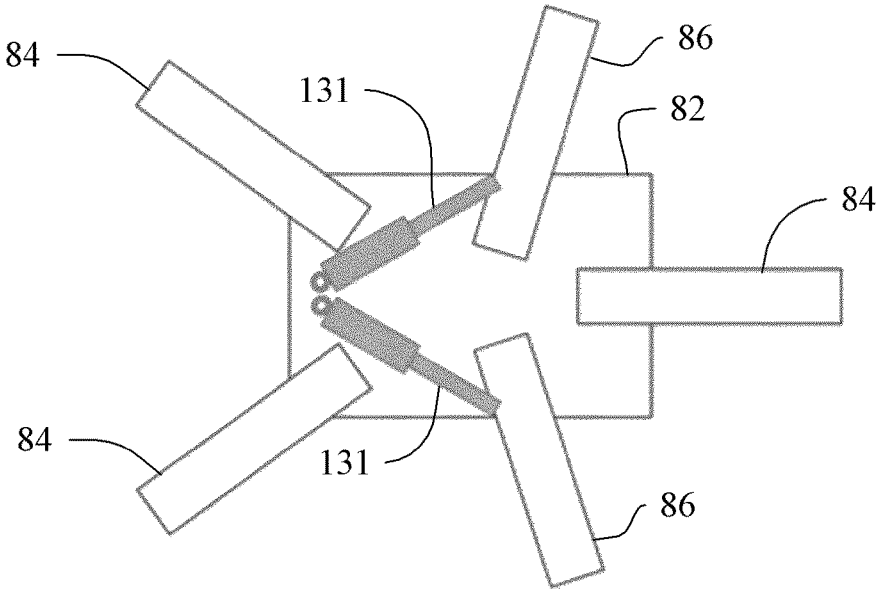

In some embodiments, and to allow the partial rotation functionality, each foldable legs 86 can be moved independently between stabilizing and retracted conditions through the use of a linear actuator 131 or the like, as best illustrated in FIGS. 31A-B. FIG. 31A shows the base in the retracted condition whilst FIG. 31B shows the base in the stabilizing condition. A programmable control unit can be utilized to control each linear actuator 131 independently, and which also controls other electronic functions of the lift device 40. It can be appreciated that the linkage between the lifting arm arrangement and the foldable legs 86 can be electronic as opposed to a mechanical linkage.

Referring to FIGS. 32-36B, as discussed above a turning handle was moved between two protrusions 11.1 and 11.2 in order to effect vertical movement of the head 11.1 and rotation of the head 11.2.

Figure 32:
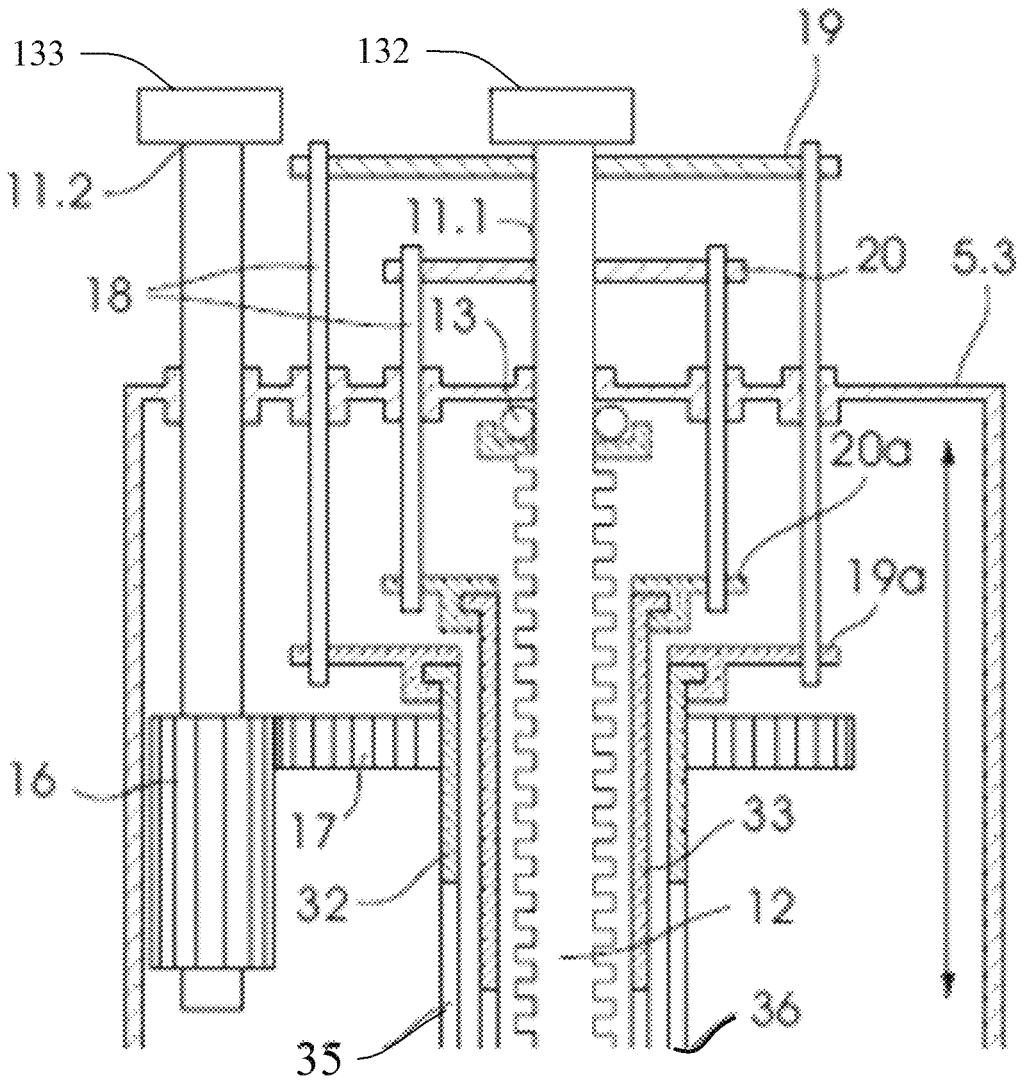
FIG. 32 is an enlarged cross-sectional view of the lifting device utilizing spur gears on the two protrusions.
Figure 33A:
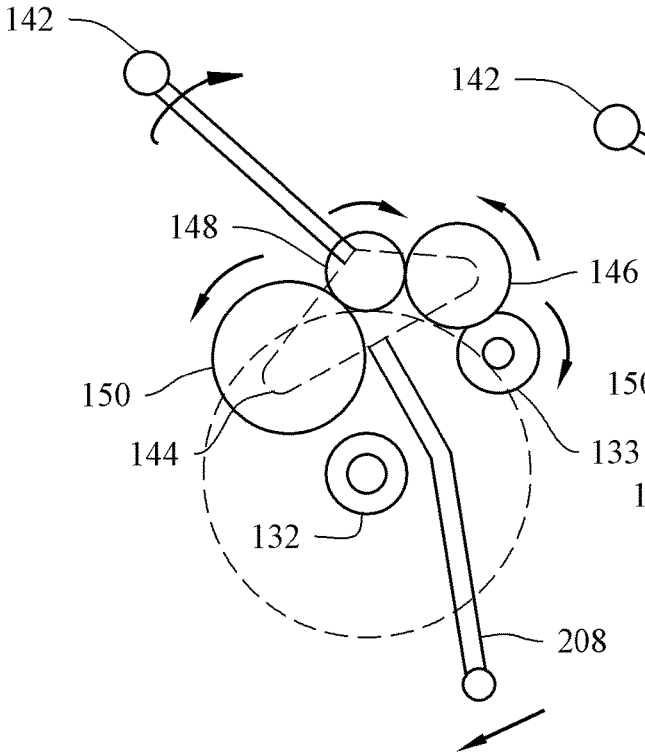
FIGS. 33A-B is a top elevational schematic view of the jockey assembly utilizing a spring biased handle for controlling engagement with the spur gears in an engage and disengaged position.
Figure 33B:
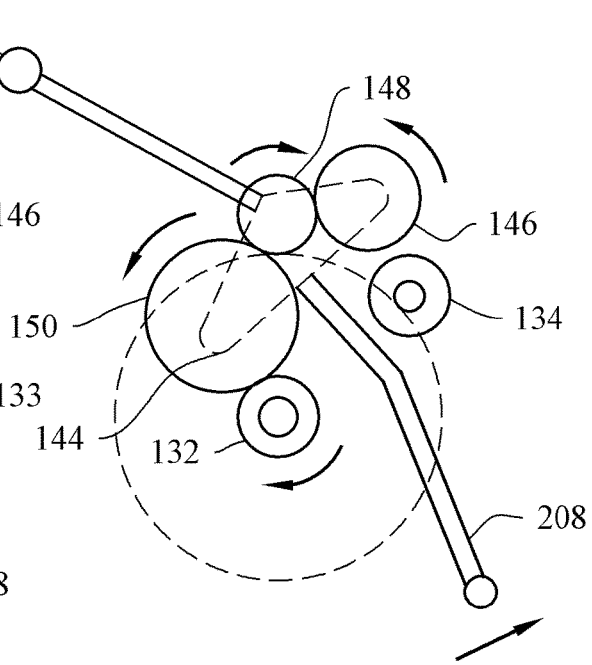
Figure 34A:
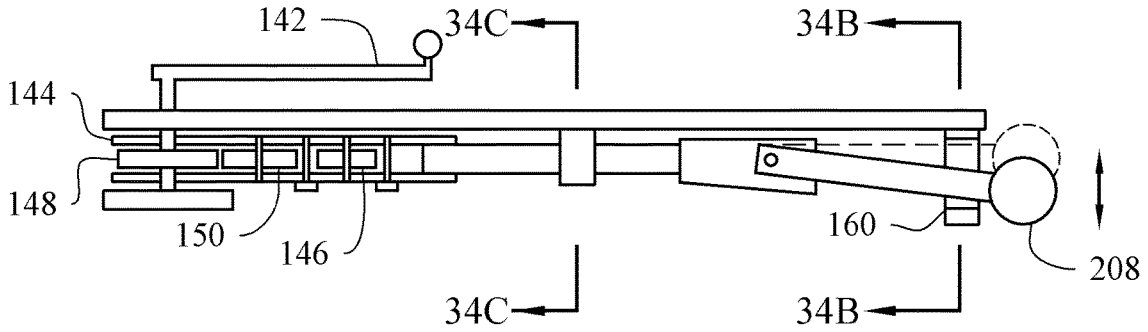
FIG. 34A is a cross-sectional view of the jockey assembly utilizing the spring biased handle for controlling engagement with the spur gears of FIG. 33.
Figure 34C:
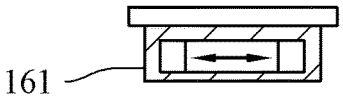
FIG. 34C is a cross-sectional view of the jockey stabilizing cradle taken along line 34C-34C in FIG. 34A.
Figure 34B:
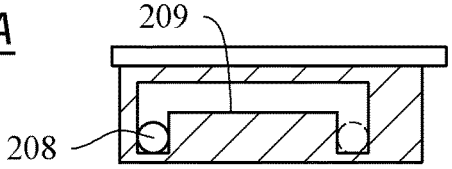
FIG. 34B is a cross-sectional view of the gate taken along line 34B-34B in FIG. 34A.

Some embodiments of the present technology can include two spur gears 132, 133 fitted to the top of shafts 11.1 and 11.2 and the two protrusions were removed, as best illustrated in FIG. 32. A jockey assembly can be included in which the turning handle 142 is fixed to one new protrusion and the jockey assembly 144 is swung between two positions by means of a spring loaded handle 208, which in turn engages with either one of the two small spur gears 132, 133 whilst remaining engaged with a central drive gear 148. The spring loaded handle 208 is used in conjunction with a gate 209 in order to ensure proper engagement of the jockey 144 in each of the selected positions, as best illustrated in FIGS. 32-34. A cradle 161 can be used to support and cradle the jockey 144, as best illustrated in FIG. 34C. It can be appreciated that a crank handle 142 can be provided for convenient rotation of the central drive gear or shaft 148. Rotation of the crank handle 142 provides rotation of a first gear 146 and a second gear 150 associated with the jockey 144 in the opposite direction.

The handle 208 can be moved to pivot the jockey 144 so that the first gear 146 of the jockey 144 is engageable with one of the spur gears 133. The handle 208 can then be moved to pivot the jockey 144 in an opposite direction to disengage the first gear 146 from the first spur gear 133, and engage the second gear 150 associated with the jockey 144 with the second spur gear 132.

Figure 35:
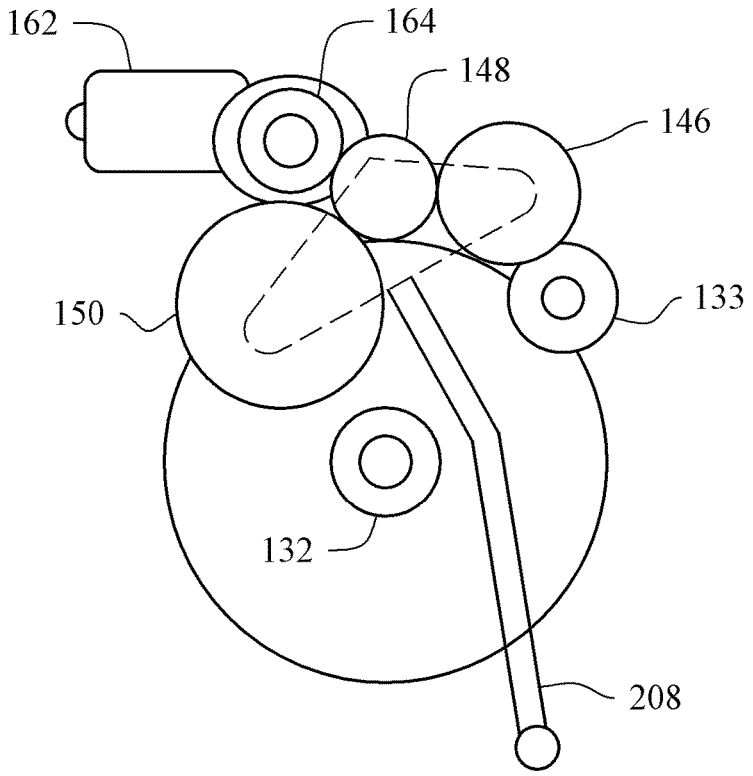
FIG. 35 is a top elevational schematic view of the jockey assembly, utilizing a motorized assembly, for controlling engagement with the spur gears.
Figure 36A:
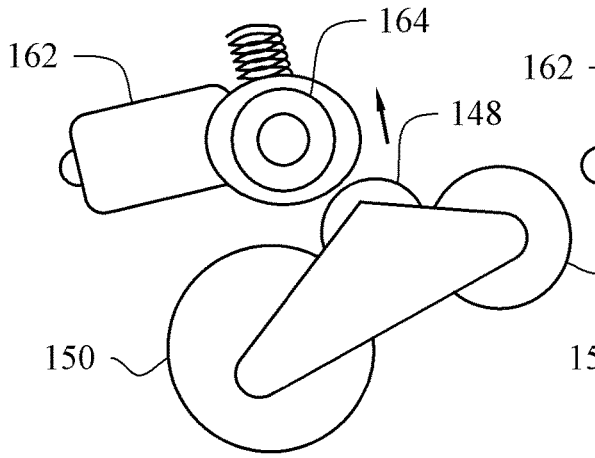
FIGS. 36A-B is a top elevational schematic view of the jockey assembly with the motorized assembly in an disengaged and engaged position.
Figure 36B:
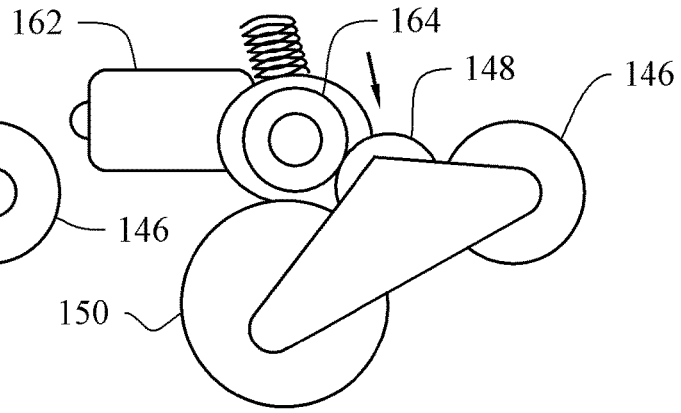

Referring to FIGS. 35-36B, embodiment of the present technology can utilize a worm drive motor 162, in place of or in combination with the crank handle 142, which can be fitted to engage with the same central drive gear 148 that is now enabling lifting and rotation depending on the position of the jockey assembly 144. This would obviate the need for the crank handle 142 for everyday use, whilst it may still be required to lower the head unit in the event of a battery failure. In this event, the worm drive motor 162 can be manually swung away to disengage from the central drive gear 148 to allow lowering the head unit manually by pivoting the jockey to engage with spur gear 132, and using handle 142 to rotate the central drive gear 148. The mechanism can be spring loaded, as best illustrated in FIGS. 36A and 36B, forcing the hingedly attached worm drive motor 162 to engage with the central drive gear 148 by default. A gated lever mechanism and handle similar to mechanism 208, 209 can be used to swing the motor away against the force of the spring.

Figure 37:
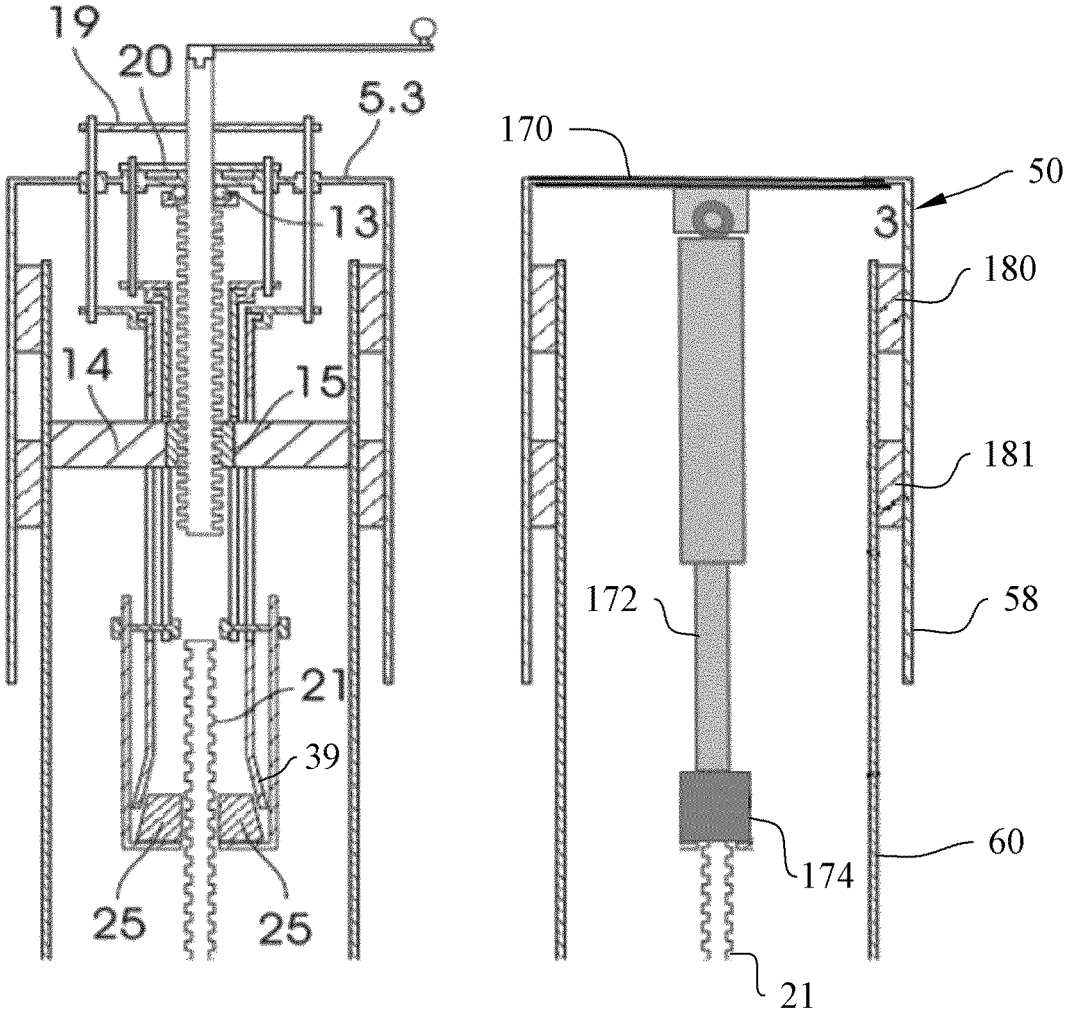
FIG. 37 is a side cross-sectional schematic view of the head unit utilizing taper bearings and linear actuator in electro-mechanical embodiment.

In another embodiment, a linear actuator 172 can be used to replace the cam plate system (22 and 23) in the head unit 5 as well as the gripping wedges 25 and tapered throat 39 assembly of the original embodiment as illustrated in FIG. 6-8, as best illustrated in FIG. 37. In this embodiment of the revised head unit 50, a linear actuator 172 can be controlled to extend or retract by the electronic control unit with signal provided by means of a switch attached to the lifting arms to sense it's position. The linear actuator 172 can be mounted towards the top 170 of the revised head unit 50 and linked via a rotatable coupling 174 to the linear gear 21 that activates the folding action in the base. It can be appreciated that this embodiment is an electro-mechanical combination alternative of embodiments of the present technology. This actuator 172 may not be used for lifting the head unit 50, as the head does not move upwards and downwards in this embodiment.

Figure 38:
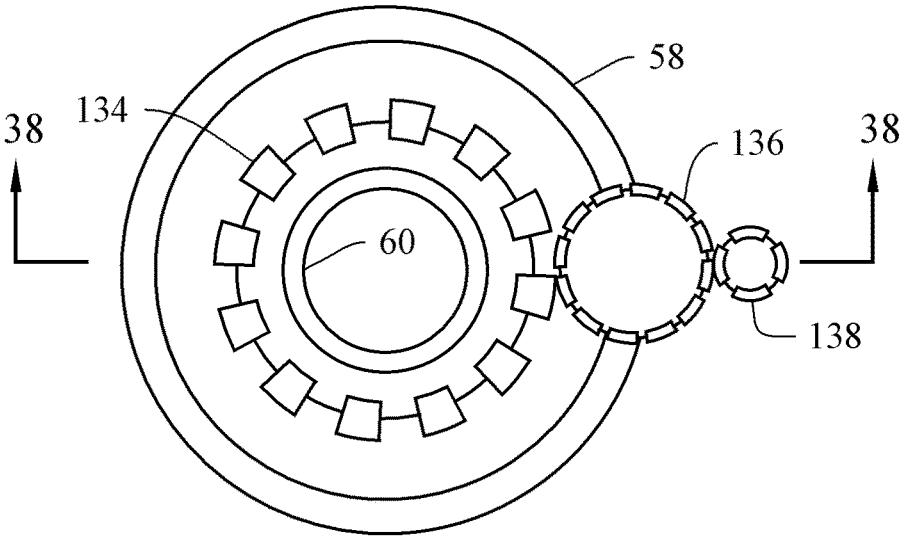
FIG. 38 is a top cross-sectional schematic view of the worm drive motor assembly and ring gear interface taken along line 38-38 in FIG. 39.
Figure 39:
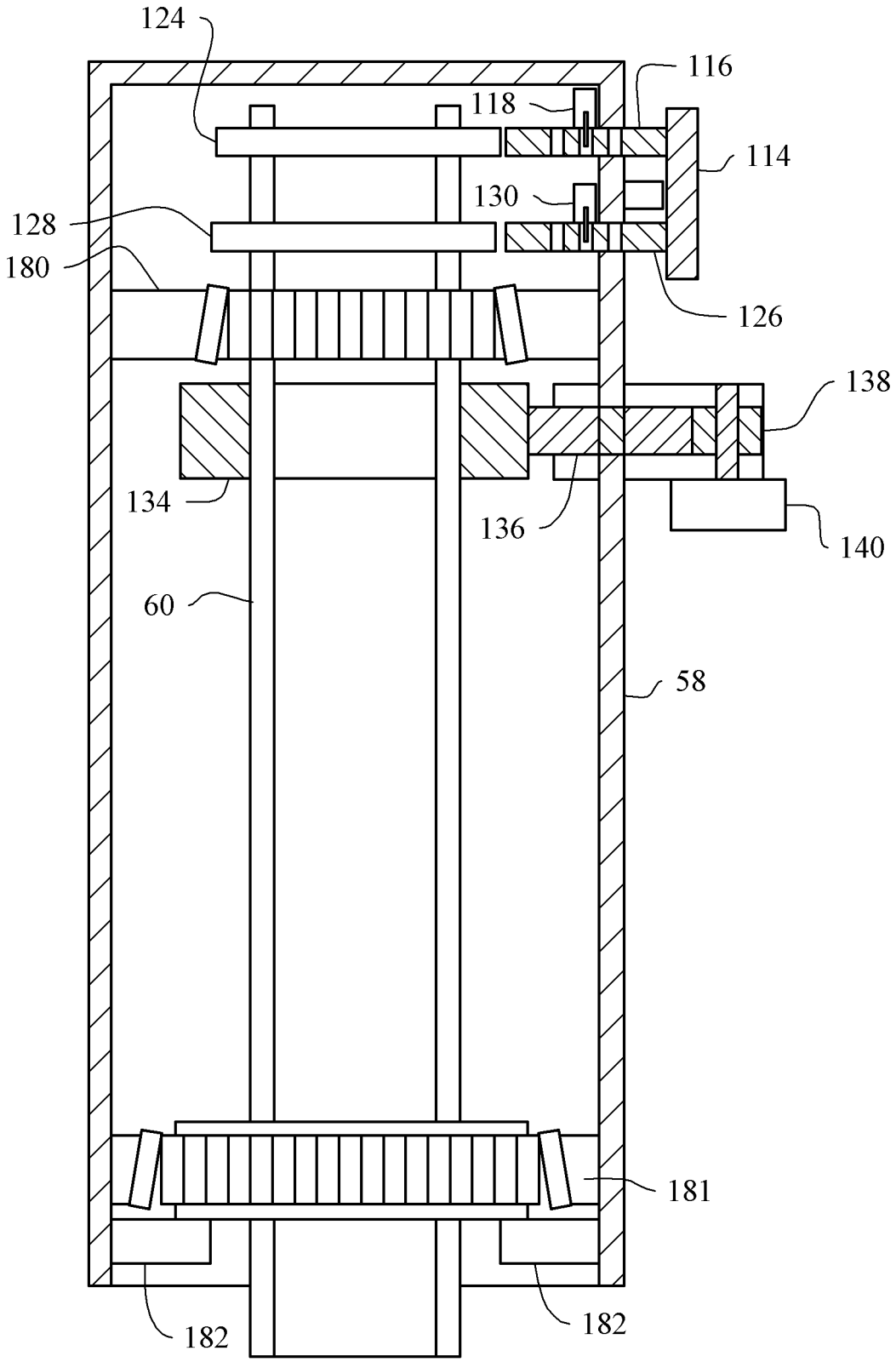
FIG. 39 is a side cross-sectional schematic view of head unit.

Referring now to FIGS. 38 and 39, rotation of the head 58 about the post 60 will be described. The head 58 is rotatably fitted to the post 60 by using two taper roller bearings 180, 181. These bearings 180, 181 are biased towards radial forces during rotation of the head 58 under load, and at the same time will carry the head 58 to which the channel assembly is attached and the lifting arms are pivotably secured thereto. Rotation of the head 58 about the post 60 is achieved by placing a ring gear 134 on the post 60 between the two taper roller bearings 180, 181 and driving this with a worm drive motor assembly 140 or similar, which is attached to the back of the head 58 away from the user when supported by the lifting arms. Locators 182 are fitted to the bottom of the head 58 below the lower taper bearing 181 to prevent the head 58 from lifting.

Figure 40:
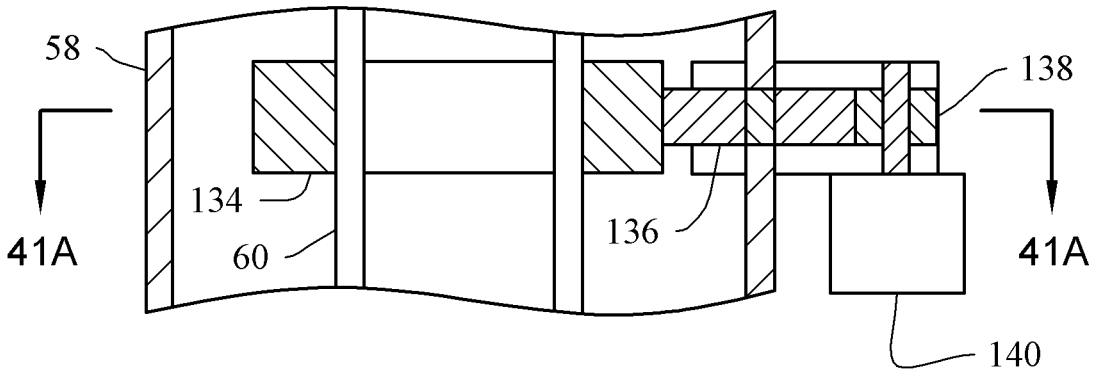
FIG. 40 is an enlarged side cross-sectional schematic view of the worm drive motor assembly used for rotation of the head.
Figure 41A:
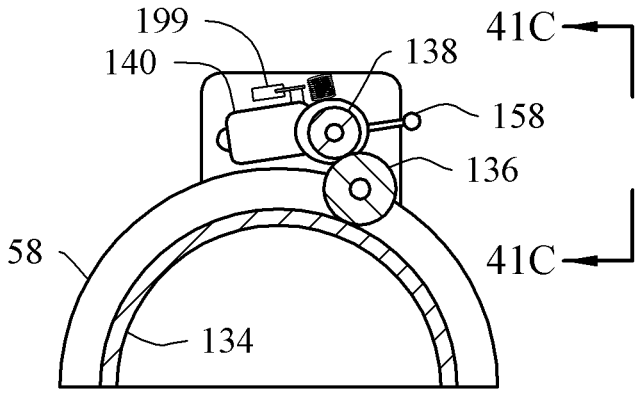
FIGS. 41A-B is an enlarged top cross-sectional schematic view of the worm drive motor assembly in an engaged and disengaged position.
Figure 41B:
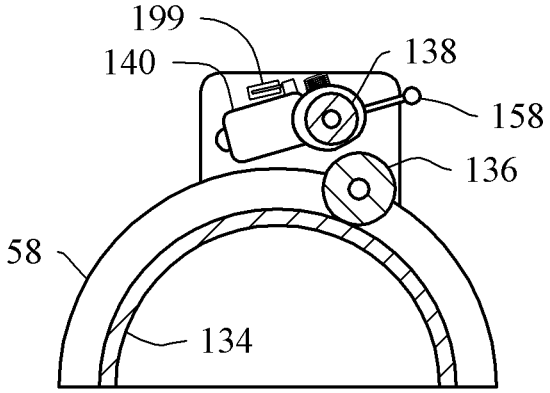

As best illustrated in FIGS. 40-41, the worm drive motor 140 can be used to effect rotation, which is hingedly mounted on the head 58 and interfaces with the ring gear 134 via intermediate gear 136. The worm drive motor 140 can be capable of being manually disengaged with the intermediate gear 136 to allow free rotation by manually pushing/rotating the head 58 about the post 60, as best illustrated in FIG. 41B. This free rotation can be limited to only being operational when the folding legs of the lift device are in the stabilizing condition.

This mechanism can be interlocked when the base is not in the stabilizing condition, which will prevent the drive motor 140 from being disengaged to effect free rotation. Interlock can be achieved by solenoid 199 being at rest with the actuator extended, as best illustrated in FIG. 41A, preventing the drive motor 140 from being hinged and moved away to disengage a drive gear 138 of the motor 140 from an intermediate gear 136 as a bracket on the motor 140 pushes against the solenoid actuator.

When the base is in the stabilizing condition, the solenoid 199 can be electronically energized and the actuator retracted, as best illustrated in FIG. 41B, allowing the motor 140 to be hinged and moved away to disengage the drive gear 138 from the intermediate gear 136. The motor 140 can be hinged between the engaged position (FIG. 41A) and disengaged position (FIG. 41B) by means of the spring loaded selection lever 158 attached thereto and protruding through to the outside of the enclosure through the gated slot 160, which locates the lever 158 in either one of the two positions.

Figure 41C:
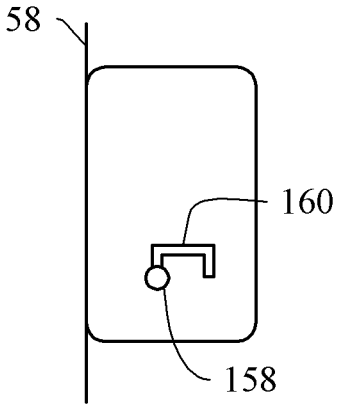
FIG. 41C is an enlarged side view of the drive motor enclosure showing the selection lever and selection gate.

The movement of the selection lever 158 can be controlled or limited by the slot or gate 160 defined through the drive motor enclosure, as best illustrated in FIG. 41C. One portion of the gate 160 can be associated with the engaged position and another portion can be associated with the disengaged position.

The solenoid 199 can be controlled by the control unit, which senses when the base is in the stabilizing condition.

Figure 42:
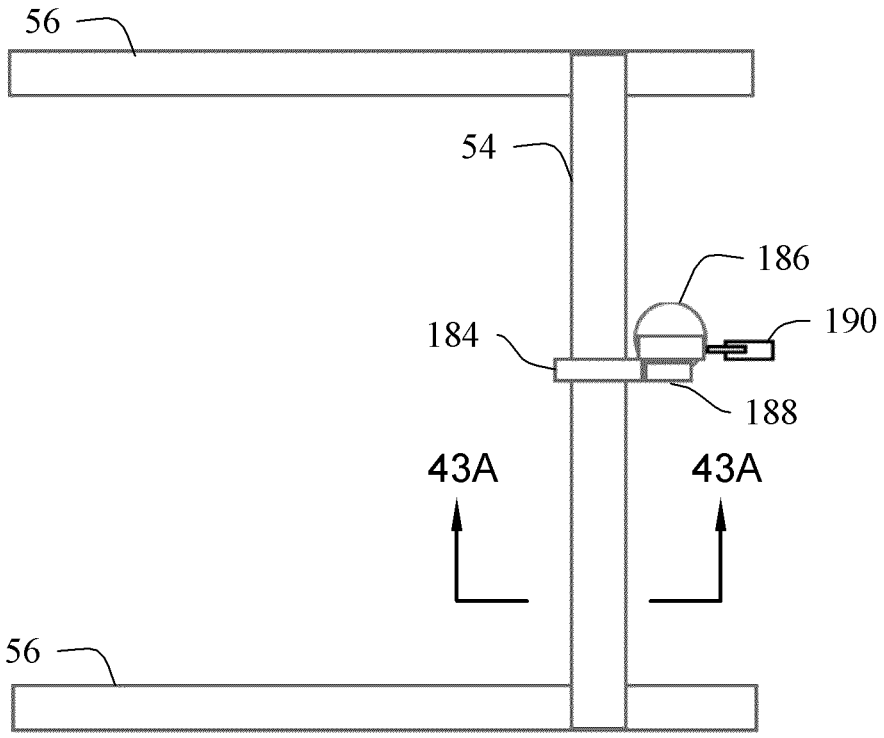
FIG. 42 is a top elevational view of the motorized lifting arms in a supporting position.
Figure 43A:
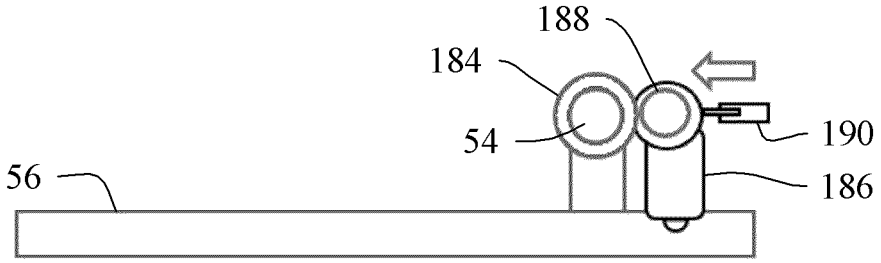
FIGS. 43A-B is a side plane view of the worm drive motor assembly in an engaged and disengaged position.
Figure 43B:
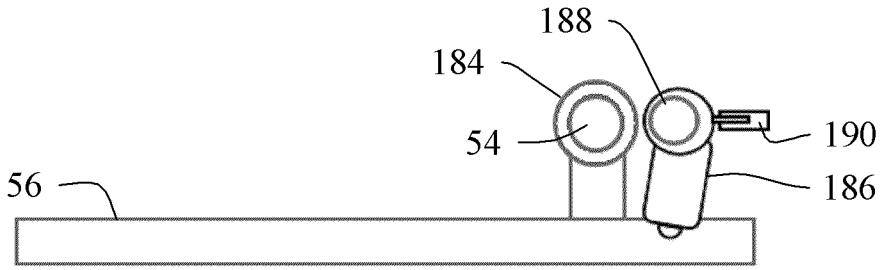

Referring to FIGS. 42-43B, some embodiments of the present technology can include the motorized rotation of the lifting arms 56 between the supporting and inoperative positions. In order to improve on the ease of use of the lift device 40 of the present technology, especially where users have limited upper body movement and hand/arm range limitations, a motorized assembly 186 can be included for utilization of the function of moving/rotating the lifting arm arrangement 54, 56 between the supporting (horizontal) and inoperative (vertical) positions. The motorized assembly 186 can include a ring gear 184 fitted to the center shaft 54 of the lifting arm arrangement, and engaging a worm drive 188 of the motor 186. A solenoid actuator 190 can be included to move the worm drive motor 186 in and out of engagement with the ring gear 184, as best illustrated in FIGS. 43A and 43B. The worm drive motor 186 can be hingedly attached to the lifting arm carrier while solenoid actuator 190 can be fixed securely to the lifting arm carrier or a bracket thereof.

In the event where the user would prefer to move the lifting arm arrangement manually between the two positions, the worm drive motor 186 would by default not be engaged with the ring gear 184 and would not impact on this action. This non-engaging default position can be accomplished by a default position control of the solenoid 190 or by a spring biasing the hinged motor 186 assembly away from the ring gear 184. In the event where the user would prefer to use the motorized function, he will select this via the remote controller or control switch mounted to the head, which will activate the solenoid 190 which would in turn causes the worm drive motor 186 and the drive gear 188, to engage with the ring gear 184 on the center shaft 54, which would cause the rotation of the worm drive motor 186 to rotate the center shaft 54 in clockwise or counter-clockwise direction, depending on selection, causing the lifting arms 56 to rotate between the two positions.

It can be appreciated that electronic limit switches can be utilized to ensure that the solenoid 190 and drive motor 186 is switched off once the lifting arms 56 reached either one of the two final positions.

In some embodiments, the present technology can include inductive charging, wireless charging, or cordless charging. When not in use, the lift device 40 can be maneuvered by means of the drive wheels 92 onto a charging pad making use of inductive charging. It can be appreciated that an automated navigation system can be utilized allowing the lift device to maneuver to the charging pad without assists or control from the user. Another option for charging is to provide a charging station where the lift device gets moved to and in physical contact with the charging terminals, after having allowed for similar connection on the lift itself. It can be appreciated that the lift device can be controlled by remote control via radio frequency remote, Bluetooth, Wi-Fi or smartphone. Artificial Intelligence can also be utilized with the lift device.

Even though the lift device of the present invention is designed to enable independence, it would be useful to log/communicate certain usage events to interested parties like family members that are not at home, e.g. when the user is being supported by the lifting arms and when he is no longer supported. These can include a notice when lift in use, alarms when the user is supported by the lifting arms for extended period of time or when a tilt sensor detects that the lift has tilted more than a maximum preset amount.

Figure 44:
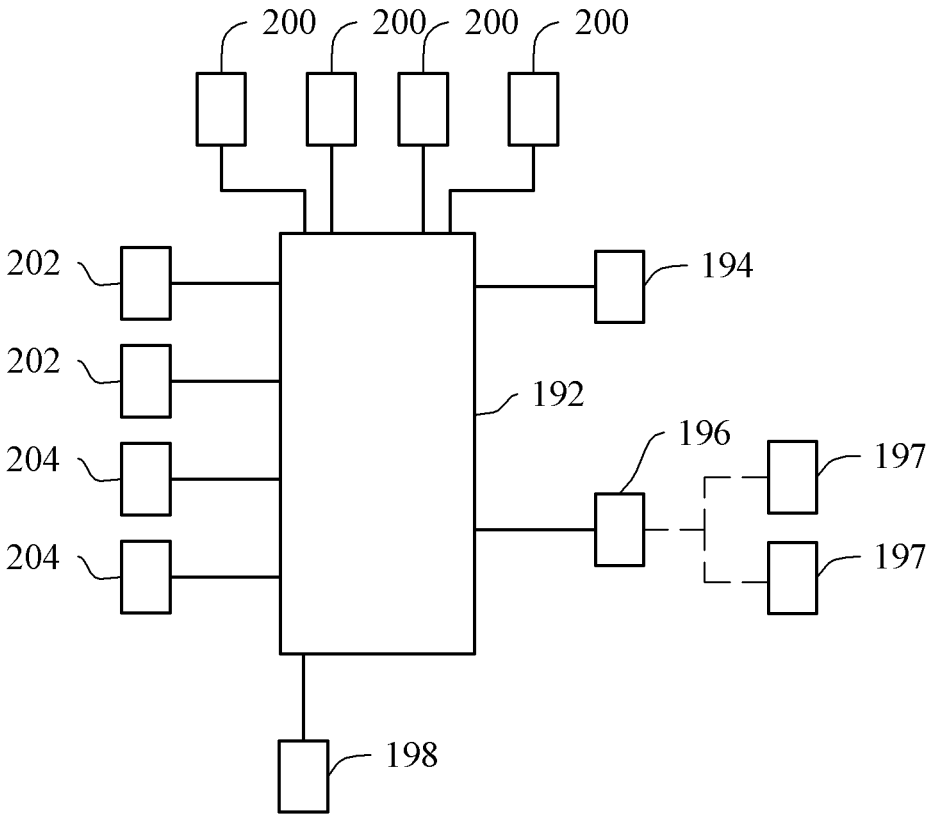
FIG. 44 is a block diagram of an embodiment of the control system constructed in accordance with the principles of the present technology.

Referring to FIG. 44, the elements and operations of the lift device 40 can be controlled by an electronic control system. The electronic control system can include a programmable controller or processing unit 192, a user interface or remote control 194 in operable communication with the processing unit, and a transmitter or receive or transceiver 196 in operable communication with the processing unit. The transceiver 196 is capable of communication with remote device such as, but not limited to, smartphones or "Internet of Things" (IoT) 197. At least one RAM memory and/or at least one non-volatile long term memory can be operably connected or connectable with the processing unit 192. A display 198 in operable communication with the processing unit can be utilized for displaying information regarding the lift device 40.

One or more electronic switches or sensors 200 can be utilized to determine operational status or conditions of elements of the lift device 40. These switches or sensors 200 are in operable communication with the processing unit.

The processing unit 192 can be in operable communication with any or all of the motors 202 and/or actuators 204 associated with the lift device 40. Commands from the remote control 194, transceiver 196 and/or switches 200 can be analyzed by the processing unit 192 to provide control signals to an appropriate motor 202 and/or actuator 204.

It can be appreciated that the lift device 40 and the electronic control unit can be configured or configurable as a complete system. Alternatively, it can be appreciated that the electronic control unit can be configured or configurable as a module connectable in the lift device 40. The control unit can include, but not limited to, a graphics processing unit (GPU), digital signal processor (DSP), Active Server Pages (ASP), central processing unit (CPU), accelerated processing unit (APU), Application Specific Integrated Circuit (ASIC). Even further the control unit can be configured or configurable with software or programming code as part of an operating system or application running on or controlling the lift device 40.

In various example embodiments, the electronic control unit of the lift device 40 operates as a standalone device or may be connected (e.g., networked) to other devices. In a networked deployment, the electronic device may operate in the capacity of a server or a client machine in a server-client network environment, or as a peer machine in a peer-to-peer (or distributed) network environment. The electronic device may be a personal computer (PC), a tablet PC, a set-top box (STB), a personal digital assistant (PDA), a cellular telephone, a portable music player (e.g., a portable hard drive audio device such as an Moving Picture Experts Group Audio Layer 3 (MP3) player), a web appliance, a network router, switch or bridge, or any machine capable of executing a set of instructions (sequential or otherwise) that specify actions to be taken by that device. Further, while only a single electronic device is illustrated, the term "device" shall also be taken to include any collection of devices that individually or jointly execute a set (or multiple sets) of instructions to perform any one or more of the methodologies discussed herein.

The example electronic control unit of the lift device 40 includes a processor or multiple processors (e.g., CPU, GPU, or both), and a main memory and/or static memory, which communicate with each other via a bus. In other embodiments, the electronic control unit of the lift device 40 may further include a video display (e.g., a liquid crystal display (LCD)). The electronic control unit of the lift device 40 may also include an alpha-numeric input device(s) (e.g., a keyboard), a cursor control device (e.g., a mouse), a voice recognition or biometric verification unit (not shown), a drive unit (also referred to as disk drive unit), a signal generation device (e.g., a speaker), a universal serial bus (USB) and/or other peripheral connection, and a network interface device. In other embodiments, the electronic control unit of the lift device 40 may further include a data encryption module (not shown) to encrypt data.

An image processing unit may be utilized and include a module operably associated with a drive unit, with the drive unit including a computer or machine-readable medium on which is stored one or more sets of instructions and data structures (e.g., instructions) embodying or utilizing any one or more of the methodologies or functions described herein. The instructions may also reside, completely or at least partially, within the memory and/or within the processors during execution thereof by the electronic control unit of the lift device 40. The memory and the processors may also constitute machine-readable media.

The instructions may further be transmitted or received over a network via the network interface device utilizing any one of a number of well-known transfer protocols (e.g., Extensible Markup Language (XML)). While the machine-readable medium is shown in an example embodiment to be a single medium, the term "computer-readable medium" should be taken to include a single medium or multiple media (e.g., a centralized or distributed database and/or associated caches and servers) that store the one or more sets of instructions. The term "computer-readable medium" shall also be taken to include any medium that is capable of storing, encoding, or carrying a set of instructions for execution by the device and that causes the device to perform any one or more of the methodologies of the present application, or that is capable of storing, encoding, or carrying data structures utilized by or associated with such a set of instructions. The term "computer-readable medium" shall accordingly be taken to include, but not be limited to, solid-state memories, optical and magnetic media, and carrier wave signals. Such media may also include, without limitation, hard disks, floppy disks, flash memory cards, digital video disks, random access memory (RAM), read only memory (ROM), and the like. The example embodiments described herein may be implemented in an operating environment comprising software installed on a computer, in hardware, or in a combination of software and hardware.

It is appreciated that the software application is configured or configurable to be stored in any memory of the electronic control unit of the lift device 40 or on a remote computer in communication with the electronic control unit of the lift device 40. The software application is configured or configurable to include the interface capable of allowing a user to define custom parameters for controlling the motors 200 and/or actuators 204.

The pivoting action of the lifting arm arrangement 56 has a corresponding impact on the folding legs via a mechanical linkage, an electro-mechanical linkage or a full electrical linkage. In order for the electro-mechanical and full electrical linkage to function, electrical limit switches are fitted to the head 52, as indicated in the two embodiments illustrated in FIG. 13 and FIG. 17 and best illustrated in FIG. 45-FIG. 46B. The switches 214, 216 are fitted to the load bearing section of the head 52 and interfaces with a protrusion 215 on the cross beam or centre shaft 54 to which the lifting arms 56 is secured. When the lifting arm arrangement is in the supporting position as best illustrated in FIG. 46A, the protrusion 215 engages with the switch 214 which provides an electronic signal to the electronic control unit to reflect this position, which will in turn control operations that can be performed by the lifting device in this condition. Similarly, when the lifting arm arrangement is lifted and moved towards the inoperative position, the protrusion 215 will no longer engage with the switch 214, which would signal to the electronic control unit that the base should be put into the retracted condition.

Figure 46A:
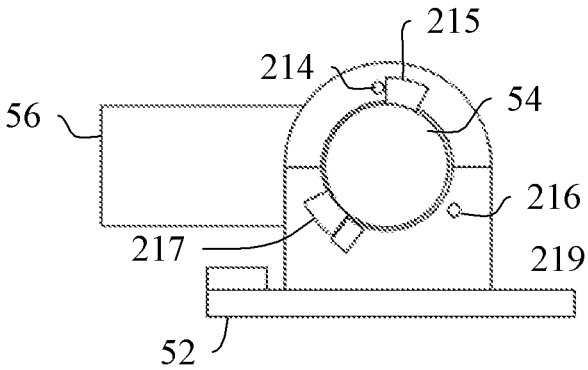
FIGS. 46A and 46B is a side plane view of the lifting arm arrangement in the supporting position and the upmost position.
Figure 46B:
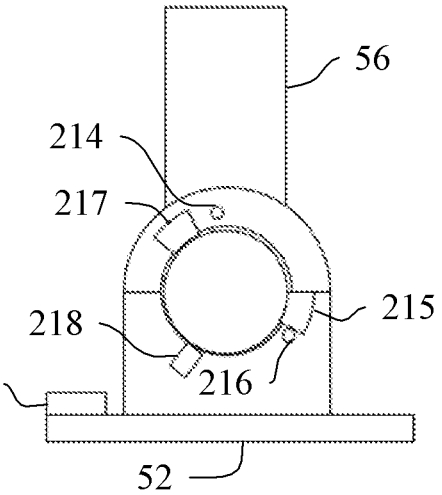

When the lifting arms reach the upmost position as best illustrated in FIG. 46B, the protrusion 215 engages with switch 216 to signal to the electronic control unit that the lifting arm arrangement is in the inoperative position, which will in turn control operations that can be performed by the lifting device in this condition. If the lifting arm arrangement is pivoted away from the inoperative position, the protrusion 215 will no longer engage with switch 216, which would signal to the electronic control unit that the base should be put into the supporting condition. A three-axis accelerometer is integrated with the protrusion 215 on the cross beam 54 which is calibrated with the lifting arms in the inoperative and supporting positions, and this signal is used by the electronic control unit to sense that the lifting arms arrangement is between the two positions, which in turn would allow the electronic control unit to control operation of the lifting device.

Another three axis accelerometer 219 is fitted to the head 52, which provides electronic signal to the electronic control unit regarding the tilt angle of the lifting device. As tilting and ultimately falling over is one of the biggest risks when operating the lifting device, this information is used by the electronic control unit to raise an alarm, which could be visual or audible, but not limited to this, as messaging can be incorporated with the control unit to notify third parties of the a pre-programmed event that occurred. Apart from raising an alarm, the control unit may also be programmed to perform corrective action in certain conditions where the accelerometer 219 senses that the lift is tilting at an angle that exceeds predetermined limits, which may include but not limited to lowering the lifting arm arrangement 56, extending telescopic sections 225 in the legs 84, 86 or applying brakes to the lifting device via the drive wheels 92.

Figure 45:
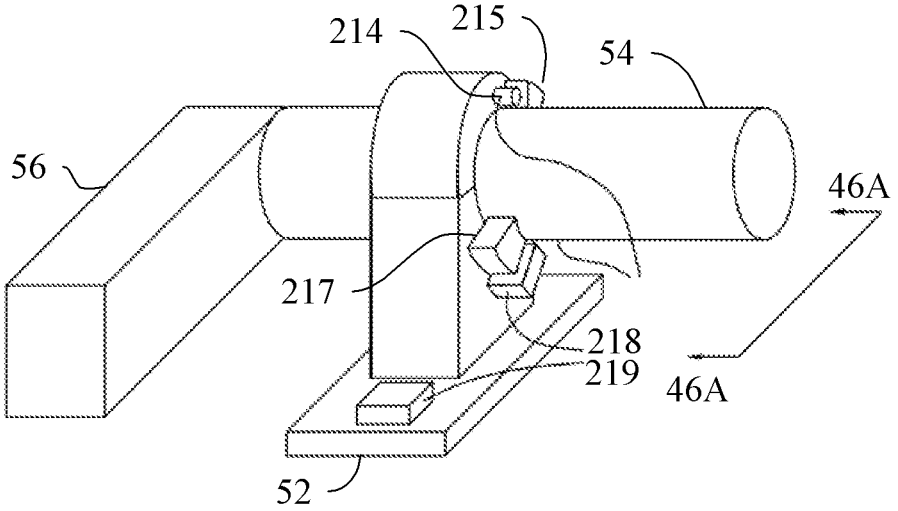
FIG. 45 is a perspective view electro-mechanical assembly of the lifting arm arrangement.

A strain gauge or load cell is integrated with a stopping bracket 218 fitted to the head 52 in a manner as indicated in FIG. 45-FIG. 46B. A load cell is a transducer that is used to create an electrical signal whose magnitude is directly proportional to the force being measured. When the lifting arm arrangement 56 is in the supporting condition, a protrusion on the cross beam 54 stops against the integrated strain gauge and stopping bracket 218 and the load placed on the lifting arm arrangement is translated into an electronic signal via the strain gauge and communicated to the electronic control unit. This signal is calibrated to raise and alarm or cause the control unit to perform certain operations when the predetermined safe working load is exceeded, in the event of overloading the lifting device. Actions performed by the lifting device via the control unit may include but is not limited to preventing the lifting arm arrangement to lift the user, or possibly lower the lifting arm arrangement to its lowest supporting level.

Figure 47:
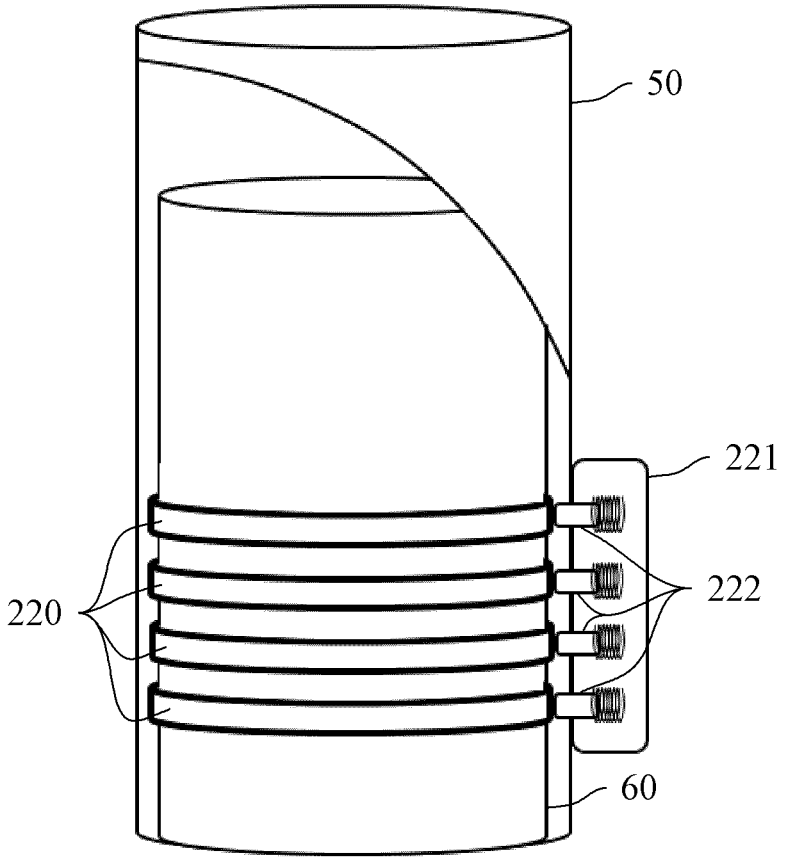
FIG. 47 is a cross-sectional view of the slip ring and brush assembly associated with the head and the post.

As the head 50 rotates about the post 60, the electric signals pertaining to the base of the lifting device, have to be transmitted to the control unit and actuator which is mounted on the head. To complete this electrical connection through a rotating assembly, a slip ring and brush assembly is incorporated as best illustrated in FIG. 47. The slip rings 220 are fitted to the post 60, whilst the brush assembly 221 which contains a number of spring loaded brushes 222 is fitted to the head 50 with the brushes protruding through holes in the head 50 in order to remain in contact with the slip rings 220 as the head 50 rotates about the post 60. Electrical conductors are terminated on each brush and slip ring combination in order to complete the circuit.

Figure 48:
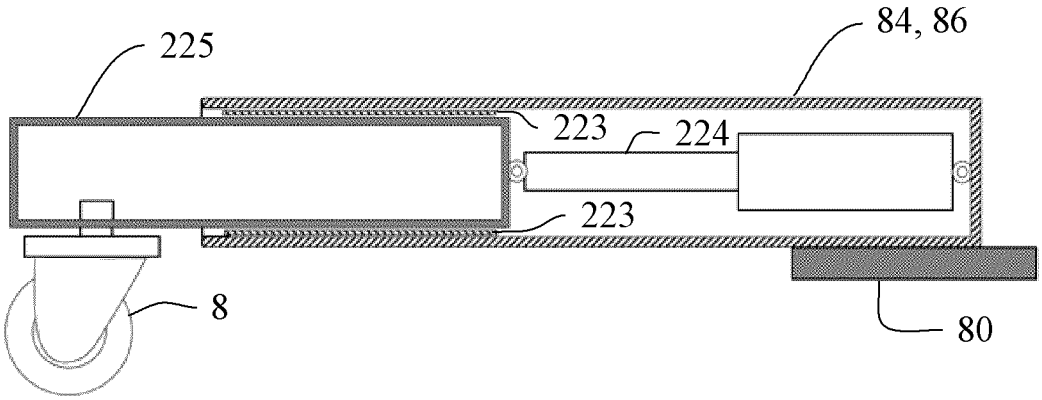
FIG. 48 is the leg with the telescopic section.

In another embodiment, one or more of the legs 84, 86 included on the base 80 may be configured to include a telescopic section 225 which can be extended, to effectively provide a longer leg and improve the stability of the lifting device, or retracted into the leg 84, 86 and thereby reducing the effective width or footprint of the base of the lifting device. The telescopic section 225 of the leg is extended or retracted by means of a linear actuator 224 or other motorized means which is fitted to the associated leg 84, 86. This embodiment is best illustrated in FIG. 48 which provides a side view of a leg 84, 86 on the base 80 with the one side exposed, showing the configuration of the linear actuator 224 which is coupled at one end to telescopic extension 225 and to the leg 84, 86 or base 80 at the other end. The linear actuator 225 is controlled by the control unit via the actuator and the castor wheel 8 is mounted to the telescopic extension 225 instead of the leg 84, 86. The telescopic section 225 may be guided within the leg for relative longitudinal, sliding movement by polymeric, typically Vesconite™, bearings 223 as illustrated, but guiding sliding means is not limited to the polymeric.

Further in some embodiments of the mobile lifting system of the present technology, the fixed leg and the moveable leg can each includes a spring configured to pivot the wheel away from the fixed leg and the moveable leg, respectively.

Some embodiments of the mobile lifting system of the present technology can include a wheel motor operable associated with each wheel.

Some embodiments of the mobile lifting system of the present technology can include a raising mechanism associated with each wheel and configured to pivot the wheel toward the fixed leg and the moveable leg, respectively.

Some embodiments of the mobile lifting system of the present technology can include a track unit attached to the head, the track unit including a carriage configured to travel along a length of the track, the carriage being attached to the lifting arm arrangement.

In some embodiments of the mobile lifting system of the present technology, the track unit can include a track motor configured to move the carriage.

In some embodiments of the mobile lifting system of the present technology, the track unit can include threaded rod operable associated with the motor and threadably engageable with the carriage, wherein rotation of the threaded rod by the motor imparts movement of the carriage.

In some embodiments of the mobile lifting system of the present technology, the lifting arm arrangement can include a pair of spaced apart arms extending from a cross-beam pivotably secured to the head.

In some embodiments of the mobile lifting system of the present technology, the arms when in the supporting position can extend laterally from the head and in the inoperative position extend upwardly from the head.

In some embodiments of the mobile lifting system of the present technology, the post can include a ring gear that is operably engaged with a drive gear of the motor.

Some embodiments of the mobile lifting system of the present technology can include at least one disc associated with the post. The disc can include an open section configured to receiving an end of a moveable lever extending through the head.

In some embodiments, the base is movable between an expanded stabilizing condition and a retracted condition and configured for operation, to move the base between the stabilizing condition and the retracted condition, by the disabled person using the device.

In some embodiments, the head is rotatable about the post through 360 degrees.

In some embodiments, the lifting arm arrangement is pivotably secured to the head and movable between a supporting position and an inoperative position, and the arm arrangement is connected to the base through a linkage means which moves the base into the stabilizing condition when the arm arrangement is in the supporting position and moves the base into the retracted condition when the arm arrangement is in the inoperative position.

In some embodiments, the linkage secures the base in the stabilizing condition while the arm arrangement remains in the supporting position.

In some embodiments, the linkage is a mechanical linkage translating the physical movement of the lifting arm arrangement to a corresponding movement of the legs in the base.

In some embodiments, the linkage is an electro-mechanical combination translating the physical movement of the lifting arm arrangement to a corresponding electronic signal which is converted to motorized means to effect a corresponding movement of the legs in the base.

In some embodiments, the linkage is a fully electronic linkage, effected by operating an actuator in the form of a control panel, wired remote control or wireless remote control on the head in combination with motorized means to effect movement of lifting arm arrangement and legs.

In some embodiments, the lifting arm arrangement includes a pair of spaced apart arms extending from a cross-beam pivotably secured to the head.

In some embodiments, the pair of spaced apart arms has a lifting arm section hingedly attached to each arm.

In some embodiments, the arms when in the supporting position extend laterally from the head and in the inoperative position extend upwardly from the head.

In some embodiments, the lifting arm section is configured to remain lateral when in the supporting position and extend upwardly from the head in the inoperative position.

In some embodiments, the wheels of the base are arranged substantially equally spaced apart on a diameter about the post when the base is in the stabilizing condition.

In some embodiments, the base includes a plurality of legs extending substantially radially from the post in the stabilizing condition, with at least one of the legs being movable from a radial position towards an adjacent leg to bring the base into the retracted condition.

In some embodiments, the legs are at least five legs, two of which are hingedly connected to the hub at the bottom of the post and foldable towards adjacent legs.

In some embodiments, each movable leg is movable independently from a radial position to an adjacent leg to bring the base into the partially stabilizing condition which corresponds to the partial rotational selection made for rotation of the head about the post.

In some embodiments, the actuator is a rotatable handle provided on the head.

In some embodiments, the operation of the handle is configured to give effect to rotation the head about the post or raise and lower the head on the post.

In some embodiments, the actuator is rotatable in opposite directions to rotate the head alternately about the post with rotation mode selected.

In some embodiments, the actuator is rotatable in opposite directions to respectively raise and lower the head on the post with a raising or lowering mode selected utilizing an electronic control unit.

In some embodiments, the handle axially turns a screw-threaded rod rotatably fixed to the head which extends through a correspondingly screw-threaded bore in a carrier fixed to the post.

In some embodiments, the actuator is a motor.

In some embodiments, the actuator is selected from the group consisting of a control panel provided on the head, a wired remote control provided on the head; and a control panel provided on the head associated with wireless remote controlling means.

In some embodiments, the actuator is accessible to the person supported by the lifting arm arrangement for effecting control of the functions of the lifting device.

In some embodiments, the actuator is accessible to the person while not supported by the lifting arm arrangement for effecting control of the functions of the lifting device.

In some embodiments, the handle turns an outer rotary gear, rotatably supported in relation to the head that runs on track provided by an inner annular gear, which is coaxial and fixed relative to the post.

In some embodiments, the outer rotary gear is turned by a handle or other motorized means to effect driven rotation of the head about the post.

In some embodiments, the outer rotary gear is configured to be disengaged from the inner annular gear allowing free rotation of the head about the post.

In some embodiments, the device is configured for operation to limit the rotation of the head about the post.

In some embodiments, the device includes a selectable means to limit the rotation of the head about the post to at least one portion of a full rotation In some embodiments, the selected partial rotation of the head about the post coincides with the base being in a corresponding partially stabilizing condition.

In some embodiments, the base is associated with a set of drive wheels configured for operation to propel the mobile lifting system.

In some embodiments, the drive wheels are each associated with a drive wheel carrier including a spring configured to pivot the drive wheel towards the floor surface.

In some embodiments, a wheel motor can be operable associated with each drive wheel.

In some embodiments, a raising mechanism can be associated with each drive wheel and configured to pivot the drive wheel towards and away from the floor respectively.

In some embodiments, the lifting arm arrangement further comprises a motor operable associated with the cross beam to rotate the lifting arm arrangement between the supporting position and the inoperative position.

In some embodiments, one of the two seating positions is a wheelchair.

In some embodiments, the legs include telescopic elements configured to increase an effective length thereof.

In some embodiments, the lifting arm arrangement includes a strain gauge.

In some embodiments, the head includes means to measure vertical stability of the lifting device.

A person skilled in the art will appreciate that a number of variations may be made to the features of the embodiment described without departing from the scope of the invention. For example, instead of using linear and rotating gears to transfer the vertical movement within the post to horizontal movement at the base, cranks, cams, linkages, chains, a combination of the preceding mechanisms, or any other mechanisms to effect the required movement may be used. Furthermore, instead of having two protrusions and a detachable lever, two separate levers may be used for rotation and raising/lowering of the head relative to the post. Alternatively other mechanisms, such as switch-operated hydraulic, pneumatic or electric actuation may be used to affect rotation and elevation of the head as well as folding and locking of the movable legs.

While embodiments of the lift device have been described in detail, it should be apparent that modifications and variations thereto are possible, all of which fall within the true spirit and scope of the present technology. With respect to the above description then, it is to be realized that the optimum dimensional relationships for the parts of the present technology, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present technology. For example, any suitable sturdy material may be used instead of the above-described. And although assisting users have been described, it should be appreciated that the lift device herein described is also suitable for lifting and moving any object.

Therefore, the foregoing is considered as illustrative only of the principles of the present technology. Further, since numerous modifications and changes will readily occur to those skilled in the art, it is not desired to limit the present technology to the exact construction and operation shown and described, and accordingly, all suitable modifications and equivalents may be resorted to, falling within the scope of the present technology.

What is claimed as being new and desired to be protected by Letters Patent of the United States is as follows:

1. A mobile lifting system comprising:

a base including one or more wheels, the base being movable between an expanded stabilizing condition and a retracted condition and configured for operation, to move the base between the stabilizing condition and the retracted condition by a person using the mobile lifting system; and a post extending from the base, the base including a plurality of substantially equally spaced apart legs extending substantially radially relative to the post, the post movably supporting a head configured for upwards and downwards movement, and the head having a lifting arm arrangement attached thereto, the head being rotatable about the post for transfer of the person between two seating positions which are angularly displaced and in proximity of the post;

wherein the head includes an actuator configured for effecting movement relative to the post, the post being located substantially at a centre of the base configured to provide stability as the lifting arm arrangement on the head is rotated about the post while supporting the person;

wherein an electronic control unit is configured to control the actuator;

wherein the mobile lifting system being configured for operation, to move the head upward and downward on the post and to rotate the head about the post, by the person using the mobile lifting system and for movement with a wheelchair by the person using the wheelchair;

wherein the lifting arm arrangement is pivotably secured to the head and movable between a supporting position and an inoperative position, and the lifting arm arrangement is connected to the base through a linkage which moves the base into the stabilizing condition when the lifting arm arrangement is in the supporting position and moves the base into the retracted condition when the lifting arm arrangement is in the inoperative position.

2. The mobile lifting system of claim 1, wherein the head is rotatable about the post through 360 degrees.

3. The mobile lifting system of claim 1, wherein the linkage secures the base in the stabilizing condition while the lifting arm arrangement remains in the supporting position.

4. The mobile lifting system of claim 1, wherein the linkage is a mechanical linkage translating physical movement of the lifting arm arrangement to a corresponding movement of the legs in the base.

5. The mobile lifting system of claim 1, wherein the linkage is an electro-mechanical combination translating physical movement of the lifting arm arrangement to a corresponding electronic signal which is converted to motorized means to effect a corresponding movement of the legs in the base.

6. The mobile lifting system of claim 1, wherein the linkage is a fully electronic linkage, effected by operating a control panel, wired remote control or wireless remote control in communication with the electronic control unit and in combination with motorized means to effect movement of the lifting arm arrangement and the legs.

7. The mobile lifting system of claim 3, wherein the lifting arm arrangement includes a pair of spaced apart arms extending from a cross-beam pivotably secured to the head.

8. The mobile lifting system of claim 7, wherein the pair of spaced apart arms has a lifting arm section hingedly attached to each of the spaced apart arms respectively.

9. The mobile lifting system of claim 7, wherein the spaced apart arms when in the supporting position extend laterally from the head and in the inoperative position extend upwardly from the head.

10. The mobile lifting system of claim 8, wherein the lifting arm section is configured to remain lateral when in the supporting position and extend upwardly from the head in the inoperative position.

11. The mobile lifting system of claim 2, wherein the wheels of the base are arranged substantially equally spaced apart on a diameter about the post when the base is in the stabilizing condition.

12. The mobile lifting system of claim 11, wherein at least one of the legs being movable from a radial position towards an adjacent leg to bring the base into the retracted condition.

13. The mobile lifting system of claim 12, wherein the legs are at least five legs, two of which are hingedly connected to a hub at the bottom of the post and foldable towards adjacent legs.

14. The mobile lifting system of claim 12, wherein each movable leg is movable independently from a radial position to an adjacent leg to bring the base into a partially stabilizing condition which corresponds to a partial rotational selection made for rotation of the head about the post.

15. The mobile lifting system of claim 1, wherein the actuator is a rotatable handle provided on the head.

16. The mobile lifting system of claim 15, wherein the operation of the handle is configured to give effect to rotation the head about the post or raise and lower the head on the post.

17. The mobile lifting system of claim 1, wherein the actuator is rotatable in opposite directions to rotate the head alternately about the post with rotation mode selected.

18. The mobile lifting system of claim 1, wherein the actuator is rotatable in opposite directions to respectively raise and lower the head on the post with a raising or lowering mode selected utilizing the electronic control unit.

19. The mobile lifting system of claim 15, wherein the handle axially turns a screw-threaded rod rotatably fixed to the head which extends through a correspondingly screw-threaded bore in a carrier fixed to the post.

20. The mobile lifting system of claim 1, wherein the actuator is a motor.

21. The mobile lifting system of claim 1, wherein the electronic control unit includes any one or combination selected from the group consisting of a control panel provided on the head, a wired remote control provided on the head, and a control panel provided on the head associated with wireless remote controlling means.

22. The mobile lifting system of claim 21, wherein the electronic control unit, the control panel, the wired remote control or the wireless remote controlling means is accessible to the person supported by the lifting arm arrangement for effecting control of functions of the mobile lifting system.

23. The mobile lifting system of claim 21, wherein the electronic control unit, the control panel, the wired remote control or the wireless remote controlling means is accessible to the person while not supported by the lifting arm arrangement for effecting control of functions of the mobile lifting system.

24. The mobile lifting system of claim 1, wherein the actuator turns an outer rotary gear, rotatably supported in relation to the head that runs on track provided by an inner annular gear, which is coaxial and fixed relative to the post.

25. The mobile lifting system of claim 24, wherein the outer rotary gear is turned by a motorized means to effect driven rotation of the head about the post.

26. The mobile lifting system of claim 25, wherein the outer rotary gear is configured to be disengaged from the inner annular gear allowing free rotation of the head about the post.

27. The mobile lifting system of claim 1, wherein the mobile lifting system is configured for operation to limit the rotation of the head about the post.

28. The mobile lifting system of claim 27, wherein the mobile lifting system includes a selectable means to limit the rotation of the head about the post to at least one portion of a full rotation.

29. The mobile lifting system of claim 28, wherein the selected partial rotation of the head about the post coincides with the base being in a corresponding partially stabilizing condition.

30. The mobile lifting system of claim 1, wherein one or more of the wheels are drive wheels configured for operation to propel the mobile lifting system.

31. The mobile lifting system of claim 30, wherein each of the drive wheels is associated with a drive wheel carrier including a spring configured to pivot the drive wheel towards a floor surface.

32. The mobile lifting system of claim 31 further comprising a wheel motor operable associated with each drive wheel.

33. The mobile lifting system of claim 32 further comprising a raising mechanism associated with each drive wheel and configured to pivot the drive wheel towards and away from the floor surface respectively.

34. The mobile lifting system of claim 9, wherein the lifting arm arrangement further comprises a motor operable associated with the cross beam to rotate the lifting arm arrangement between the supporting position and the inoperative position.

35. The mobile lifting system of claim 1, wherein one of the two seating positions is a wheelchair.

36. The mobile lifting system of claim 12, wherein the legs includes telescopic elements configured to increase an effective length thereof.

37. The mobile lifting system of claim 9, wherein the lifting arm arrangement includes a strain gauge.

38. The mobile lifting system of claim 1, wherein the head includes means to measure vertical stability of the mobile lifting system.

39. A mobile lifting system comprising:

a base unit including a plurality of substantially equally spaced apart legs movable between an expanded stabilizing condition and a retracted condition and configured for operation, to move the legs between the stabilizing condition and the retracted condition;

a post extending from the base unit, the post movably supporting a head for upwards and downwards movement, and the head being rotatable about the post, wherein the legs of the base unit extend substantially radially relative to the post;

a lifting arm arrangement pivotably attached to the head;

a motor configured to rotate the head about the post; and an electronic control unit configured or configurable to control at least one motive element in the base unit that moves the legs into the stabilizing condition when the lifting arm arrangement is in a supporting position and moves the legs into the retracted condition when the lifting arm arrangement is in an inoperative position;

wherein the lifting arm arrangement is pivotably secured to the head and movable between a supporting position and an inoperative position, and the lifting arm arrangement is connected to the base through a linkage which moves the base into the stabilizing condition when the lifting arm arrangement is in the supporting position and moves the base into the retracted condition when the lifting arm arrangement is in the inoperative position.

* * * * *